US006471202B1

(12) United States Patent
Sugimura

(10) Patent No.: US 6,471,202 B1
(45) Date of Patent: Oct. 29, 2002

(54) SHEET FEEDING APPARATUS AND IMAGE PROCESSING APPARATUS

(75) Inventor: Hideo Sugimura, Kunitachi (JP)

(73) Assignee: Canon Kabushiki Kaisha, Tokyo (JP)

( * ) Notice: Subject to any disclaimer, the term of this patent is extended or adjusted under 35 U.S.C. 154(b) by 160 days.

(21) Appl. No.: 09/698,240

(22) Filed: Oct. 30, 2000

(30) Foreign Application Priority Data

Oct. 29, 1999 (JP) ..... 11-308007
Oct. 29, 1999 (JP) ..... 11-308008

(51) Int. Cl.[7] ..... B65H 5/00

(52) U.S. Cl. ..... 271/10.11; 271/10.13; 271/119; 271/273

(58) Field of Search ..... 271/10.09, 10.11, 271/10.13, 114, 119, 272, 273

(56) References Cited

U.S. PATENT DOCUMENTS 4,925,062 A * 5/1990 Tsukamoto et al. ..... 271/114 X
5,480,132 A * 1/1996 Kiyohara et al. ..... 271/10.01
5,571,265 A * 11/1996 Yagi et al. ..... 271/119
5,681,036 A * 10/1997 Wakahara et al. ..... 271/119 X

* cited by examiner

*Primary Examiner*—David H. Bollinger
(74) *Attorney, Agent, or Firm*—Fitzpatrick, Cella, Harper & Scinto

(57) ABSTRACT

Present invention relates to a sheet feeding apparatus for conveying a sheet from a feeding roller to an image processing section, comprising an intermediate conveyance roller disposed between the feeding roller and the image processing section, a drive source providing a rotary drive force to the intermediate conveyance roller, an intermediate conveyance roller moving mechanism for moving the intermediate conveyance roller to be projecting in a sheet conveyance route so as to be conveyable of the sheet when the drive source is driven in one rotational direction and to be escaping from the sheet conveyance route when the drive source is driven in the other rotational direction and an intermediate conveyance roller normally feeding mechanism for rotating the intermediate conveyance roller in only one sheet feeding direction notwithstanding of the rotational direction of the drive source.

10 Claims, 78 Drawing Sheets

SHEET FEEDING APPARATUS AND IMAGE PROCESSING APPARATUS

BACKGROUND OF THE INVENTION

1. Field of the Invention

This invention relates to a sheet feeding apparatus applicable to an image processing apparatus such as a photocopier, a printer, a facsimile machine, and the like and, more particularly, to a sheet feeding apparatus for feeding sheets to an image forming section and an image processing apparatus to which the sheet feeding apparatus is mounted.

2. Description of Prior Art

As a sheet feeding apparatus applying to an image processing apparatus such as a printer or the like, an apparatus has been known in which plural sheets are stacked and contained in feeding cassettes, in which a feeding roller formed in the apparatus body presses the top surface of the stacked sheets, in which the sheet is picked up and fed sheet by sheet from the topmost sheet of the stacked sheets by the rotation of the feeding roller, and in which the sheet is conveyed to an image processing apparatus (such as recording section) by intermediate conveyance roller.

For example, with a conventional recording apparatus as for an image processing apparatus, a recording sheet that has conveyed to the recording section is conveyed by the feeding roller of the recording section and the intermediate conveyance roller as described above during the subsequent recording operation. Stable conveyance is tried by synchronized drive of the feeding roller of the recording section and the intermediate conveyance roller as described above.

However, both rollers cannot make perfectly synchronized feeding due to various factors such as pulsation movements of the drive system and differences in inertia of the drive system, and therefore, slight disorders in feeding may occur, creating fogs in recording image quality.

To cancel such feeding disorders due to asynchrony between the feeding roller and the intermediate conveyance roller, there is an apparatus that the intermediate conveyance roller is not driven during recording operation after the recording sheet is conveyed to the recording section. That is, the intermediate conveyance roller is driven through a one-way clutch, and where the feeding roller in the recording section conveys the recording sheet, the intermediate conveyance roller idles by function of the one-way clutch.

With this apparatus, however, though feeding disorders due to asynchrony between the above both rollers can be avoided, the intermediate conveyance roller idles together with the conveyed sheet, thereby rendering the idling of the intermediate conveyance roller by itself loaded to the sheets, so that sheets may be subject to back tension in the recording section. Accordingly, conveyance in the recording section by feeding roller becomes unstable, so that the recording images may be disordered, and in some cases, images may be shrunk in the feeding direction.

It is an object of the invention to provide a sheet feeding apparatus enabling sheets to be stably fed without receiving interference with the intermediate conveyance roller at the image processing section such as a recording section or the like, improving sheet conveyance performance in the image processing section, and improving the recording image quality.

SUMMARY OF THE INVENTION

To accomplish the above object, a representative structure of the invention, as a sheet feeding apparatus for conveying sheets from a feeding roller to an image processing section, includes an intermediate conveyance roller disposed between the feeding roller and the image processing section; a drive source providing a rotary drive force to the intermediate conveyance roller; an intermediate conveyance roller moving mechanism for moving the intermediate conveyance roller to be projecting in a sheet conveyance route so as to be conveyable of the sheet when the drive source is driven in one rotational direction and to be escaping from the sheet conveyance route when the drive source is driven in the other rotational direction; and an intermediate conveyance roller normally feeding mechanism for rotating the intermediate conveyance roller in only one sheet feeding direction notwithstanding of the rotational direction of the drive source.

According to this sheet feeding apparatus, since the intermediate conveyance roller normally rotating in the sheet feeding direction can project in and escape from the sheet conveyance route, the sheet can be conveyed smoothly without exerting any load due to shifts in operation of the drive system.

In another aspect of the invention, a sheet feeding apparatus includes: a feeding roller rotatively driven through a one-way clutch capable of selectively outputting rotation input for feeding a sheet in a sheet by sheet manner; an intermediate conveyance roller for conveying the sheet to an image processing section; intermediate conveyance roller supporting means for supporting the intermediate conveyance roller, the intermediate conveyance roller supporting means rotatable to a position rendering the intermediate conveyance roller project in a sheet conveyance route and to a position rendering the intermediate conveyance roller escape from the sheet conveyance route; and a clutch locking mechanism for locking the one-way clutch to stop rotation output given to the feeding roller and for unlocking the one-way clutch, wherein the one-way clutch is unlocked at a time that the intermediate conveyance roller is projecting in the sheet conveyance route by rotation of the intermediate conveyance roller supporting means.

According to this sheet feeding apparatus, since the locking mechanism locks and unlocks the one-way clutch transmitting drive to the feeding roller in association with the motion of the intermediate conveyance roller, the sheet can be conveyed smoothly in releasing loads to the intermediate conveyance roller as well as the feeding roller when the sheet enters in the image processing section.

DESCRIPTION OF PREFERRED EMBODIMENTS

First Embodiment

Figure 1:
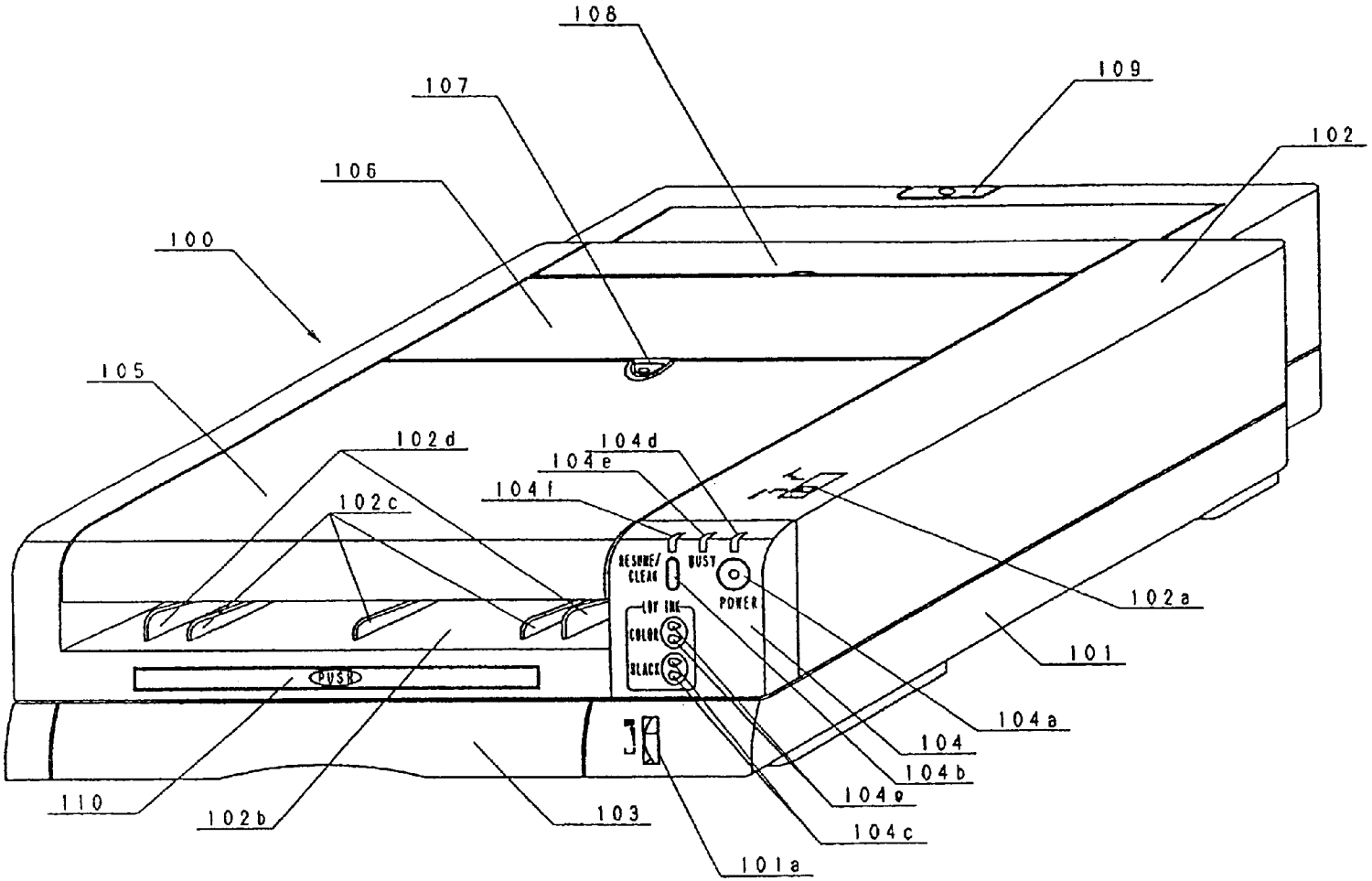
FIG. 1 is a perspective view of a sheet feeding apparatus according to an embodiment of the invention.

Referring to the drawings, an embodiment of a recording apparatus to which the above means apply is described next. The recording apparatus is described as an image processing apparatus, but the same sheet feeding apparatus can be used in an image reading apparatus.

This embodiment is described with use of a serial type inkjet recording apparatus, and the recording apparatus uses, as a recording head, a disposable type recording head detachably attached to the recording apparatus.

Whole Structure

Figure 2:
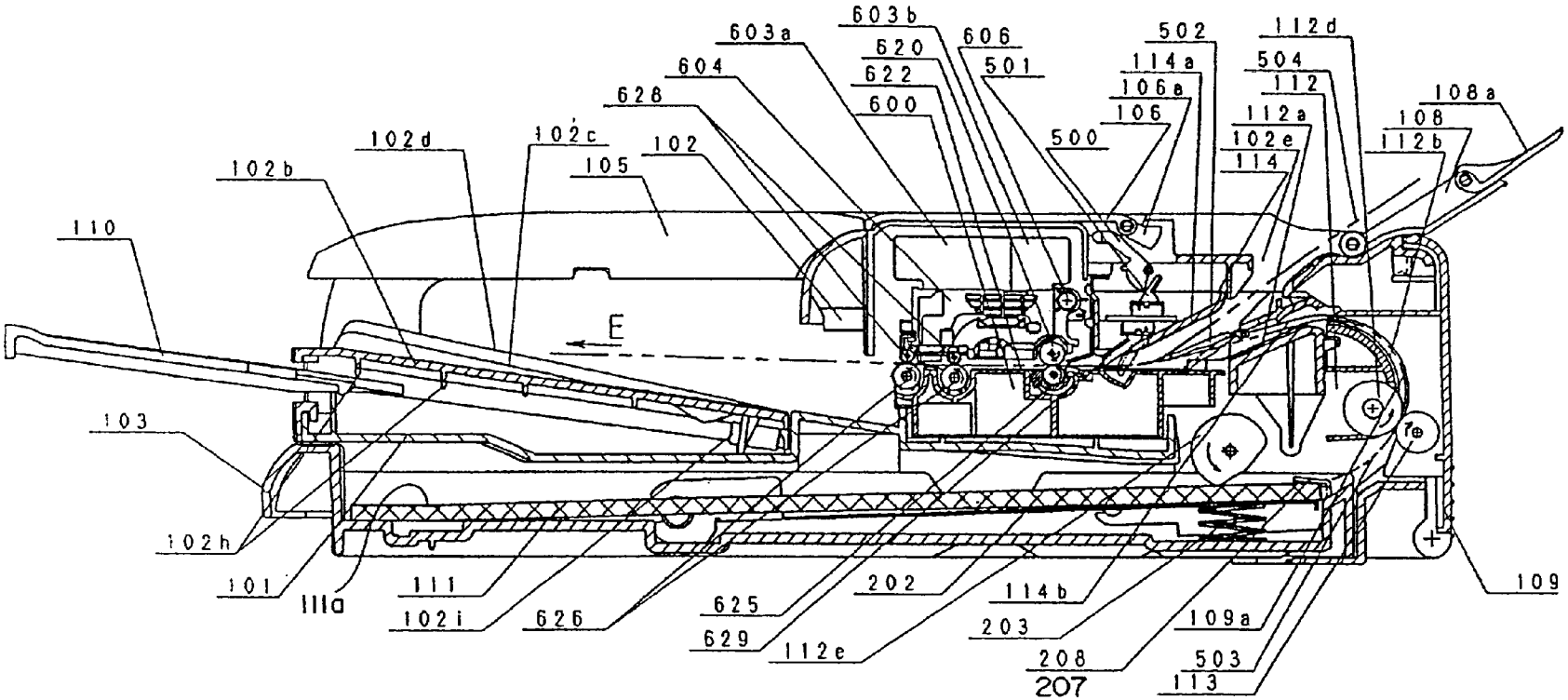
FIG. 2 is a lateral cross section of the sheet feeding apparatus according to an embodiment of the invention.

FIG. 1 is an eternal perspective view of the recording apparatus; FIG. 2 is a right cross section showing a sheet conveyance route of a recording sheet of a recording apparatus.

First of all, a basic structure of the recording apparatus is described in reference to FIG. 1 and FIG. 2.

In FIG. 1, numeral 101 is a base (bottom case) and is constituting a housing and chassis of the recording apparatus with a main casing 102.

Numeral 101*a* is an indicator portion which can show a sheet remaining amount and shows a remaining amount of recording sheets stacked on a feeding cassette 103. Numeral 102*a* is a selection switch and has a structure for selecting modes of two types (A/B) corresponding to a specification of an apparatus (namely, computer or STB) sending data to this recording apparatus.

A recording sheets delivery portion 102*b* is formed over the feeding cassette, and recording sheets are delivered along top portions of ribs 102*c* (three) and ribs 102*d* (two) as ribs placed in extending in a delivery direction at a recording sheet delivery portion for receiving delivered sheets, and the recording sheets delivered afterward are stacked on previously delivered recording sheets.

Numeral 201 is a base cassette and a base member of the feeding cassette 103. The base cassette is detachably attached to the recording apparatus body, stacks recording sheets in a plural number, and supplies the recording sheets to the recording apparatus sheet by sheet separately by a feeding mechanism as described below.

Numeral 104 is a control panel, which is formed with a power switch 104*a*, a reset switch 104*b*, a power source indicator 104*d*, a date transmission indicator 104*e*, an error indicator 104*f*, and am ink remaining amount indicator for displaying the ink remaining amount in both of black ink and color inks. Numeral 104*c* is for remaining amount indicator for black ink, which is provided in two, and numeral 104*g* is for remaining amount indicator for color ink, which is provided in two. The remaining amount of ink is indicated with three step indication modes of "no turning on", "only one turning on", and "two turning on" corresponding to the used ink amount with respect to each color, and when the containing amount of the tank is categorized in two types, the indicator shows with implied differences according to the respective containing amounts.

It is to be noted that the ink remaining amount detecting method in this invention includes the steps of, for both of color inks and black ink, counting a total dot number sprayed by recording operation and recovery operation, and comparing the sprayed dot number with the prescribed ink total capacity (total dot number), to detect the ink remaining amount.

In the main casing 102, each dot counter reset key, not shown, is provided (total two pieces) corresponding to each of color and black to reset the dot counter number as described above at a position where an access cover 106 is opened. The counter is reset upon pushing the switch corresponding to a newly replaced tank when the user begins to use the tank by replacing the old tank, and where the ink remaining amount indicator is turned on, the indicator is turned off.

Numeral 105 is a delivery cover and shields a top of the recording sheet delivery portion 102*b* described above to which the recording sheets delivered from the printer are stacked. The delivery cover 105 is detachably attached to the main casing 102. The top surface of the delivery cover 105 is approximately flat in almost entire portions thereof and is made as substantially the same level as the top surface of the main casing 102 and other structural parts.

The delivery cover 105 having substantially the flat top surface region is thus detachably attached as to render the apparatus top as a whole substantially flat, so that the height of the apparatus body is made low, and at the same time, other apparatuses can be mounted to the flat portion formed at the entire top of the apparatus body.

The plural ribs are provided on the back surface of the delivery cover 105 along the sheet conveyance direction, so that in the case where the delivered recording sheets are curled upward, the above ribs guide the conveyance of the recording sheets.

Numeral 106 is an access cover. When the recording head cartridge or ink tank of a disposable type in this embodiment is newly attached or replaced, the access cover is opened after unlocked by an access cover locking portion 107 to allow replacement work.

A lever portion 106*a* is formed at the access cover 106. While the access cover 106 is opened, the lever of the cover switch 501 is rotated by a cover arm 500 rotatably mounted to the printer unit to turn on the switch, and thereby the open state of the access cover is recognized. This apparatus has a sequence (see, FIG. 2) that the carrier is automatically moved to a cartridge replacing position after a prescribed time passes upon detection of opening of the cover and that the carrier is automatically moved to a predetermined position (home position, recovery operation position, or the like) where the above means detects the access cover closed.

Numeral 108 is a manual feeding cover. Where sheets, such as envelops or postal cards, not conveyed from feeding cassettes, are subject to recording operation, the manual feeding cover 108 is opened to expose an manual opening 102*e* of the main casing 102, and the sheet 111 is inserted to the recording position from the manual opening 102*e*.

At that time, the recording sheets to be manually fed are supported from the lower side of the sheets by the plural ribs formed on a back surface of the manual tray and introduced to the feeding opening. Numeral 108*a* is a subsidiary tray. The subsidiary tray 108*a* is contained in a collapsed manner while the manual feeding tray is closed and held as to assist the length of the manual feeding tray while the manual feeding tray is opened to support the entry of the sheets.

Numeral 114 is a paper passing guide, which is a member constituting the recording sheet conveyance route as described below and is attached to the printer unit 600.

Numeral 502 is a flapper and attached rotatably to the paper passing guide 114, and operates to introduce sheets to the sheet introduction opening of the printer unit 600 (see, FIG. 2) when sheets are manually fed as described below.

Numeral 109 is a U-turn cover and a member constituting the recording sheet conveyance route as described below. The U-turn cover 109 is used to remove jammed sheet or sheets in opening the U-turn cover 109 where the recording sheet or sheets are jammed due to some cause in the recording sheet conveyance route.

Numeral 110 is a delivery tray and is a member supporting (assisting) sheets for preventing the sheets from dropping out of the apparatus body (near side) where the recording sheets delivered from the printer unit are delivered to the recording sheet delivery portion 102*b* as described above. The delivery tray 101 is normally in a state that contained in the apparatus body and when necessary, in a state that pulled out of the apparatus body (see, FIG. 2).

Recording Sheet Conveyance Route

Referring to FIG. 2, the sheet conveyance route in the recording apparatus according to the invention is described. As a sheet feeding means in this invention, there are two methods: a feeding cassette, and a manual feeding.

Now, recording sheet conveyance route using the feeding cassette is described.

In FIG. 2, the numeral 111 is stacked recording sheets. The recording sheets 111 are set at a prescribed position of the feeding cassette 103 as described above. A pressing plate 202 as a holding member for holding the recording sheets upward is mounted below the stacked recording sheets 111 as to be rotatable with respect to the feeding cassette and are urged upward by a pair of the pressing plates 203. A pair of separation nails 207, 208 are disposed near the paper outlet of the feeding cassette as to engage to corner portions of the topmost surface of the stacked recording sheets 111.

Numeral 112 is an ASF (Automatic Sheet Feeding or Auto Sheet Feed) and plays a role to separately convey the topmost sheet of the recording sheets stacked on the feeding cassette to the printer unit 600. Detail of the ASF unit will be described below.

In the ASF unit 112, numeral 112*e* is a feeding roller and separately conveys only the topmost recording sheet of the stacked recording sheets 111. Numeral 112*a* and numeral 112*b* are guide surfaces constituting the feeding route. The guide surfaces 112*a*, 112*b* constitute the feeding route with guide ribs 109*a* constituting a feeding route formed at the U-turn cover 109 and with guide ribs 114*b* formed at the paper passing guide 114.

The route is for substantially U-turn route. As for the sheet conveyance direction, the direction that the sole sheet picked up from the cassette is conveyed is going away from the printer unit, but the feeding route in substantially the U-turn shape made of the guide surface and the guide ribs renders the conveyance direction turns about 180 degrees with the smooth curvature, thereby conveying the recording sheets in a direction to the recording starting position at the printer unit.

The conveyance route located ahead of the U-turn route is constituted of the guide surface 114*a* formed at the paper passing guide 114 and the ribs 622*b* formed on the platen 622, and introduces the sheets to the feeding roller.

In the ASF unit 112, numeral 112*d* is a U-turn roller, and a U-turn pinch roller 113 rotatively attached to the base is urged to the U-turn roller 112*d* with proper spring force. The U-turn pinch roller rotates by being driven from the rotation of the U-turn roller 112, thereby nipping the sheet to convey the sheet.

The recording sheets 111 are stacked in a plural number in the feeding cassette 103 and inserted in the recording apparatus body. The feeding roller 112*e* installed in the ASF unit 112 rotates in a direction of CCW in the drawing according to a preset sequence, thereby separating the topmost recording sheet of the stacked plural sheets to a single sheet with the separation nails 207, 208 placed at the feeding cassette 103 and at the same time beginning the sheet conveyance.

Detail of the feeding cassette 103 is described below. The recording sheet 111 separated from the feeding cassette 103 is further conveyed by the feeding roller as described above, and when reaching the U-turn roller 112*d*, the recording sheets 111 is nipped and conveyed by the U-turn roller 112*d* and the U-turn pinch roller 113. The recording sheet 111 is conveyed to a LF(feeding) roller 620 rotatably attached to a printer unit 600 via the U-turn feeding route. The flapper 502 is at that time pushed up by the recording sheet to open the conveyance route for the recording sheet.

A pinch roller 625 attached rotatably to the printer unit 600 is urged to the feeding roller 620 by appropriate spring force. The pinch roller 113 is driven to rotate according to the rotation of the feeding roller 620, thereby nipping and conveying the recording sheet reaching the feeding roller.

Numeral 626 is delivery rollers (two row). Plural spurs 628 attached rotatably to the printer unit 600 are urged to the delivery roller 626 by appropriate spring force. The spurs 628 are driven to rotate according to the rotation of the delivery roller 626, thereby nipping and conveying the recording sheet.

Detail of the printer unit 600 will be described below.

The recording sheet 111 conveyed by the feeding roller 620 described above is further conveyed in E direction in the drawing by the delivery roller 626 described above. The recording sheet 111 is delivered finally along the top of the ribs 102*c*, 102*d* as ribs for receiving delivered sheets as described above, and the sheets thus delivered sequentially are stacked on the sheets previously delivered.

The recording sheet conveyance route by the feeding cassette as described above is shown with a double dot chain line 503 (see, FIG. 2).

Numeral 629 is a paper sensor and used as a means for detecting the position of the front end of the recording sheet. The paper sensor 629 detects the arrival of the recording sheet 111 by pulling up of the lever by the front end of the recording sheet 111 conveyed by the feeding roller 112*e* and the U-turn roller 112*d*. After sensor's detection, the recording sheet 111 is set to the recording start position by conveying the recording sheet 111 in a prescribed amount.

Numeral 604 is a carrier, to which a recording head cartridge 601 is detachably mounted. A replaceable color ink tank 603*a* and black ink tank 603*b* are mounted to the recording head cartridge 601, and the carrier 604 is held by a guide shaft 606 and a guide rail 607 and is movable reciprocally in a main scanning direction. Detail of the carrier is described below.

Next, the recording sheet conveyance route for manual feeding is described.

In the case of the manual feeding, the manual feeding cover 108 is open, and the recording sheet is inserted through the manual feeding opening 102*e*. The recording sheet is pushed until the sheet front end hits the feeding roller 620 where passing the sheet route constituted of the guide surface made at the paper passing guide 114 and the ribs 622*b* formed on the platen 622.

At that time, the flapper 502 is grounded at a prescribed position of the platen by the self-weight, thereby supporting the insertion of the recording sheet.

When the sheet hits the feeding roller 620, the paper sensor 629 disposed right before the feeding roller 620 is turned on to detect that the recording sheet is inserted, and the recording sheet is conveyed in a prescribed amount by drive of the feeding roller 620 in the prescribed amount after a prescribed period of time passes, and then, the recording sheet is set to a printing start position by conveying the recording sheet in the reverse direction (upstream direction) by reverse rotation of the feeding roller.

In those series of operations, it is confirmed that the recording sheet is surely conveyed by the feeding roller by detection of turning on of the delivery sensor 630 attached on a downstream side of the feeding roller. If not turned on, it is judged as an error state in which the recording sheet is not set properly, and the apparatus performs an error treatment to prevent ink stains, which otherwise occurs by printing at a place other than the recording sheet, from occurring.

Particularly, where a recording sheet having a short size is manually fed, the rear end of the sheet completely enters in the manual feeding opening during feeding (forward feeding) for confirming the sheet insertion, but during the conveyance of the recording sheet in the reverse direction, the sheet rear end is introduced in the direction toward the manual feeding opening 102*e* by the slope of the flapper, thereby preventing the recording sheet from jamming, which otherwise occur due to entry of the sheet rear end into some irregular portion such as the U-turn route or the like.

The recording sheet conveyance route by the manual feeding as a series of operations described above is shown with a double dot chain line 504 (see, FIG. 2). The recording operation and the like after the recording sheet is set to the printing start position are substantially the same as those for cassette feeding.

Base, Delivery Tray

The delivery tray 110, when pulled out as shown in FIG. 2, is sandwiched by a tray sliding surface 101*o* of the base 101 and rubs 102*h* of the main casing 102 to limit plays in the rotational direction. A nail 110*a* of the delivery tray 110 engages with a tray stopper 101*p* of the base 101, thereby preventing the tray from ejecting in the pulling-out direction. Where the delivery tray 110 contains sheets, a latch 1021 attached to the main casing 102 engages with a projection 110*b* of the delivery tray 110 to secure the tray. A user disengages the latch by pushing the front surface of the delivery tray 110 one time, and then pulls out the delivery tray 110 to a prescribed position (position in FIG. 2).

Figure 13:
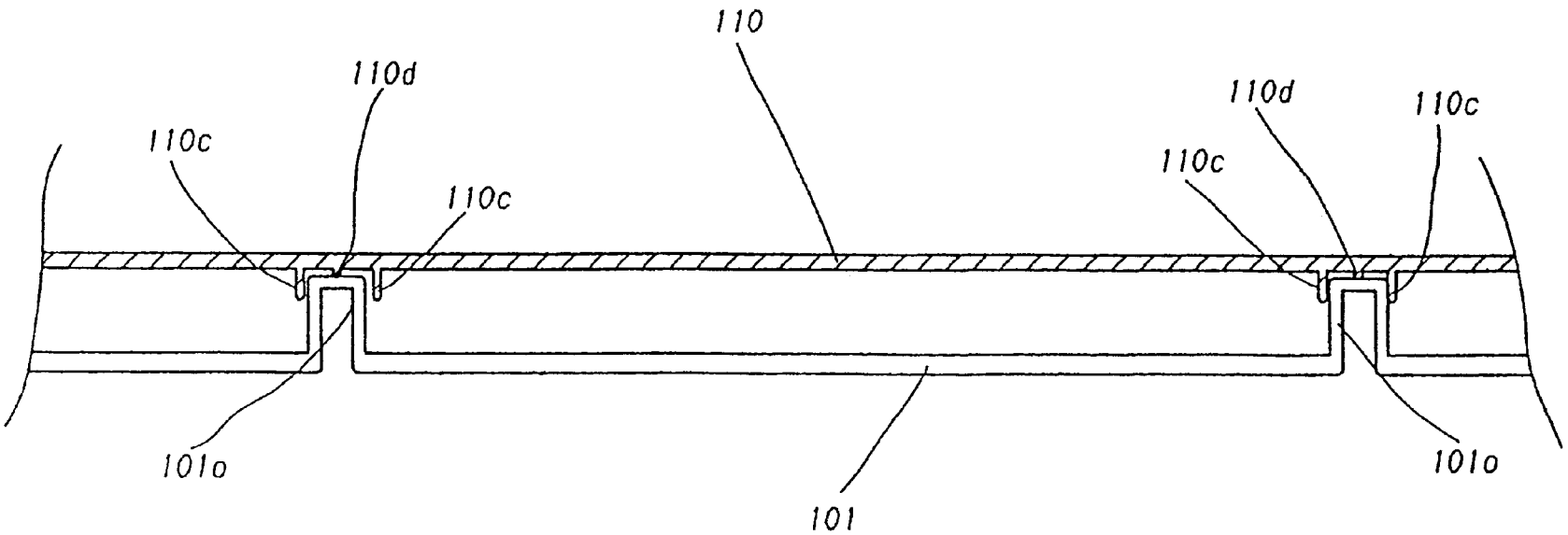
FIG. 13 is a cross section showing a sliding portion of a tray.

FIG. 13 is a cross section showing the base 101 and a sliding portion of the delivery tray 110. Ribs 110*c* are formed at the delivery tray 110 as to sandwich the tray sliding surface 101*o* formed on the base 101. By designing at least either of those to be without any gap as much as possible, plays of the delivery tray 110 to the base 101 are eliminated. The sliding ribs 110*d* are formed between the ribs 110*c* as to contact with the top surface of the tray sliding surface 101*o*, and therefore, the sliding ribs 110*s* always contact with the top during pulling out of the delivery tray 110 to make sliding operation.

Base, Structural Elements

Figure 3:
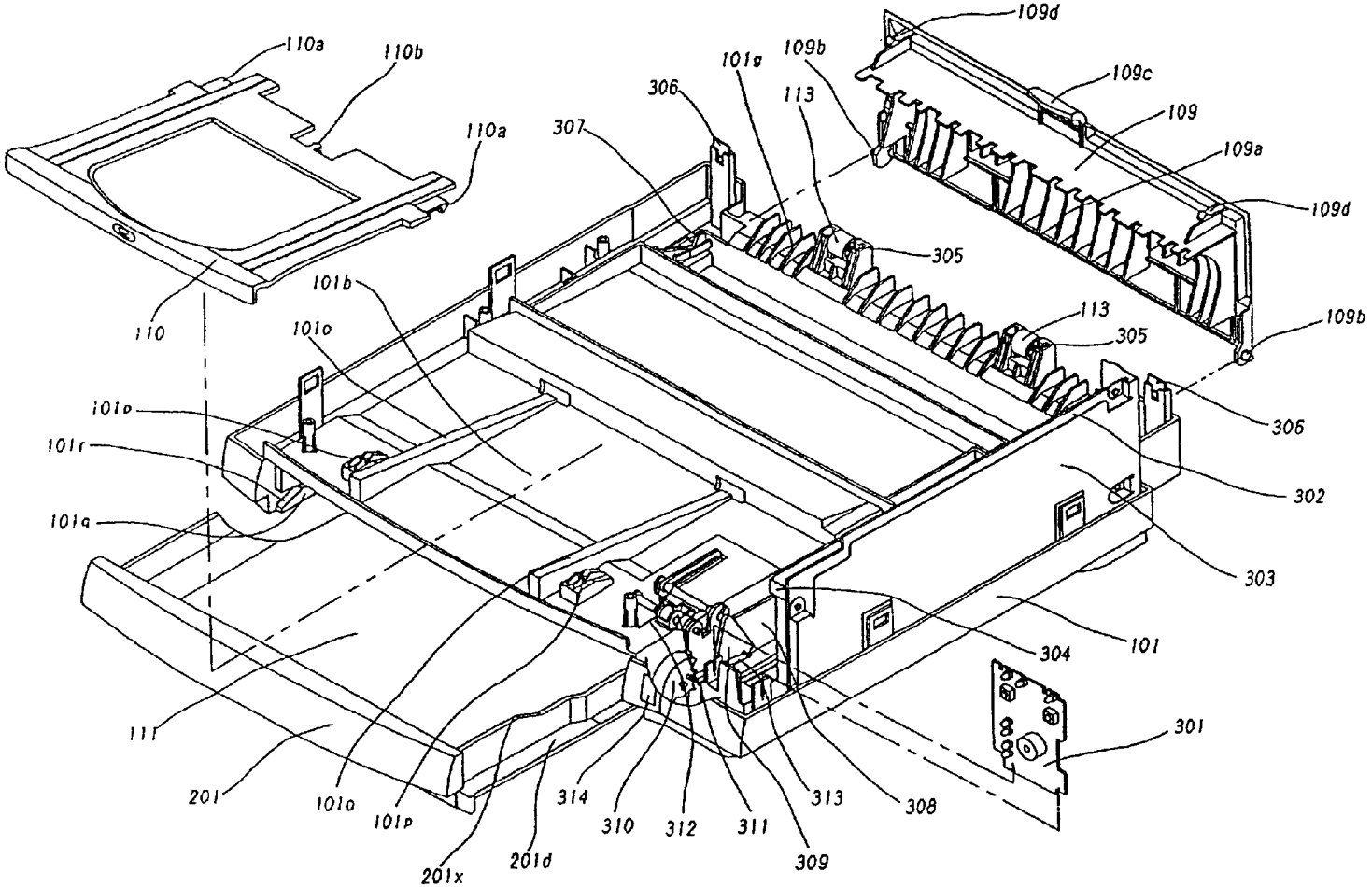
FIG. 3 is a perspective view showing base composition elements (excluding ASF unit, printer unit)

FIG. 3 is a perspective view showing internal structural parts, at a state that an upper body such as the main casing 1022 is detached. FIG. 3 actually shows a state that the printer unit and the ASF unit incorporated in the base 101 are removed. A space is formed for mounting a feeding cassette 103 stacking the recording sheets 111 below the center of the base 101, and the base 101 is defined by a surface 101*b* covering the top surface of the feeding case 103.

A main substrate 302 controlling the printer, as the mounting surface thereof is covered by the PWB guard 304 made as a metal part, is attached to a PWB chassis 303 made as a metal part in the same way and secured to the base 101. The PWB guard 304 is for preventing fire, which occurs at capacitors or the like on the main substrate 302, from spreading to the body such as the base 101. The PWB guard 304, as well as the PWB chassis 303, encloses the main substrate 302, so that the guard 304 has a shielding effect to suppress noises emitted from the main substrate 302.

An operation panel substrate 301 coupled to the main substrate 302 through a cable, not shown, is secured to the base 101 as the mounting surface thereof faces to the front face of the apparatus body 100.

A locking nut 306 having a female screw is inserted with pressure at the rear side of the base 101 and engages with the main casing 102 with a screw, thereby rendering engagement firm between the base 101 and the casing 102.

A route for reversing the conveyance direction of the recording sheets 111 is formed on a rear side in the insertion direction of the feeding case 103. The route is formed of guide ribs 101*g* formed in a plural number at the base 101 and guide ribs 109*a* formed in a plural number in the same way at the U-turn cover 109. Since both guide ribs 101*g*, 109*g* are disposed in a stagger manner in a direction perpendicular to the proceeding direction of the recording sheet 111, the recording sheet 111 is smoothly transferred among the guide ribs 101*g*, 109*g* without being trapped, thereby doing smooth conveyance. The U-turn cover 109 is supported rotatably with a shaft 109*b* of the cover to the bearing 101*h* formed at the base 101 as described below. Therefore, even if a trouble occurs such that the recording sheet 111 is left over in the conveyance route, a part of the conveyance route is made open by rotation of the U-turn cover 109, so that the user can easily remove the sheet.

The U-turn pinch roller 113 is disposed in the conveyance route. The U-turn pinch roller 113 is freely rotatable with respect to a pinch roller shaft 305 as a closely contacting spring, and the shaft itself constitutes a spring, so that a proper pressure is always generated when the U-turn roller 112*d* is in pressed contact with the roller 113 and the recording sheet 111 is stably conveyed.

Figure 14:
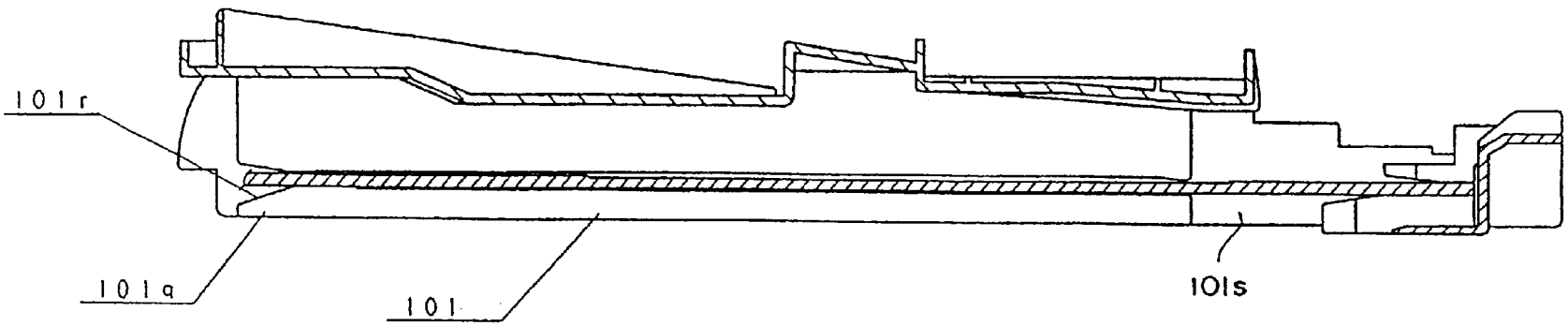
FIG. 14 is a cross section showing a cassette introduction opening (rail) at a base

A cassette supporting surface 101*q* is formed on each side surface of the attachment of the cassette 201 for supporting the rails 201*d* of the cassette 201. A tapered surface 101*r* is formed at a tip of the cassette supporting surface 101*q* so that the cassette 201 can be easily inserted (see, FIG. 14).

Base, Holding of Cassette

As shown in FIG. 3, a coil spring and a cassette side pushing member 307 are assembled to the base 101 for preventing the cassette 103 from dropping out and for urging the cassette to the printing reference.

Figure 4:
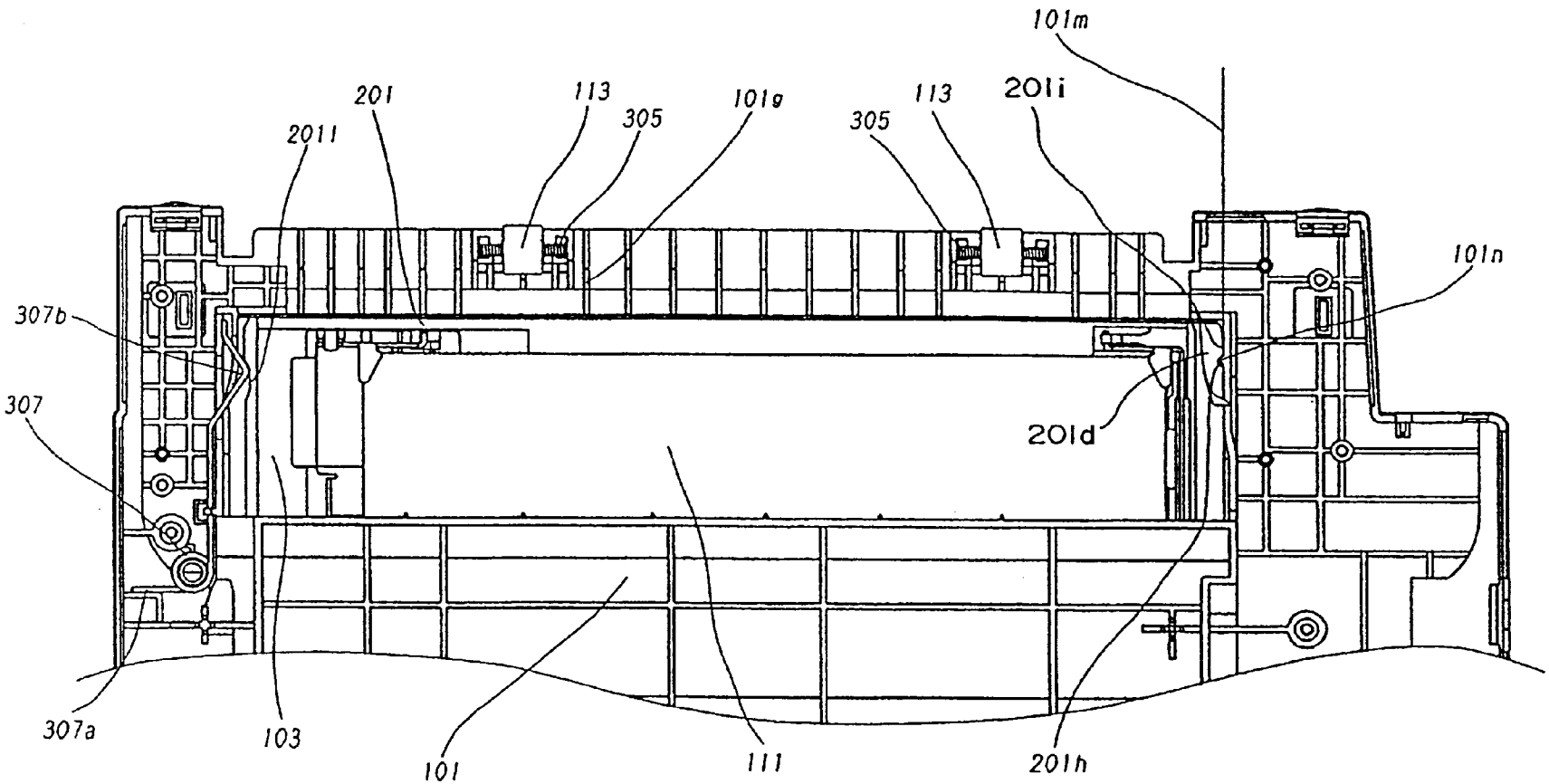
FIG. 4 is a plan view showing an attached state of cassettes.

FIG. 4 is a plan view (partially perspective view) showing a mounted state of the cassette 103 to the base 101. The cassette side pushing member 307 has two arms of a fixed end restricted by the base 101 and a free end 307*b* projecting as to contact with the cassette 201. The free end 307*b* is loosen during attaching or detaching of the cassette 201, and because the end 307*b* gives proper clicking feeding, the user can recognize that the cassette 201 is surely mounted to a right position. Where the cassette 201 is attached to the right position, a reference side surface 201 of the cassette 201 is urged by the cassette side pushing member 307 to a cassette pushing reference surface 101*m* of the base 101. The feeding cassette 103 is held without dropping out by engaging a recess 201h formed at the cassette 201 with a cassette clicking projection 101*n* formed at the base and by engaging the cassette side pushing member 307 with a recess 201*l* formed at a side wall of the cassette 201.

Base, Back Surface and Quick Sheet

Figure 5:
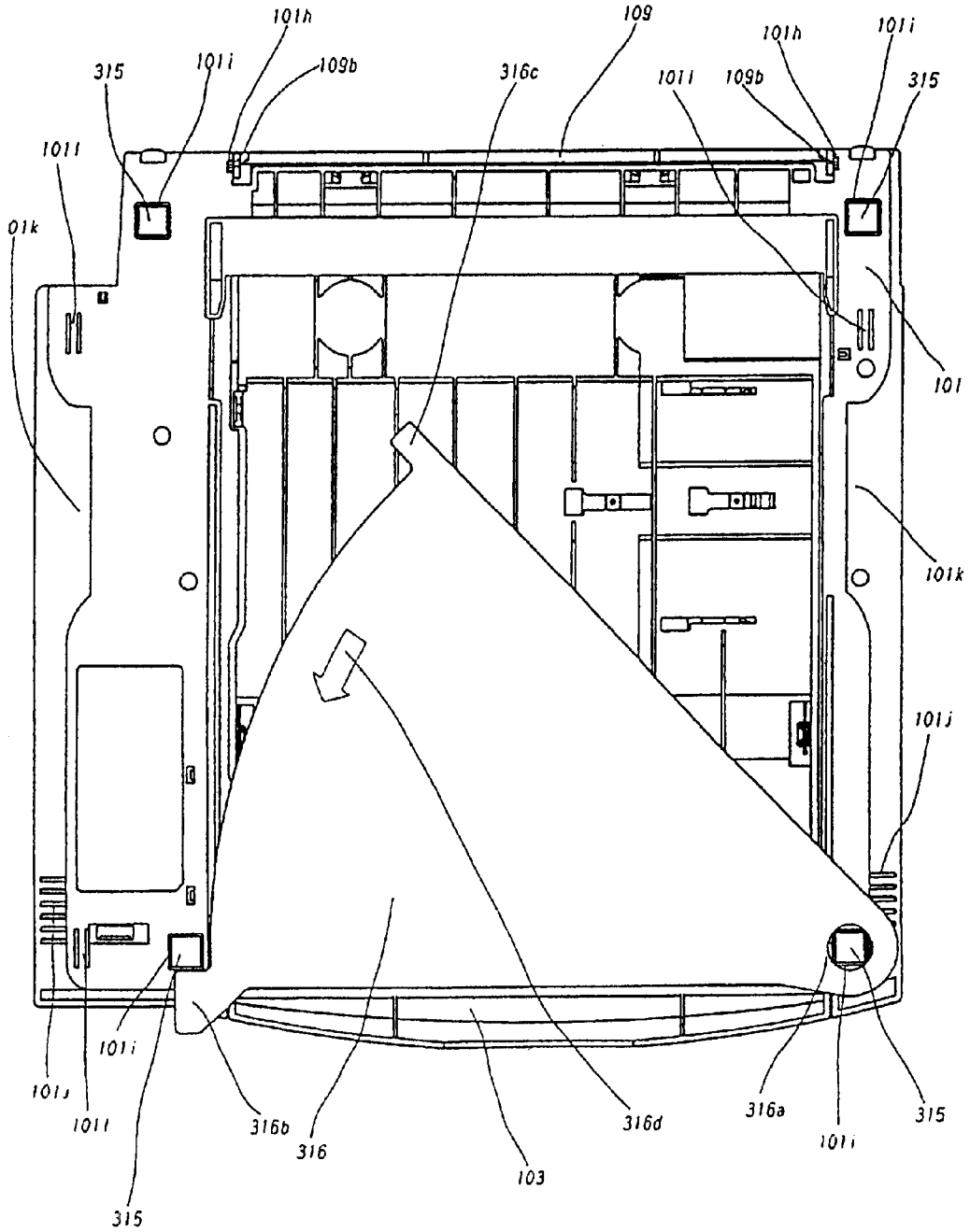
FIG. 5 is a rear view showing a contained state of quick sheets.

FIG. 5 is a diagram showing a bottom surface of the apparatus body 100. A rubber leg 315 is adhered in a rib/rubber leg positioning projection 101*i* formed in a rectangular shape at the base 101. The rubber legs 315 support the apparatus body at the mounted state, and other than the rubber legs, dummy legs 1011 are disposed in some places. The dummy leg 1011 is formed lower than the rubber leg 315 and normally not grounded, but when a load is exerted to the apparatus body 100, the dummy legs 1011 touch down to prevent the apparatus body 100 from deforming. A traction for drawing 110*j* is provided on each side on a front and back side of the base 101, and the base can be drawn easily to a near side. A recess 101*k* for carrying is formed with a space so as to allow a hand to enter readily at a position around the gravity center in the front and rear direction of the apparatus body 100.

A bearing 101*h* for the U-turn cover 109 is formed at a rear end of the base 101 and supports rotatably a shaft 109*b* of the U-turn cover 109.

A quick sheet 316 is rotatably held as a quick reference in use of the two rubber legs 315 disposed on a near side of the base 101. One rubber leg 315 (on a right side in FIG. 5) is inserted in a rotation hole 316*a* formed in the quick sheet 316, and the quick sheet 316 is rotated around the leg 315 as a center. An index portion 316*b* of the quick sheet 316 hits the other rubber leg 315 (on a left side) to limit the rotation. The index portion 316*b* of the quick sheet 316 does not go beyond the state shown in FIG. 5, and because as shown in FIG. 5 the index portion 316*b* of the quick sheet 316 always projects outward, the user can easily pull out the quick sheet by rotating the sheet in a direction of an arrow 316.

Figure 6:
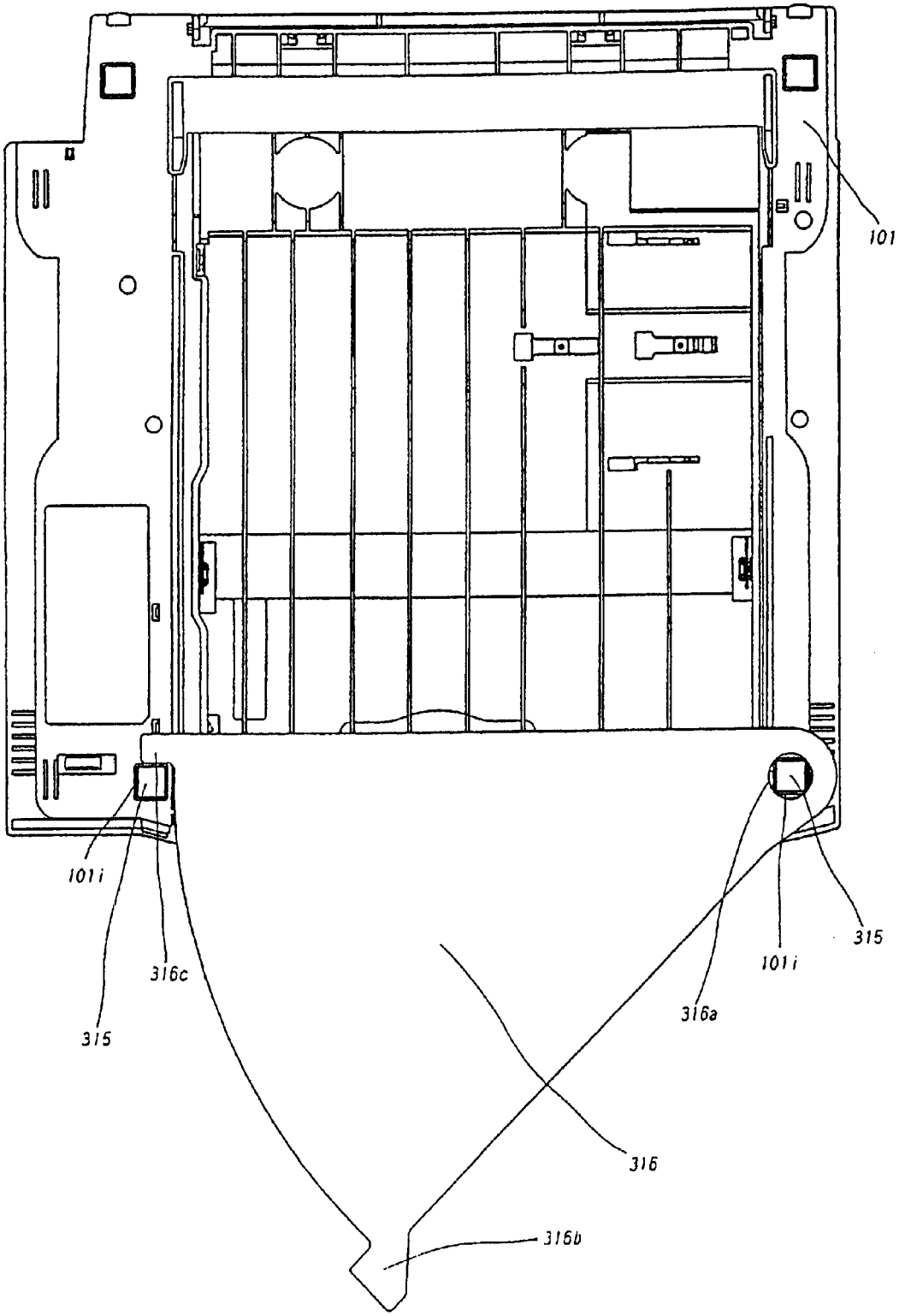
FIG. 6 is a rear view showing a used state of the quick sheets.

FIG. 6 is a bottom view showing a state that the quick sheet is rotated and pulled out. When the quick sheet 316 is rotated in a certain amount, a stopper portion 316*c* of the quick sheet 316 comes in contact with the rubber leg 315 on the left side and limits the rotation.

Base, Description of Sheet Remaining Amount Detection and Display Mechanism

Figure 7:
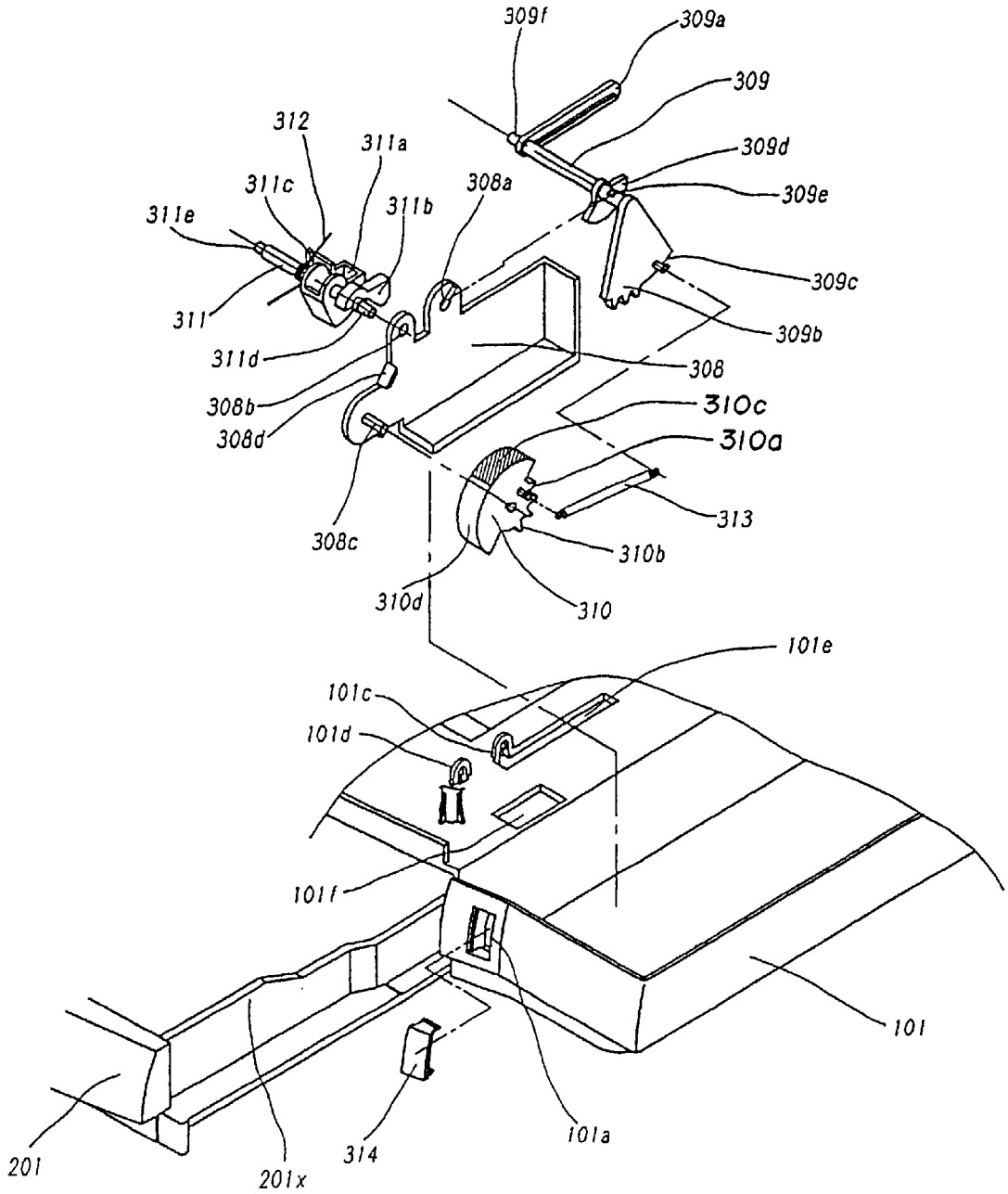
FIG. 7 is an exploded perspective view showing a sheet remaining amount detecting portion and a structure of a displaying portion thereof.

FIG. 7 is an exploded perspective view showing a structure of sheet remaining amount detection and display mechanism. The mechanism includes a lever for detecting the remaining amount of the recording sheets 111, a drum 310 for displaying the remaining amount of the recording sheets 111, a pulling spring for coupling the lever 309 and the drum 310 with each other, a cam 311 for operating and escaping the lever 309 in association with insertion and exsertion of the cassette 201, a twisted coil spring 312 urging the cam 311, and a frame 308 for holding those parts. Shaft ends 309*f*, 311*e* on one side of the lever 309, cam 311, respectively, are held to bearing 101*c*, 101*d* formed at the base 101, respectively.

An arm 309*a* is formed at the lever 309, rotates and projects downward from a hole portion 101*e* of the base 101, and comes in contact with a top surface of the recording sheets 111 stacked on the cassette 201. This rotation is transmitted to a gear portion 310*b* formed at the drum 310 through a gear portion 309*b*. A cam portion 309*d* is formed unitedly in the same way, and limits the rotation of the lever 309 upon contact with the cam 311.

Outer peripheral surfaces 310*c*, 310*d* of the drum 310 are coated with different colors. In this embodiment, the outer peripheral surface 310*d* is in white based color, while the outer peripheral surface 310*c* is in dark based color. This color coordination is not limited and can be various (in this embodiment the outer peripheral surface 310*d* is in the white based color because of reason described below), or it is readily conceivable that if one surface is made in color of the material of the drum 310 it is advantageous to reduce printing cost and the like.

An indicator portion 101*a* for displaying the sheet remaining amount formed at the base 101 is covered with an indicating window 314 molded of a transparent material. The window allows the outer peripheral surface 310*c* of the drum 310*c*, 310*d* to be confirmed and simultaneously prevents foreign objects from entering inside.

A first cam 311*a* and a second cam 311*b* are formed at the cam 311. The first cam 311*a* projects downward from the hole portion 101*f* formed at the base 101. The whole cam 311 rotates by a step 301 the formed on a side wall of the cassette 201 when the cassette 201 is mounted. The second cam 311*d* is in contact with the cam portion 309*d* formed at the lever 309 while assembled. The twisted coil spring 312 is attached to the cam 311 and urges the cam 311 in a direction to limit the rotation of the lever 309 as described below.

Figure 8:
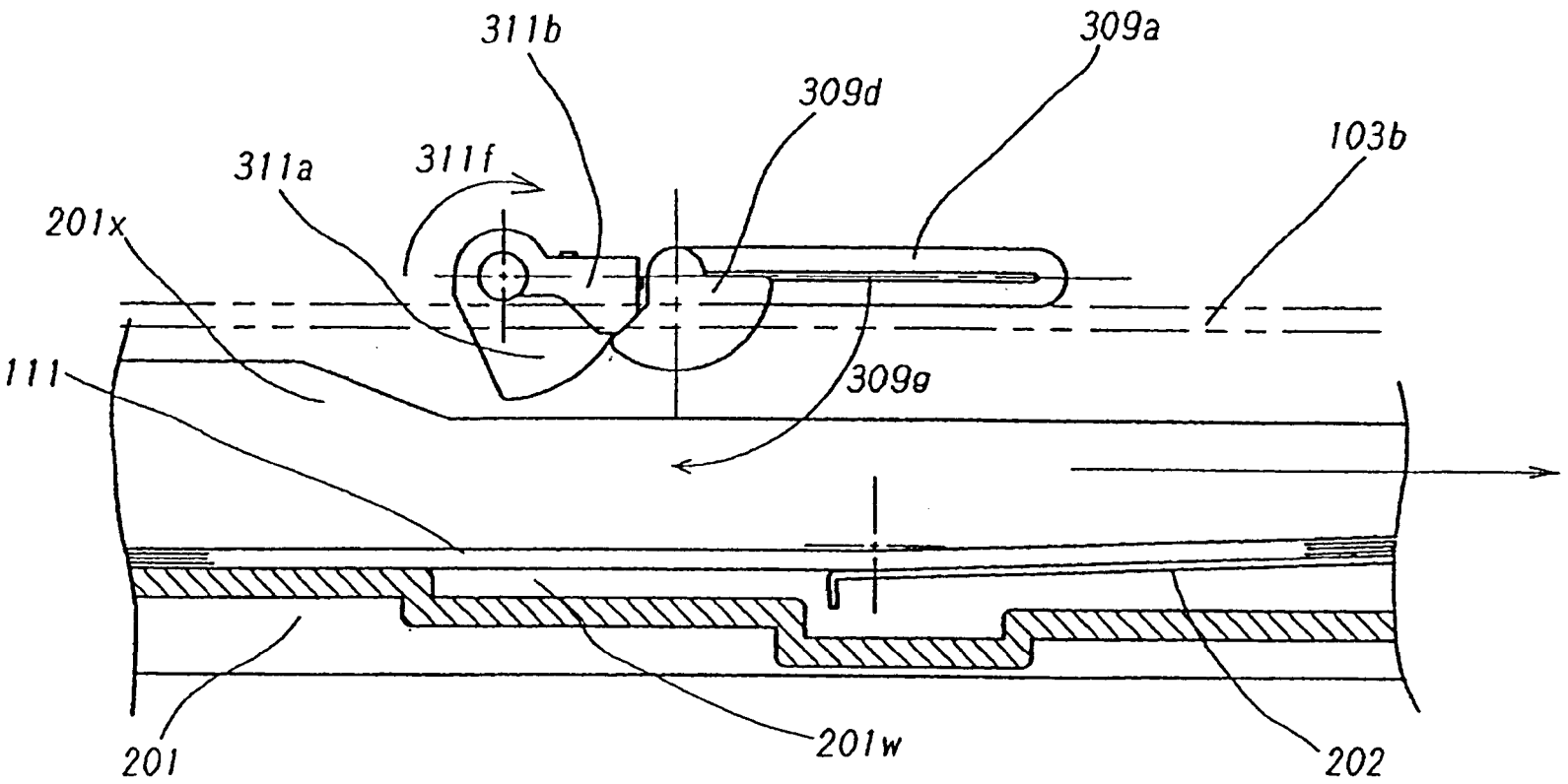
FIG. 8 is a cross section showing the sheet remaining amount detecting portion when the cassette is not attached.

FIG. 8 is a cross section (partly made transparent) showing a state that the cassette 201 is not mounted and a state of the lever 309 and the cam 311 while the cassette 201 is being attached. The cam 311 is urged in a direction of arrow 311*f* by the above-mentioned twisted coil spring 312. The cam portion 309*d* of the lever 309 is therefore pressed by the second cam 311*b* of the cam 311, thereby limiting the rotation of the lever 309 in a direction of an arrow 309*g*. That is, where the cassette 201 is not attached, the arm 109*a* of the lever 309 does not project downward and escapes in the base 101 (over the surface 101*b*), so that the lever 309 is protected from breakdown. This position is maintained during attachment of the cassette 201, as being taken care of the attachment of the cassette 201 so as not to be disturbed. It is to be noted that the cam portion 309*d* of the lever 309 and the second cam portion 311*b* of the cam 311 are disposed at positions not to project from the surface 101*b* of the base 101, or namely disposed at areas where the surface 101*b* does not exist in the axial direction of the cam 311 and the cam portion 311*b*.

Figure 9:
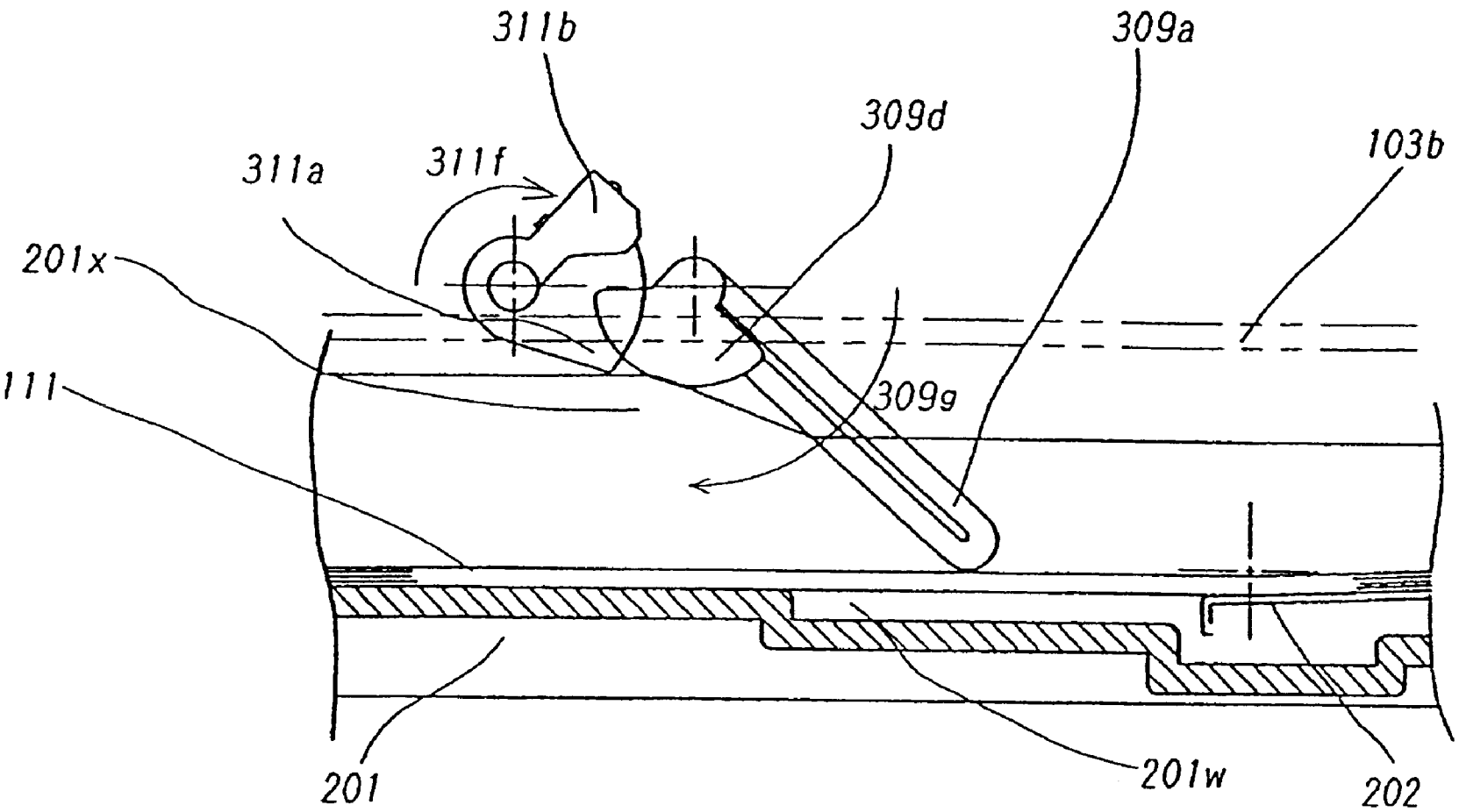
FIG. 9 is a cross section showing the sheet remaining amount detecting portion when the cassette is attached.

FIG. 9 is a cross section (partly made transparent) showing a state of the lever 309 and the cam 311 where the cassette 201 is mounted completely to the printer body. The first cam 311*a* of the cam 311 is pushed by the step 201 formed at the side wall of the feeding cassette 103, and the cam 311 rotates in a direction reverse to the arrow 311*f*. This makes free the cam portion 309*d* of the lever 309 being pressed by the second cam 311*b*, thereby rotating the lever 309 in a direction by tension of a pulling spring 313 to contact the arm 309*a* with the top surface of the sheets 111 and to activate the sheet remaining amount detection mechanism. The contact portion of the arm 309*a* of the lever 309 to the recording sheets 111 is away from a pressing plate 202 as shown in FIG. 9 and is designed on a plane not affected from motion of the pressing plate 202. The motion of the pressing plate 202 during feeding does not transmit to the lever 309, and therefore, the drum associating to the lever is not affected from the motion of the pressing plate 202, either.

Figure 10B:
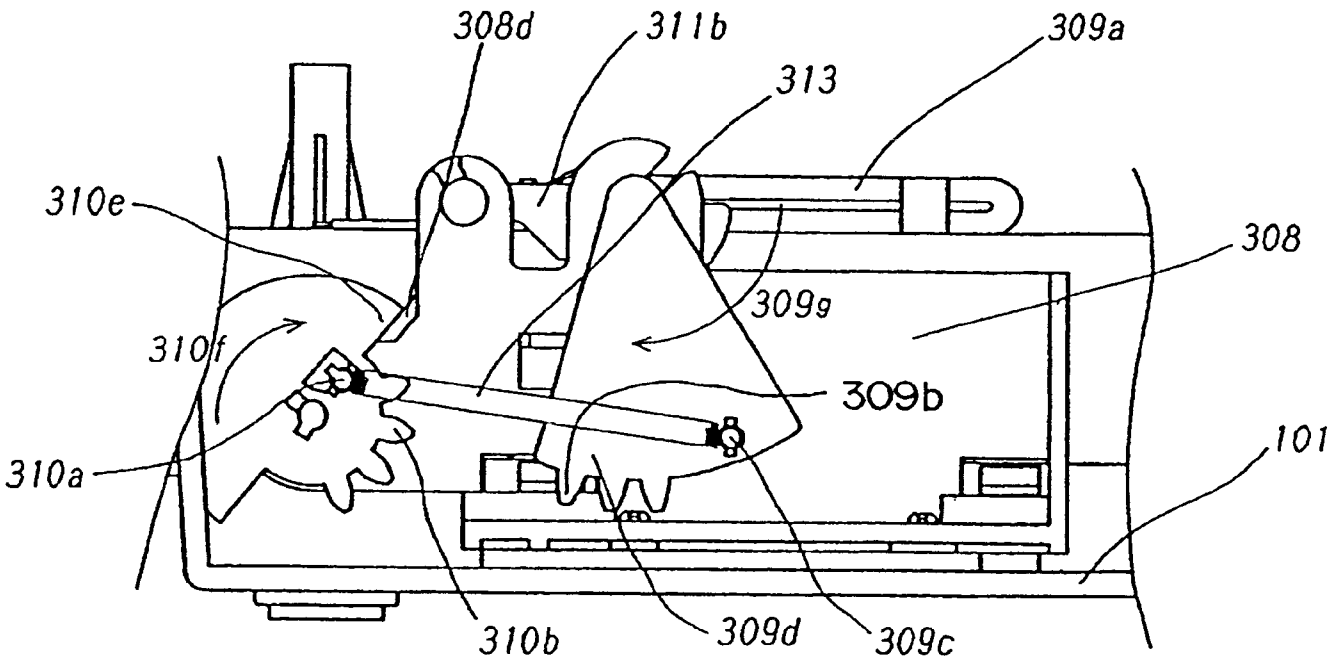
FIGS. 10(*a*) and 10(*b*) is a perspective view showing the sheet remaining amount detecting portion and the displaying portion thereof where the cassette is attached and the sheets are fully stacked.
Figure 10A:
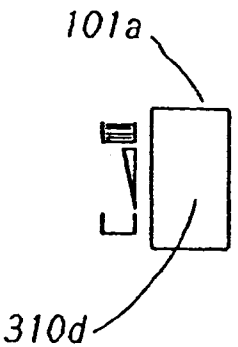
Figure 11B:
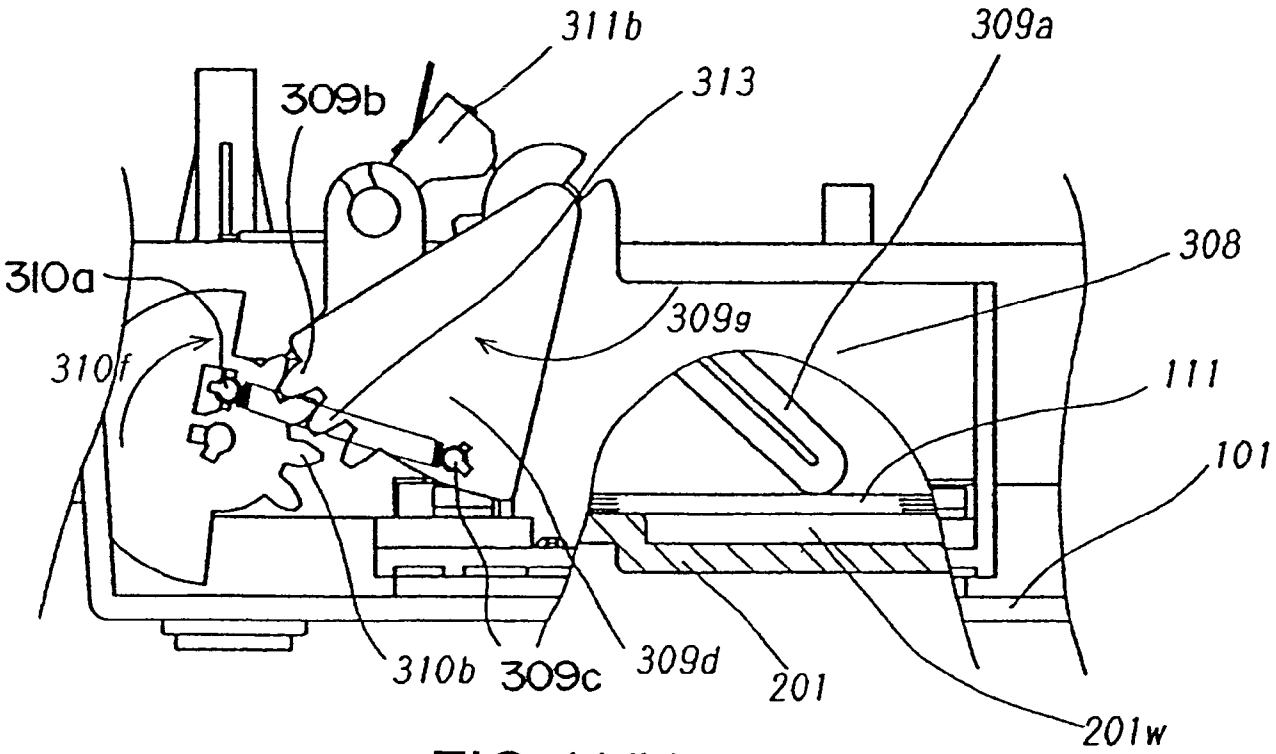
FIGS. 11(*a*) and 11(*b*) is a perspective view showing the sheet remaining amount detecting portion and the displaying portion thereof where the cassette is attached and the sheets are stacked in a small amount.
Figure 11A:
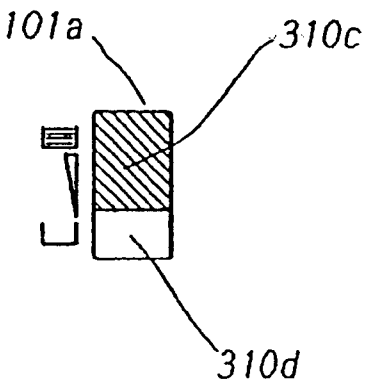
Figure 12B:
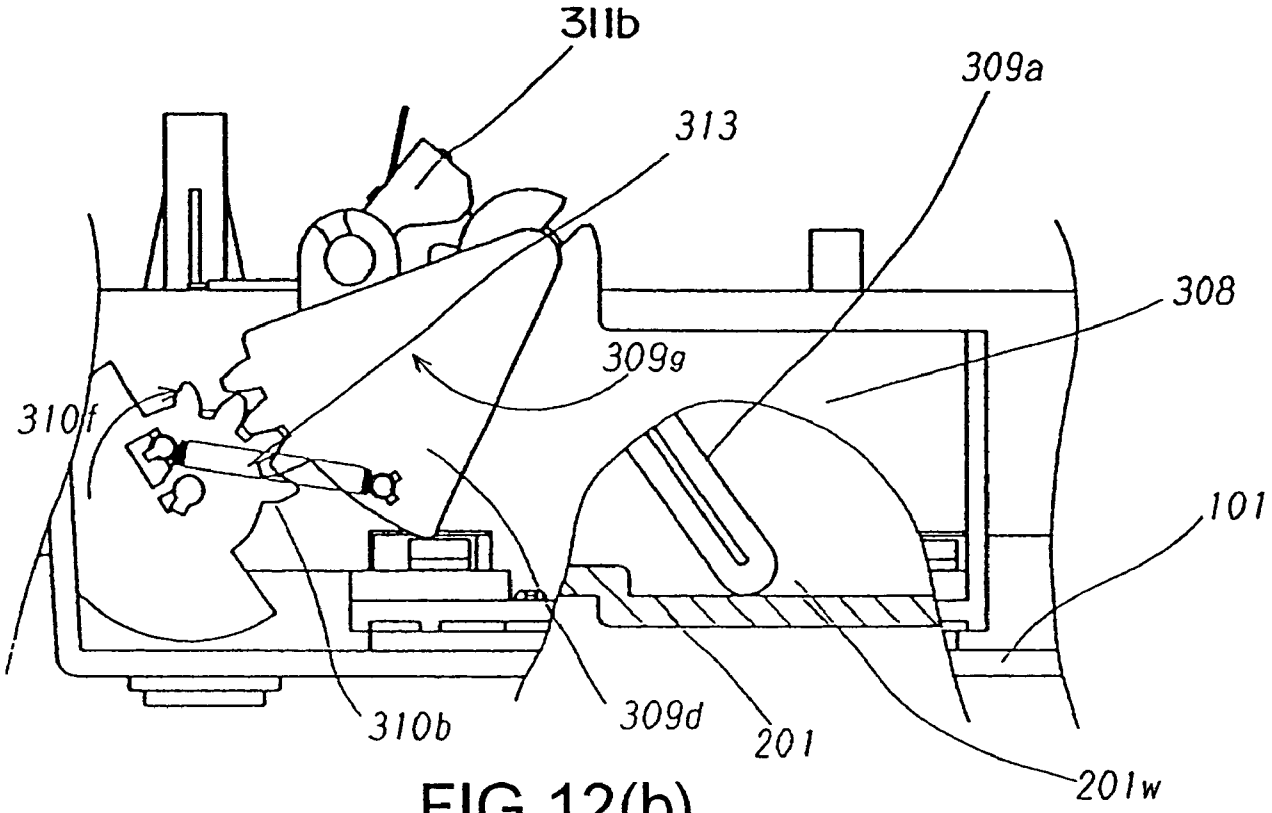
FIGS. 12(*a*) and 12(*b*) is a perspective view showing the sheet remaining amount detecting portion and the displaying portion thereof where the cassette is attached and no sheet is stacked.
Figure 12A:
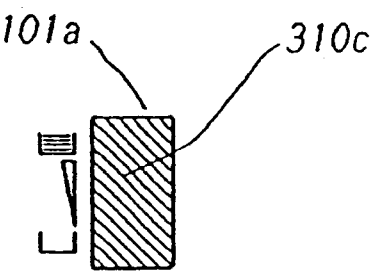

FIG. 10 to FIG. 12 are side cross sections showing operation of the sheet remaining amount with the structure thus constituted; (a) is a diagram showing a display state of the sheet remaining amount at that time. FIG. 10 shows a state that the cassette 201 is not attached. In FIG. 10(*b*), the lever 309 is restricted to rotate by the cam 311 to be positioned so that the arm 309*a* does not project downward from the top surface 101*b* of the base 101. A pulling spring 313 is engaged with a spring engagement portion 309 of the lever 309, and force rotating the lever 309 in a direction of the arrow 309*g* is exerted. Therefore, the lever 309 maintains the stable position thereof where urged in the direction of the arrow 309*g* by the pulling spring 313 as being restricted to rotate by the cam 311.

The other end of the above-mentioned pulling spring 313 is engaged with a spring engagement portion 310*a* of the drum 310, and the drum 310 is urged in a direction of an arrow 310*f*. The drum 310 rotates with limitation due to engagement of an end 310*e* of the drum 310 with a stopper portion 308*d* formed at the frame 308. This render the drum 310, as well as the lever 309, urged in one direction and maintain the stable position. By maintaining this position, the drum 310 is allowed to surely engage the gear portion 310*b* of the drum 310 with the gear portion 309*b* at a normal position when the lever 309 rotates. While the sheet remaining amount detecting mechanism is not operating, the gear portion 309*b* of the lever 309 is not made to engage with the gear portion 310*b* of the drum 310, so that the gear portions of both can be made with minimum structures in comparison with a situation that both gear portions are engaged always with each other, and so that the material costs can be reduced and the space can be reduced due to reduction of the rotation regions of the gears.

As for the sheet remaining indication in this state, as shown in FIG. 10(*a*), the outer peripheral surface 310*d* colored in the white based color is displayed entirely.

FIG. 11 shows a state that the recording sheets 111 exist where the cassette 210 is attached. As shown in FIG. 11(*b*), the state of the arm 309*a* of the lever 309 is shown with a view made transparent partly. As described above, the cam 311 escapes upon attachment of the cassette 201, and the lever 309 is released from restriction to rotate in direction of the arrow 309*g* by the tension of the pulling spring 313, so that the lever 309 stops when the arm 309*a* contacts with the top surface of the recording sheets 111. The gear portion 309*b* of the lever 309 is engaged with the gear portion 310*b* of the drum 310, thereby rotating both in association with each other. The drum 310 rotates in a direction reverse to the direction of the arrow 310*f*.

As for the sheet remaining indication in this state, as shown in FIG. 11(*a*), the outer peripheral surface 310*d* colored in the white based color is fading away, and the outer peripheral surface 310*c* colored in the dark based color begins to appear. If the recording sheets 111 are stacked in a large number, the lever 309 rotates in a small amount, and therefore, the outer peripheral surface 310*d* colored in the white based color is exposed much because the drum 310 rotates less. As the recording sheets 111 become less, the lever 309 rotates more, and the outer peripheral surface 310*d* colored in the white based color is reduce because the drum 310 rotates more. In consideration that the recording sheets 111 are mainly in white, because the outer peripheral surface 310*d* colored in the white based color of the drum 310 is reduced at the indicator portion 101*a* as the recording sheets 111 are reduced, it is easily recognizable for users.

FIG. 12 shows a state that the recording sheets 111 do not exist where the cassette 210 is attached. In the same manner as those in FIG. 11, in FIG. 12(*b*), the state of the arm 309*a* of the lever 309 is shown with a view made transparent partly. The cassette 201 is formed with a surface 201*w* recessed from the sheet stacking surface, and the surface 201*w* is designed to receive the arm 309*a* of the lever 309. Thus, the rotation amount change of the lever 309 becomes large between the case that the only one recording sheet 111 remains and the case that the recording sheet 111 is gone. Therefore, the change in the rotation amount of the drum 310 moving together becomes lager as a matter of course, thereby surely informing that the recording sheet 111 is gone to the users in exposure of the dark based color outer peripheral surface 310*c* of the drum 310. Since the rotation amount of the drum 310 changes largely, the dark based color outer peripheral surface 310*c* of the drum 310 can be shown at the whole indicator portion 101*a* of the base 101.

The pulling spring 313 is designed and disposed as to always have tension in a series of operations shown in FIG. 10 to FIG. 12. In consideration that the gear portion 309*b* of the lever 309 is engaged with the gear portion 310*b* of the drum 310, both are urged in directions opposite to each other by the pulling spring 313. To rotate this system in a constant direction, or in a direction of the arrow 309*g* shown in FIG. 11, the spring engagement position for the pulling spring 313 is set in this embodiment at a position remote to the rotation center on the side of the lever 309 so as to enlarge the moment generated by the pulling spring 313, and the spring engagement position 309*a* is set at a position adjacent to the rotation center on the side of the drum 310 so as to make small the moment generated at the drum 310 in keeping the urged position shown in FIG. 10(*b*). That is, the pulling spring 313 is designed to have both of operation to rotate the lever 309 in the direction of the arrow 309*a* and operation to pull back the drum 310, at the same time, and to have operation to urge the entire system to either direction.

Feeding Cassette

Figure 15:
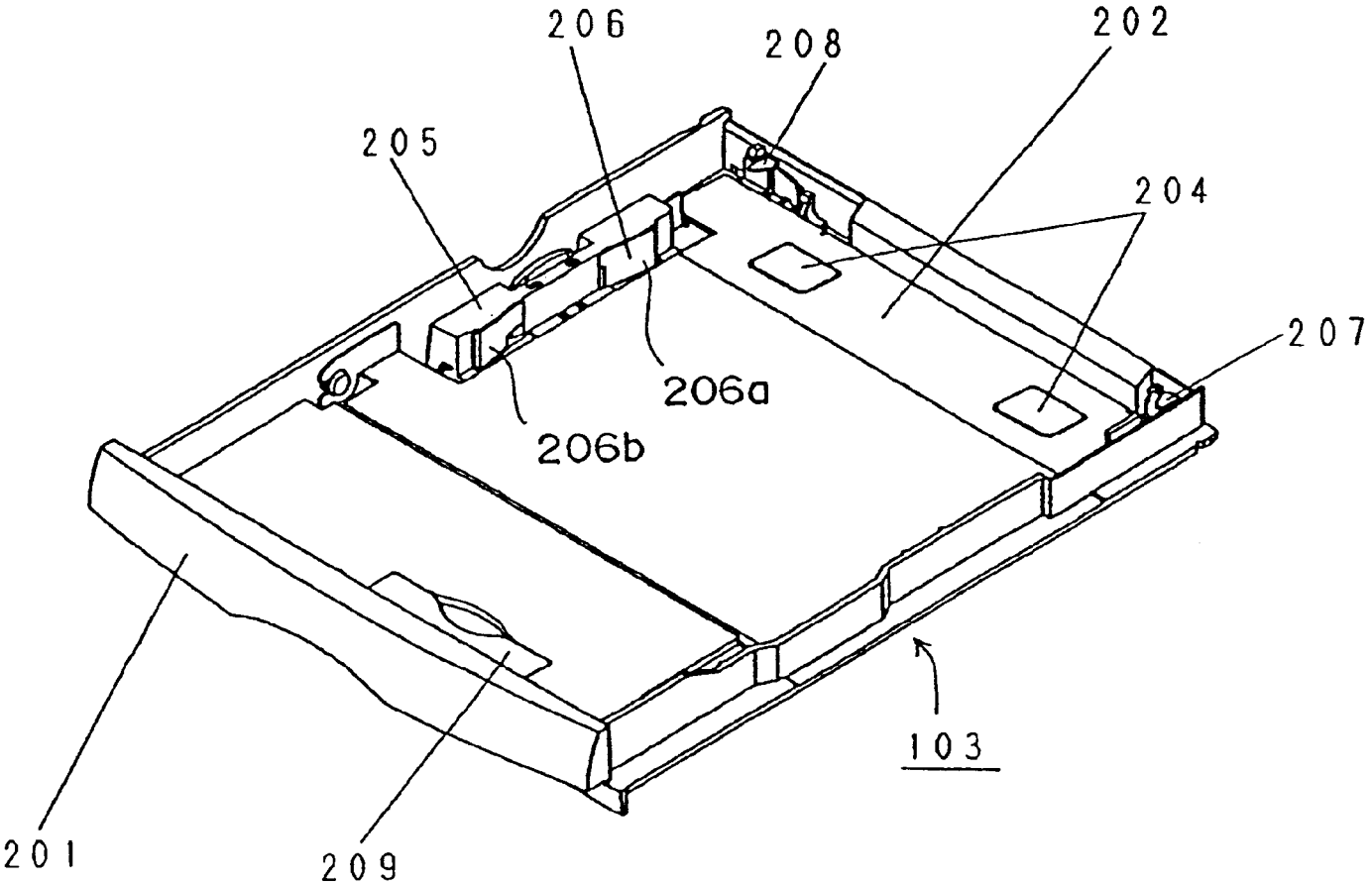
FIG. 15 is a perspective view showing the whole feeding cassette.
Figure 16:
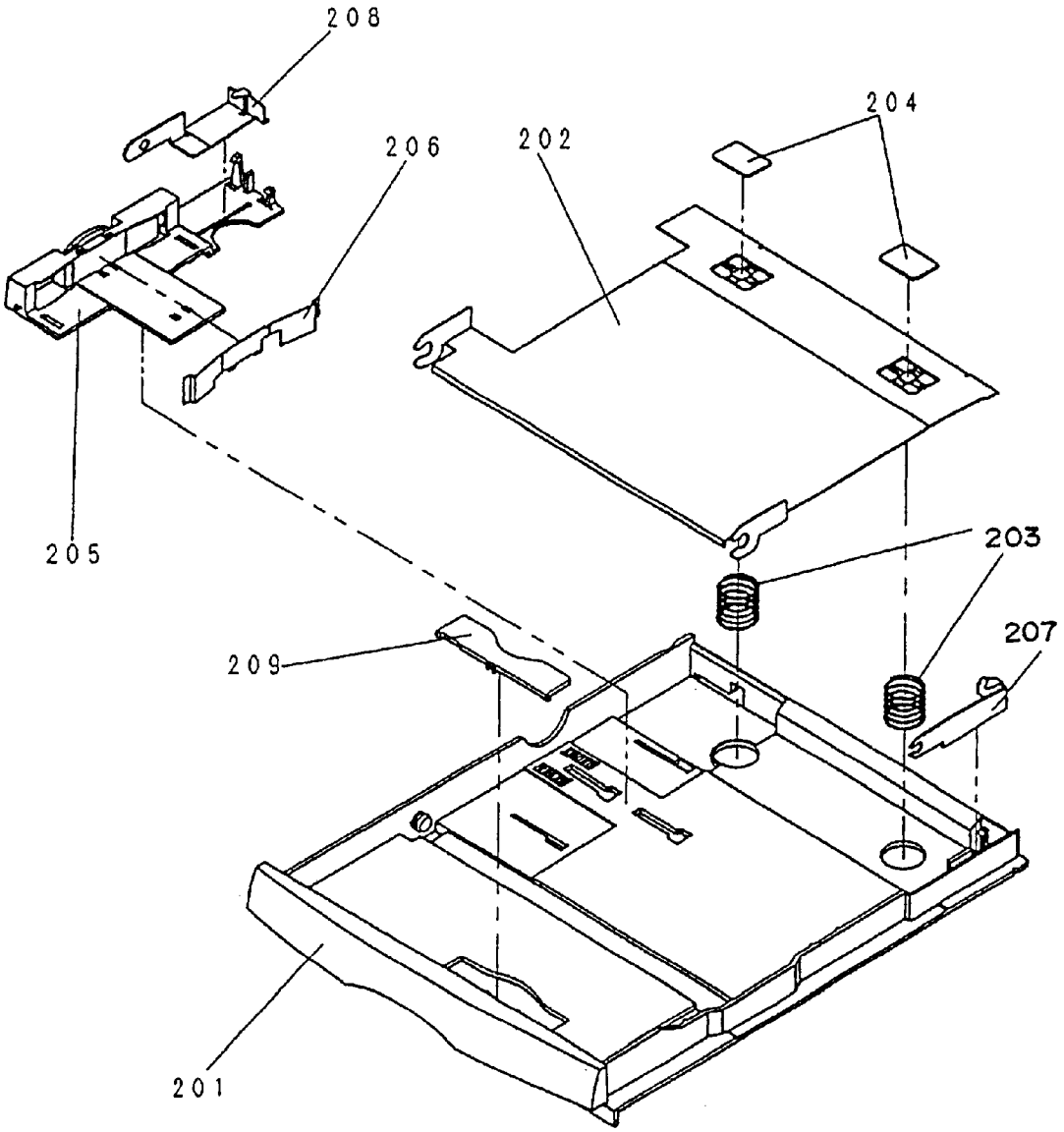
FIG. 16 is an exploded perspective view showing the feeding cassette.
Figure 17:
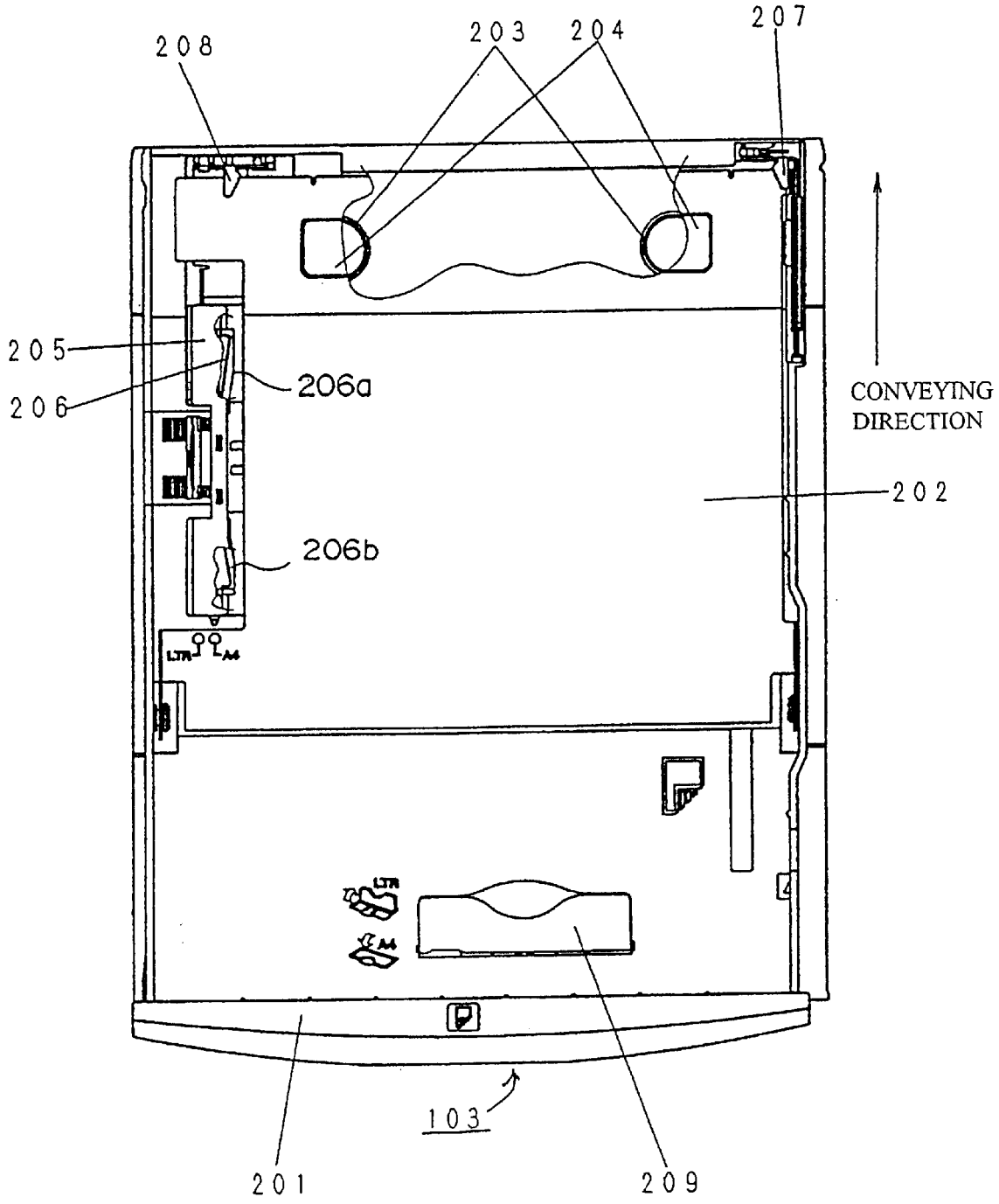
FIG. 17 is a plan view showing the feeding cassette.

FIG. 15 is an entire perspective view of the feeding cassette 103 as an embodiment of the invention. FIG. 16 is an exploded perspective view of a feeding cassette 103; FIG. 17 is a plan view.

Figure 18:
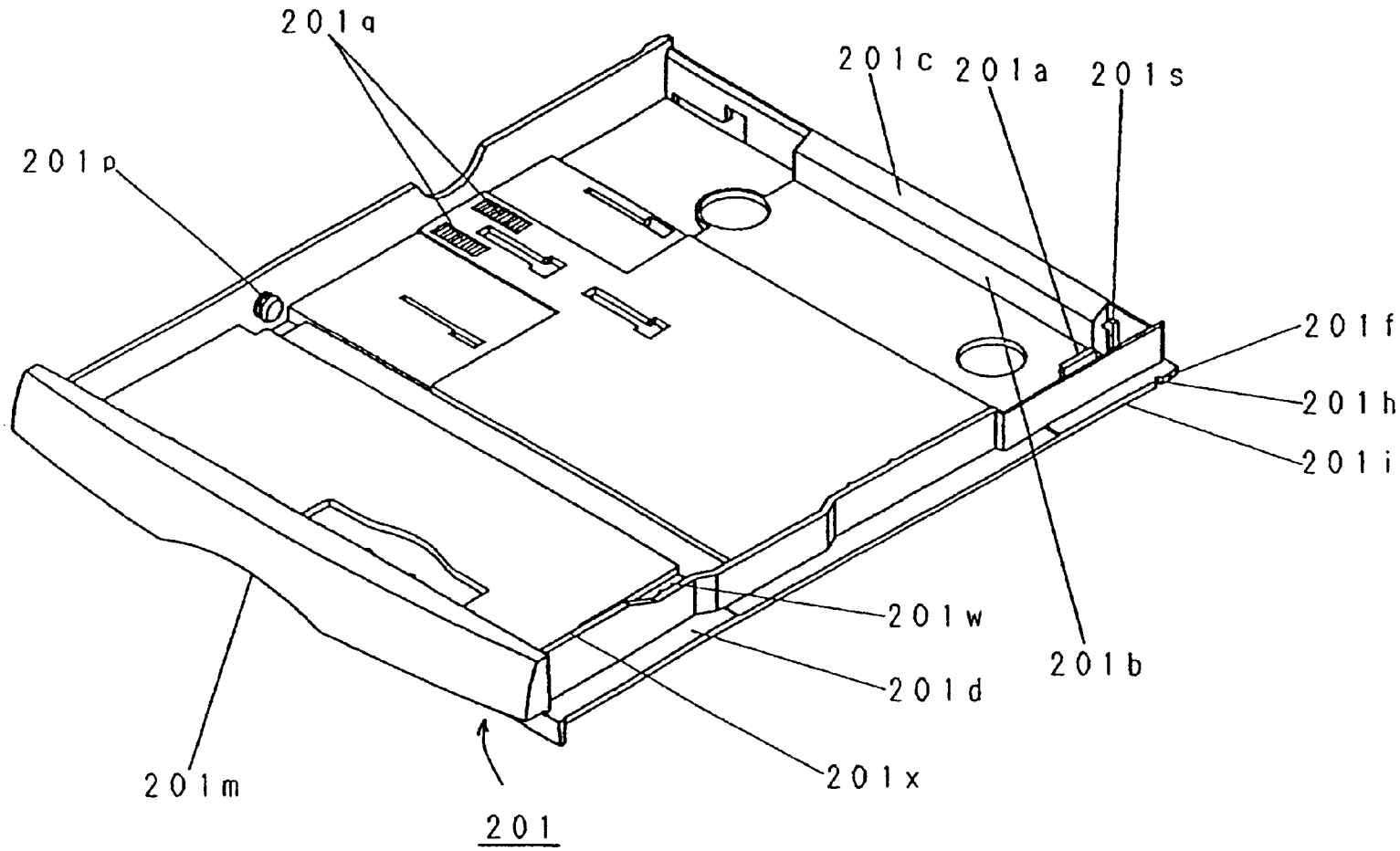
FIG. 18 is a perspective view showing the whole cassette.
Figure 19:
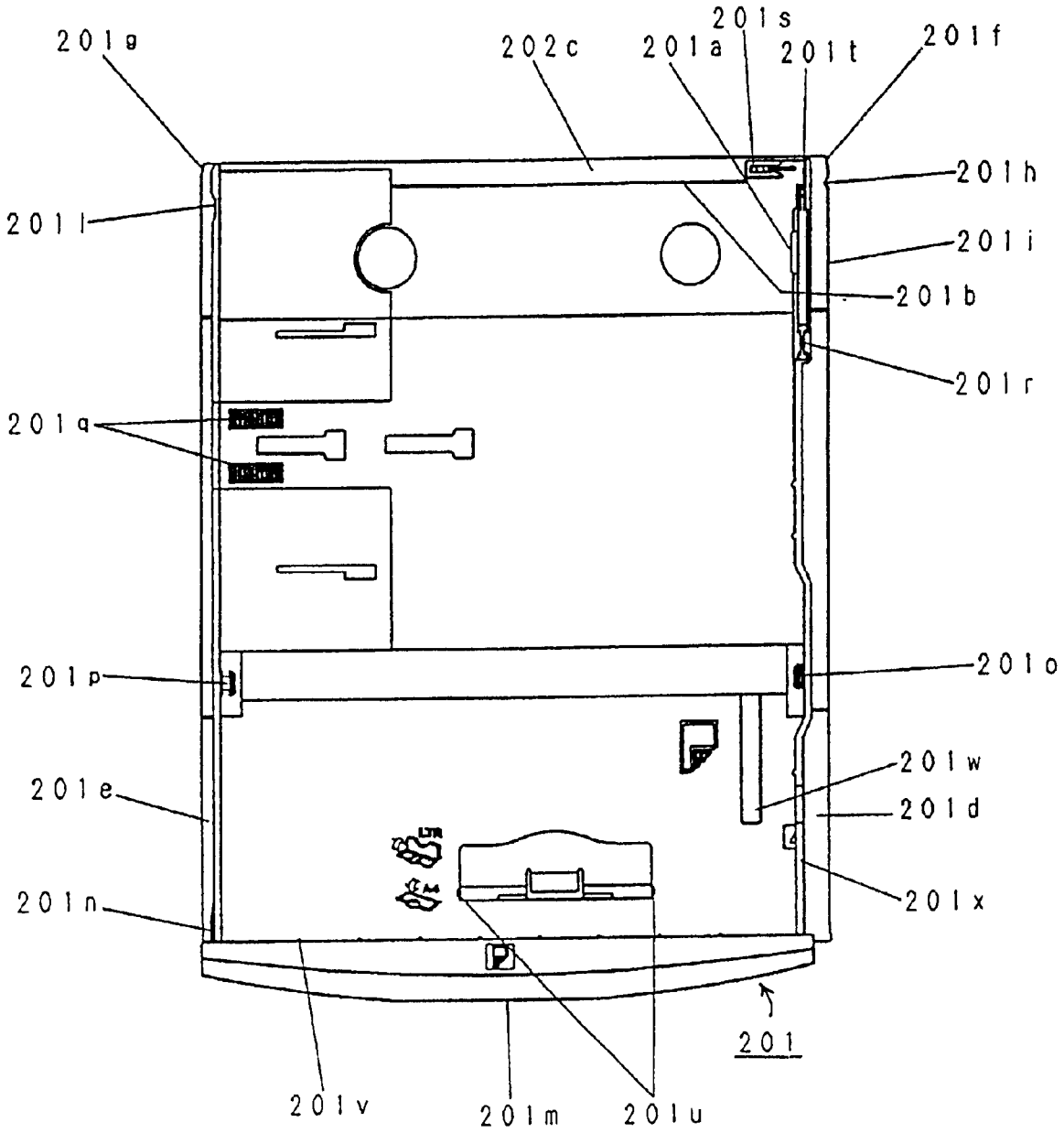
FIG. 19 is a plan view showing the cassette.

The feeding cassette 103 is constituted as to be detachably attached to the apparatus body 100, and as shown in FIG. 18, FIG. 19, two parallel rails 201*d*, 201*e* are provided on respective sides of the cassette 201 for sliding and guiding the cassette 201 on a cassette supporting surface 101*q* of the apparatus body 100 when the cassette 201 is detached from and attached to the apparatus body 100. The cassette supporting surface 101*q* has a tapered surface 101*r* located around a front surface portion of the apparatus body 100, and ends on a downstream side in the conveyance direction of the rails 201*d*, 201*e* of the cassette 201 are guided to the tapered surface 101*r*, thereby effectively improving controllability when the feeding cassette 103 is inserted in the apparatus body 100. The tapered portions 201*f*, 201*g* are arranged at ends on a downstream side in the conveyance direction of the rails 201*d*, 201*e*, thereby further improving insertion property of the feeding cassette 103 to the apparatus body 100.

Figure 25A:
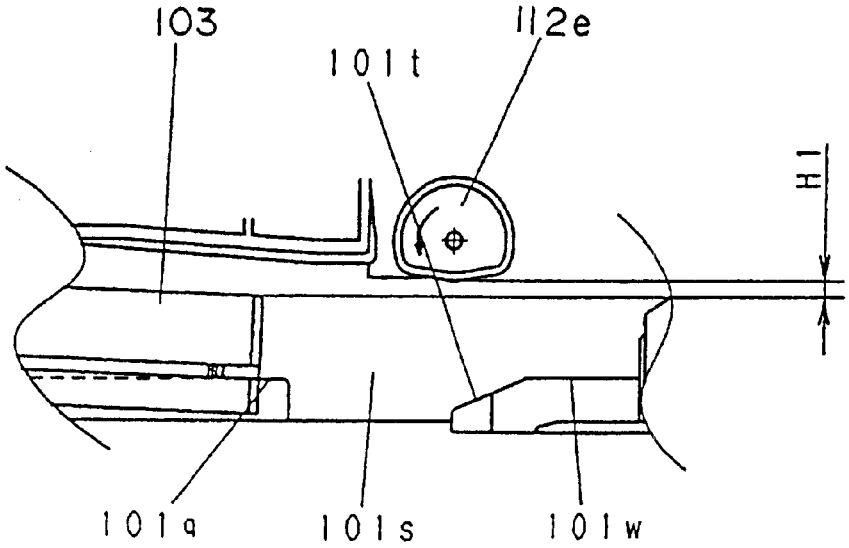
FIGS. 25(*a*)–25(*c*) is a conception illustration at a time that the feeding cassette is attached.
Figure 25B:
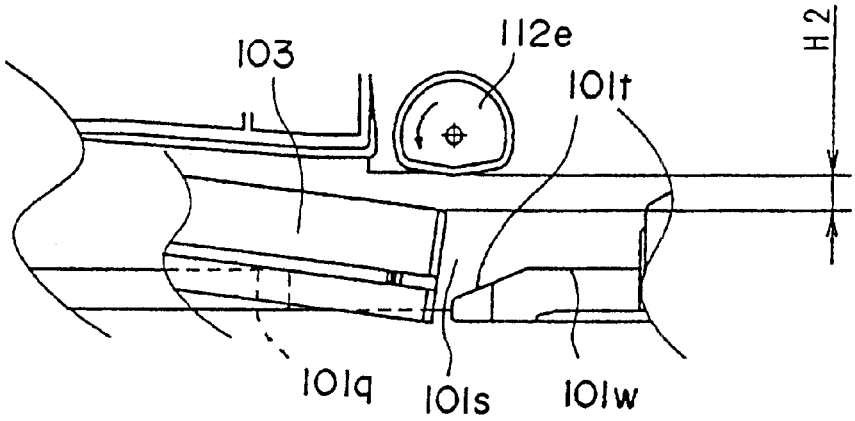
Figure 25C:
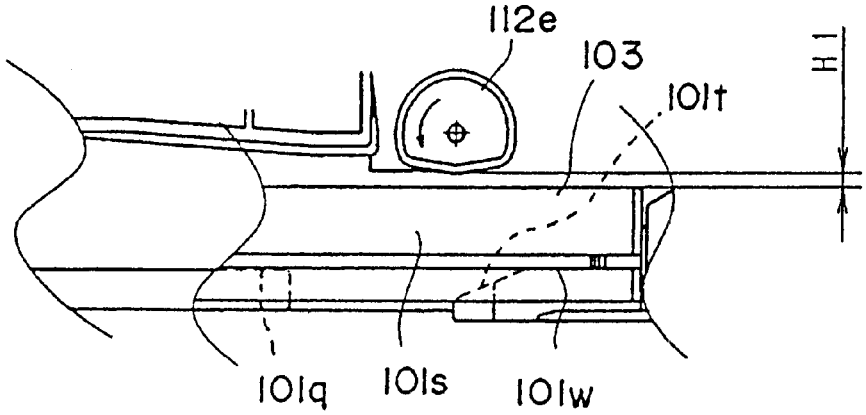

As the bottom surfaces of the rails 201*d*, 201*e* are made to slide on the cassette supporting surface 101*q* and to insert the feeding cassette 103 to the far side, the recording sheets 111 stacked on the feeding cassette 103 may be curled upward due to influences from the temperature and humidity and may contact with the feeding roller 112*e*. Where the recording sheets 111 are in contact with the feeding roller 112*e*, the front end of the sheet 111 may be curled up, and the end of the sheets 111 may be disengaged from a separation nail A207 and a separation nail B208 as described below, thereby possibly causing failures in conveyance such as double feeding, obliquely feeding, paper jamming, or the like. Therefore, as shown in FIG. 25, a cutout portion 101*s* at which any cassette supporting surface 101*q* is not placed partly adjacent to the feeding roller 112*e* of the cassette supporting surface 101*q* of the apparatus body 100. Because in the cutout portion 101*s* there is no cassette supporting surface 101*q* that is otherwise supporting the weight of the feeding cassette 102, the end on the downstream side in the conveyance direction of the feeding cassette 103 escapes downward as to move away from the feeding roller 112*e*.

More specifically, the gap between the top surface of the stacked sheets 111 and the feeding roller 112*e* is H1 (see, FIG. 25(*a*)) where the feeding cassette 103 slides on the cassette supporting surface 101*q*, but the gap between the sheets 111 stacked on the feeding cassette 103 and the feeding roller 112*e* is widened to H2 (see, FIG. 25(*b*)) because the feeding cassette 103 escapes downward by the self-weight while the feeding cassette 103 passes through the cutout portion 101*s*. Therefore, even where no gap to the feeding roller 112*e* exists due to curling upward of the sheets 111 stacked on the feeding cassette 103 caused by the temperature and humidity, the feeding cassette 103 escapes downward to increase the gap between the stacked sheets 111 and the feeding roller 112*e*, and to effectively prevent conveyance failures from occurring such as turning up of the front end of the sheets 111 caused by contacts between the sheets 111 curled up and the feeding roller 112*e*, disengagement from the separation nail A207 and the separation nail B208, double feeding, obliquely feeding, paper jamming, or the like.

The feeding cassette 103 escaped once downward at the cutout portion 101*s* is guided by the tapered surface 101*t* located on a front side of the cassette supporting surface 101*w* located on a far side of the cutout portion 110*s* to back to the original level again. Then, the feeding cassette 103 is guided to a prescribed position by the cassette supporting surface 101*q*, thereby ending the attaching operation of the feeding cassette 103. The cassette supporting surface 101*q* and the cassette supporting surface 101*w* are about the same level, and the surface 101*w* may have a function to position the level of the feeding cassette 103 after the attachment (see, FIG. 25(*c*)).

The feeding cassette 103 is urged in a sheet reference direction by the cassette side pressing member 307 of the apparatus body 100, and the feeding cassette 103 is set to the position in the sheet width direction by contacting a reference surface 201*i* of the rail 201*d* located on the reference side of the cassette 201 with a reference surface 101*m* of the apparatus body 100. At that time, to create a clicking feeling when the feeding cassette 103 is attached, a recess 201*l* is formed on a side wall of the cassette 201 at a portion corresponding to the cassette side pressing member 307. A recess 201*h* is formed on a rail 201*d* located opposite to the recess 201*l*, engages with the projection 101*n* of the apparatus body 100, thereby functioning to prevent the feeding cassette 103 from dropping out after attachment. A spacer 201*n* is formed near an end on an upstream side in the conveyance direction of the rail 201*e*, thereby preventing the feeding cassette 103 from subjecting to rattling after attachment. A handle portion 201*m* taken by an operator's hand when the feeding cassette 103 is attached and detached is formed on a front surface of the cassette 201, thereby improving effectively the controllability when the cassette is attached and detached.

A reference guide member 201*a* for limiting an end (reference end) in the width direction of the stacked sheets 111 is formed on the cassette 201. The reference guide member 201*a* has substantially the same phase as the sheet reference of the apparatus body 100 with respect to the sheet width direction when the feeding cassette 103 is attached to the apparatus body 100, and creates a reference in the width direction of the sheets stacked in the feeding cassette 103. A sheet front end hitting surface 201*b* is formed on a downstream side in the conveyance direction of the cassette 201 for positioning the front end of the sheets 111 where the sheets 111 are stacked. The sheet front end hitting surface 201*b* is a surface substantially perpendicular to the guide surface of the reference guide member 201*a* and has on the surface 201*b* a bank 201*c* structured with a slope for guiding the conveyed sheets 111 to the sheet conveyance route 503. Positioning the rear end of the sheets 111 is different between A4 size paper and LTR size paper, and in the case of the A4 size paper, the rear end of the sheets 111 are positioned with a rear end positioning rib 201*v* placed on an upstream side in the conveyance direction of the cassette 201 where a rear end limiting plate 209 is laid down as described below. The rear end positioning rib 201*v* is located at a position of A4 portrait vertical size (297 mm) plus alpha (margin of the sheet 111) away from the sheet front end hitting surface 201*b*, so that the rib 201*v* can position the rear end of the sheets 111 suitably even where the A4 size sheets have deviated sizes. In the case of the LTR size sheets, the rear end limiting plate 209 is made upright, the guide surface 209*a* of the rear end limiting plate positions the rear end of the sheets 111 in the LTR size.

The pressing plate 202 is formed on the cassette 201 for urging the stacked sheets 111 to the feeding roller 112*e* disposed to the apparatus body 100 and placed facing to the plate 202. The pressing plate 202 is supported rotatably to pressing plate attaching shafts 201*o*, 201*p* of the cassette 201 and always urged in a direction pressing the feeding roller 112*e* by means of a pressing plate spring 203. Zinc plating is made on the surface of the pressing plate 202, and a separation sheet 205 is formed right below the feeding roller 112*e* for preventing the sheets 111 from being doubly fed. The separation sheet 204 is made of an artificial skin. The frictional coefficient $\mu 2$ of the surface of the separation sheet 204 is as follows:

$$\mu 1 < \mu < \mu 3$$

wherein $\mu 1$: sheet to sheet frictional coefficient (about 0.7), $\mu 2$: sheet to separation sheet frictional coefficient (about 0.9), $\mu 3$: sheet to feeding roller frictional coefficient (about 2.0).

Figure 20:
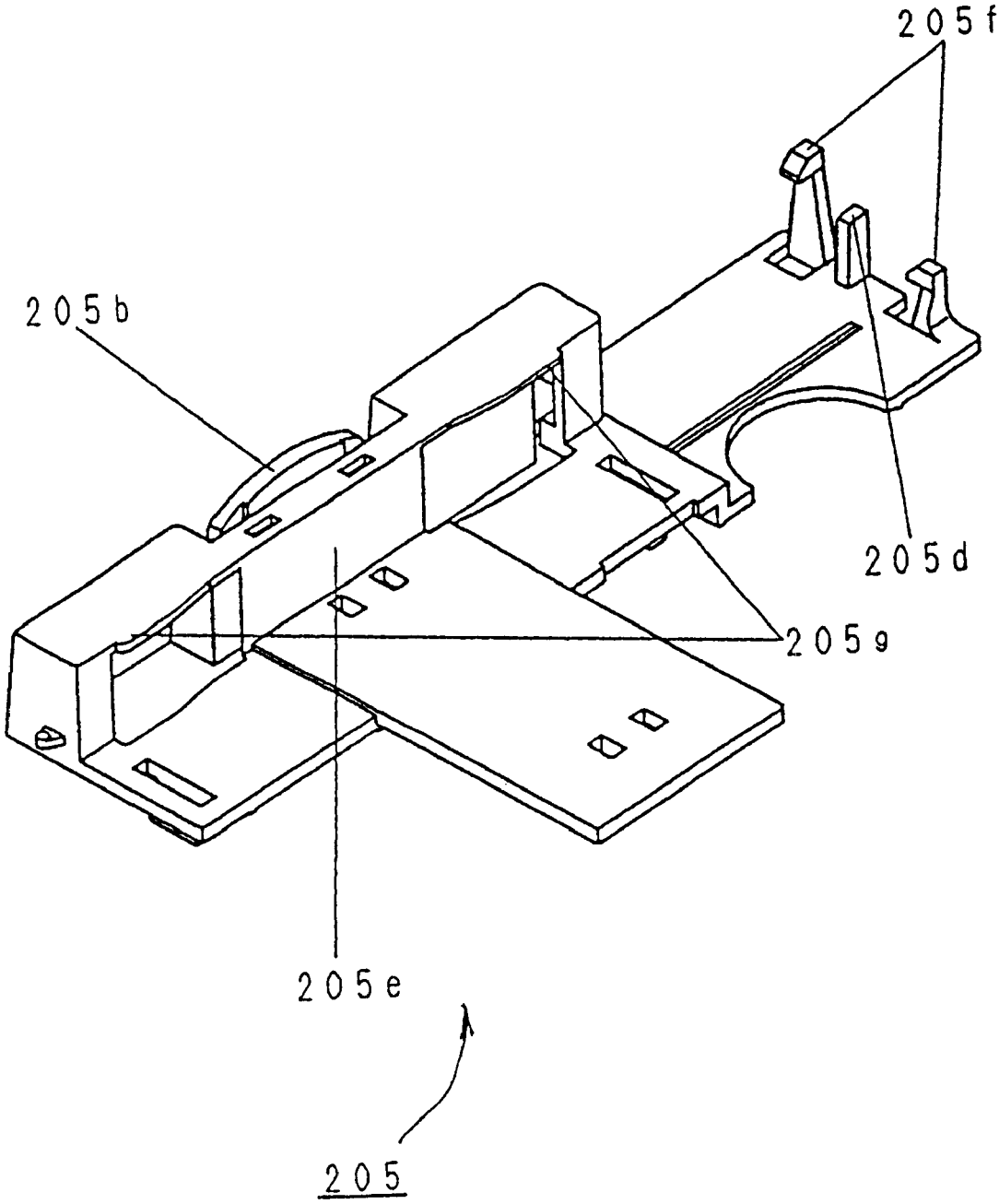
FIG. 20 is a perspective view showing the whole side guide.
Figure 21:
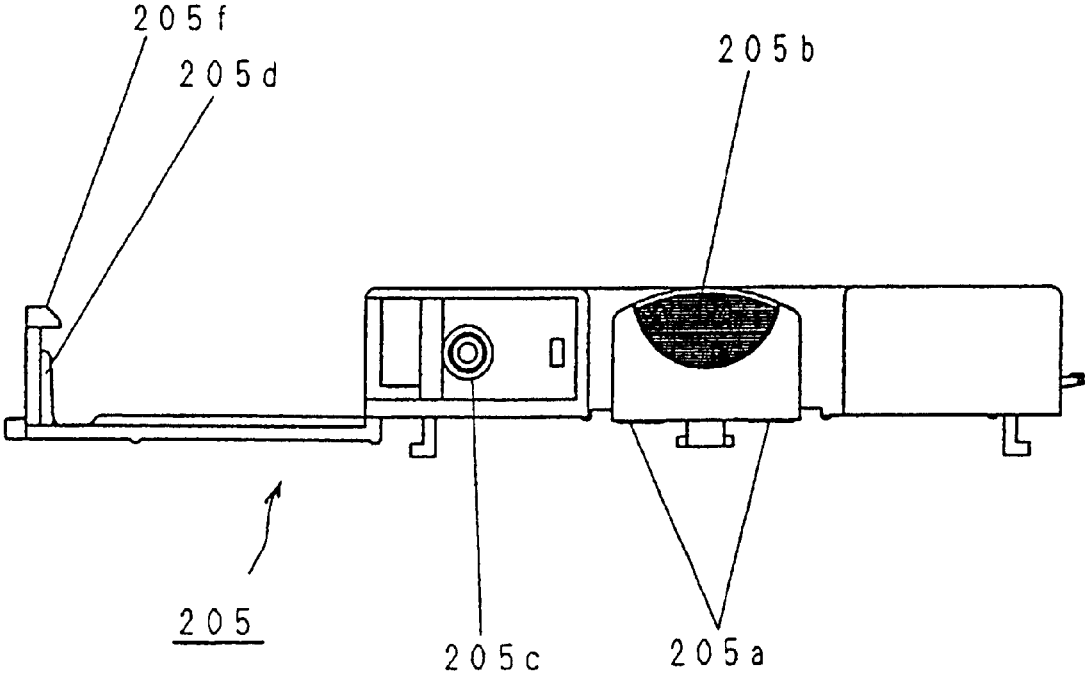
FIG. 21 is a side view showing the side guide.

Side guides 205 shown in FIG. 20, FIG. 21 are members for positioning the non-reference end of the stacked sheets 111 and are formed slidably in the sheet width direction on the cassette 201 so as to correspond to respective sheet sizes (e.g., A4, LTR) and deviations during cutting in the sheet width direction. The positioning of the non-reference end of the sheets 111 is made by contacting the guide surface 205*e* to the non-reference end of the sheets 111. A control portion 205*b* of the side guide 205 has an elasticity, and a latch 205*a* is formed at a portion of a sliding portion to the cassette 201 located below the control portion 205*b*. The latch 205*a* normally immobilizes the position of the side guide 205 in a state that the latch 205*a* engages with a corresponding latch 201*q* of the cassette 201 with the elasticity of the control portion 205*b*, but where the control portion 205*b* is made loosened in opposing the elasticity, the latch 205*a* is made to escape from the latch 201*q* to render the side guide 205 slidable in the sheet width direction.

A front end pressing spring 206 is formed at the side guide 205, and the stacked sheets 111 are normally urged to the reference guide member 201*a* and can be always stacked at a constant position. Because the stroke amount of the front end pressing spring 206 is designed to be substantially the same as the interval of the secured positions of the side guide 205 defined by the latches 201*q*, 205*a*, the sheets 111 can be positioned in the width direction in urged to the reference guide member 201*a* effectively even where the sizes in the width direction of the sheets 111 are deviated during cutting. The front end pressing spring 296 disposed to the feeding cassette 103 has two pressing portions 206*a*, 206*b* on the upstream side and the downstream side in the conveyance direction. The relation of pressing forces of the front end pressing spring 206 is that the force of the pressing portion 206*a* on the downstream side in the conveyance direction: 196 mN(20 gf) is less than the force of the pressing portion 206*b* on the upstream side in the conveyance direction: 392 mN(40 gf). This is for effectively preventing the non-reference end of the sheets 111 from being disengaged from the separation nail B208 due to deformations such as loosing or folding in being pressed by the front end pressing spring 206 where the sheets stacked in a small number are urged by the pressing portion 206 located on the downstream side in the conveyance direction of the front end pressing spring 206 located near the separation nail B206.

The pressing portions 206*a*, 206*b* of the front end pressing spring 206 are in a state projecting from the guide surface 205*e* of the side guide 205 by the stroke portions of the pressing portions 206*a*, 206*b* while the sheets 111 are not stacked on the feeding cassette 103. In this state, the pressing portions 206*a*, 206*b* projecting from the guide surface 205*e* of the side guide 205 for positioning the non-reference end of the sheets 111 when the sheets 111 are stacked may cause problems such as reduction of controllability, breakdown of the pressing portions 206*a*, 206*b*, folding of the non-reference end of the sheets 111, and the like. With this feeding cassette 103, a brim 205*g* is formed at the guide surface 205*e* over the pressing portions 206*a*, 206*b*, and the problems such as reduction of controllability while the sheets are stacked are solved by covering the pressing portions 206*a*, 206*b* projecting from the guide surface 205*e*.

Figure 22:
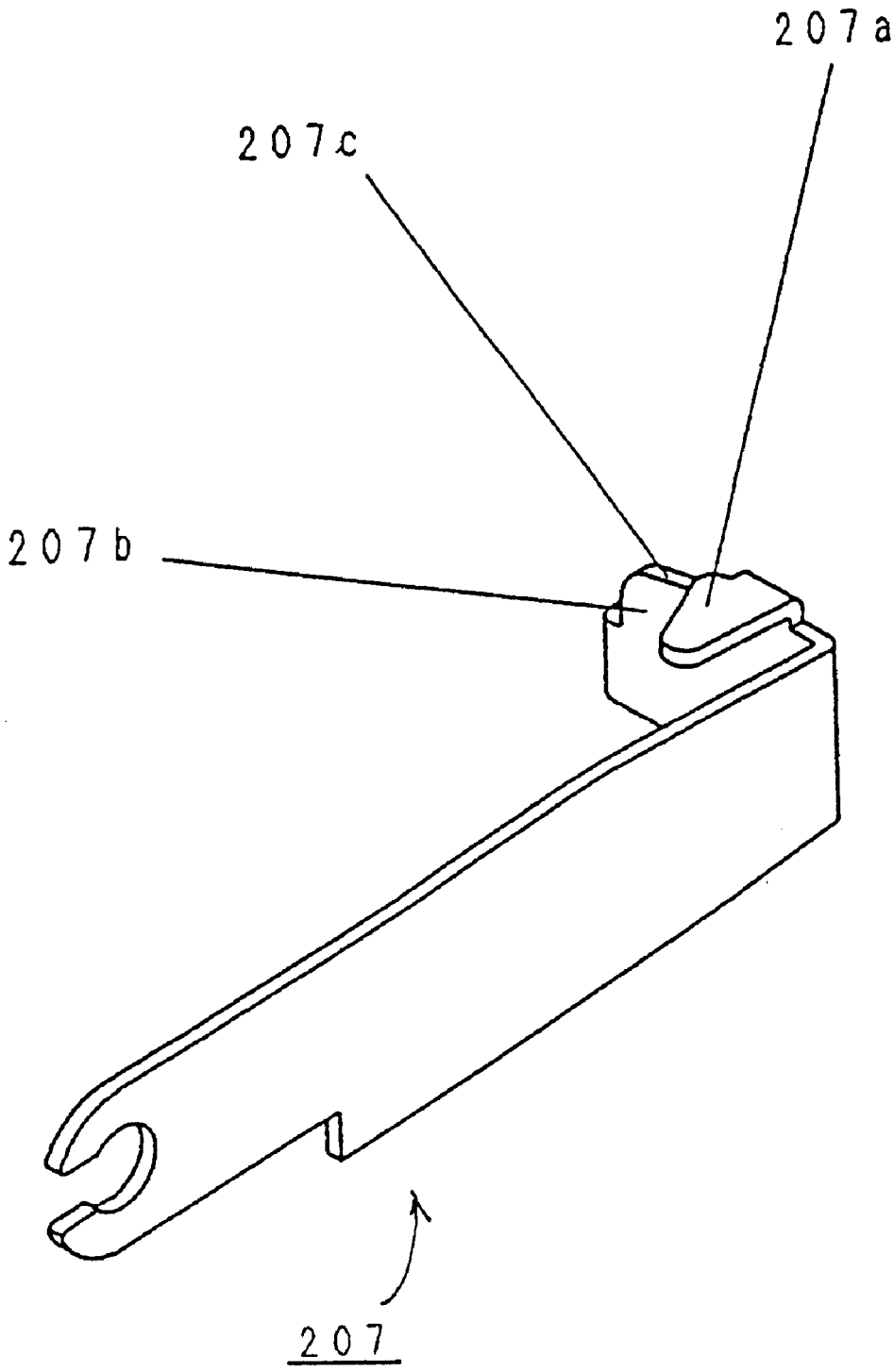
FIG. 22 is a perspective view showing the whole separation nail A.
Figure 23:
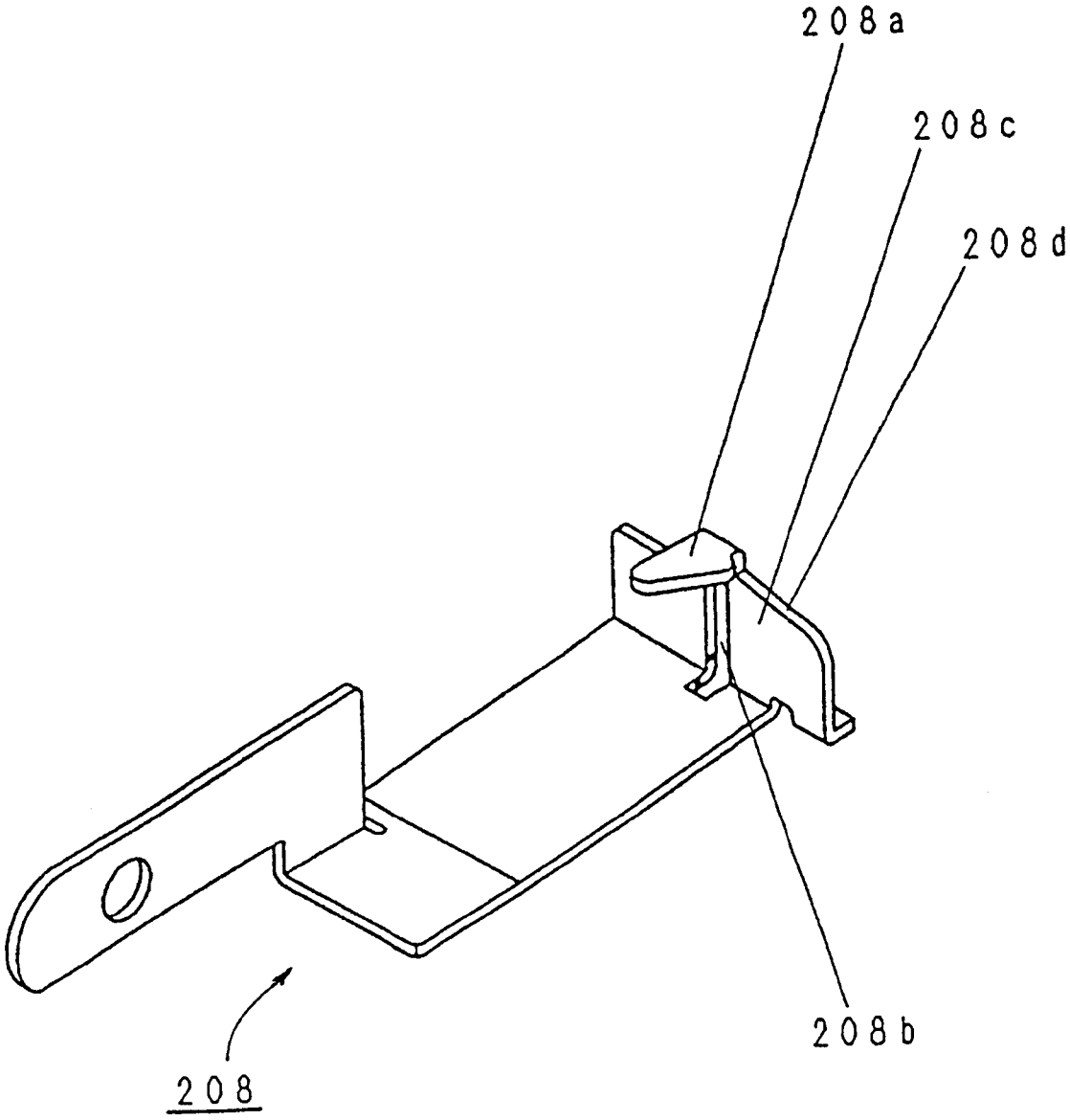
FIG. 23 is a perspective view showing the whole separation nail B.

The separation nail A207 on a reference side whose separation portion 207*a* has a prescribed engagement amount to the sheets 111 is rotatably supported to an inner surface of the reference side wall by means of a shaft 201*r* on a downstream side in the conveyance direction of the reference guide member 201*a*. The separation nail A207 shown in FIG. 22, by fitting to the gap 201*t*, suppresses rattled motions in the sheet width direction or twisting direction, thereby rendering always constant the engagement amount of the separation portion 207*a* to the sheets 111. The separation nail B208 on the non-reference side is located on a downstream side in the conveyance direction of the side guide 205 and is rotatably supported by a shaft 205*c*. The separation nail B208 shown in FIG. 23 suppresses rattled motions in the sheet width direction or twisting direction by fitting the rib 205*d* of the side guide 205 to a groove 208*b* of the separation nail B208. The separation nail A207 and separation nail B208 have rotation angles, respectively, which are limited by stoppers 201*s*, 205*f*, respectively, and rotatable within prescribed rotation angles. The separation portions 207*a*, 208*a* of the separation nail A207 and separation nail B208 are located above the pressing plate 202, the sheets 111 stacked on the pressing plate 202, thereby functioning to restrict the upper limitation of the rotation of the pressing plate 202. The upper limitation of the rotation of the separation nail A207 and separation nail B208 by restriction made with the stoppers 201*s*, 205*f* is set to a position such that the pressing plate 202, the stacked sheets 111 on the pressing plate 202, the separation nail A207, and the separation nail B208 are not in contact with the feeding roller 112*e* or the like of the apparatus body 100.

Figure 26:
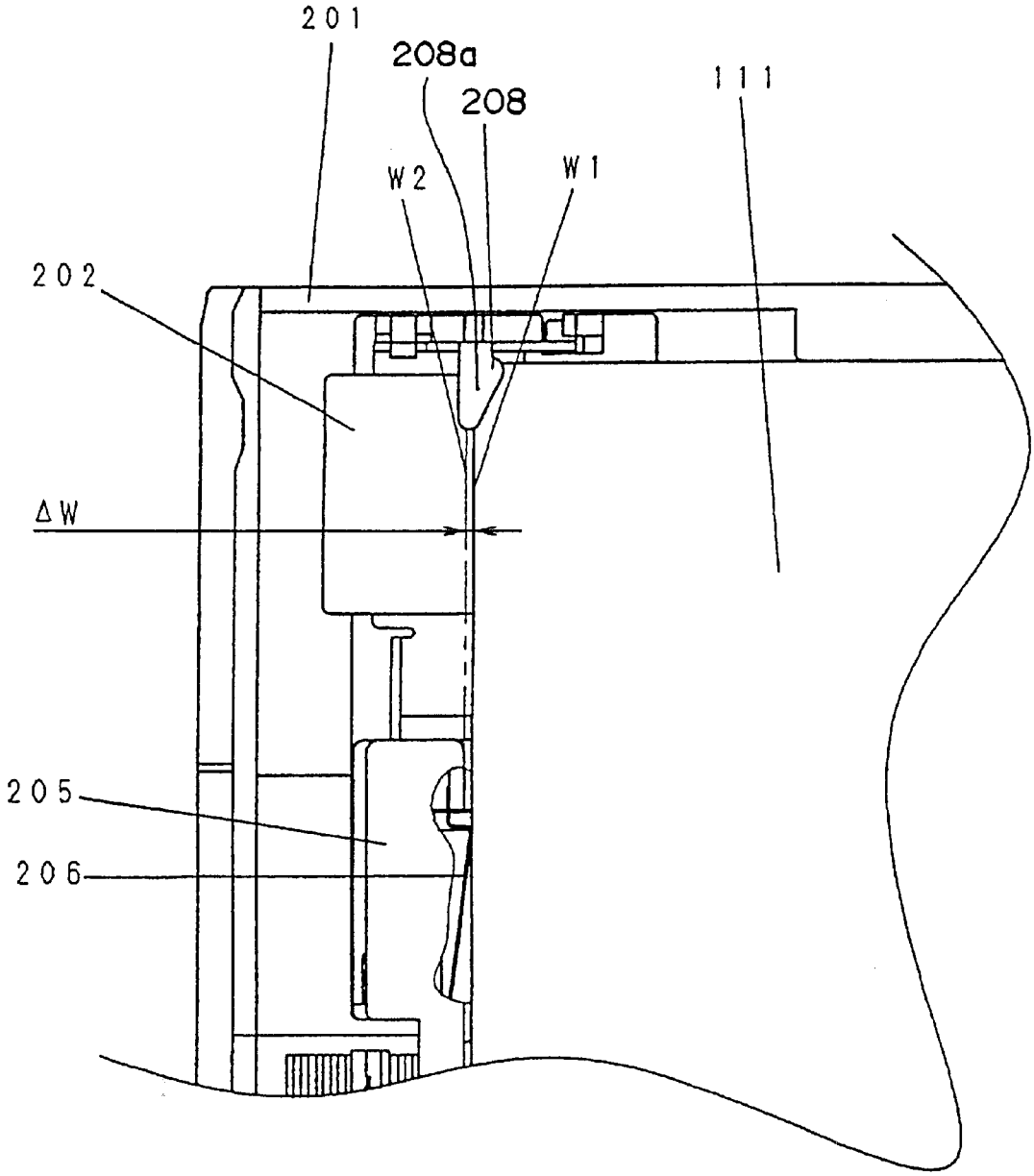
FIG. 26 is a conception illustration of a non-reference edge of stacked sheets.

The engagement amount at the non-reference end of the sheets 111 to the separation portion 208*a* of the separation nail B208 may be changed while the sheets 111 are stacked, due to deviations in size during the sheet cutting, deviations caused by extension and contraction of the sheets according to absorption of moisture, deviations in an assembled manner of the side guide 205 set by the operator, or the like, whereas the reference end of the sheets 111 is set always at a constant position by pressure of the reference guide member 201*a* according to urging of the front end pressing spring 206, and whereas the reference end has a constant engagement amount with the separation portion 207*a* of the separation nail A207. As shown in FIG. 26, though the non-reference end of the sheets 111 is normally in contact with the guide surface 205*e* of the side guide 205 to render the engagement amount to the separation nail B208 an amount W2, the non-reference end position of the sheets 111 is shifted to the sheet reference side by deviation $\Delta W$ if the deviation $\Delta W$ exists because the non-reference end of the sheets 111 is urged by the front end pressing spring 206 toward the sheet reference side (or a direction going away from the separation portion 208*a*), so that the engagement amount to the separation nail B208 is reduced to W1 by subtraction of the deviation $\Delta W$. The engagement amount to the sheets 111 may be different between the separation nail A207 and the separation nail B208, thereby causing double feeding of the sheets 111, which lack the enough engagement amount, from a looping amount shortage for separation, or causing feeding failures such as comer folding, obliquely feeding, paper jamming, or the like of the sheets 111, which have excessive engagement amount, due to increased resistance against passing the nail.

With this invention, the engagement amount of the separation portion 208*a* of the separation nail B208 with respect to the sheets 111 is substantially the same as the separation nail A207 with respect to the sheet conveyance direction, but the real size of the engagement amount in the sheet width direction is made slightly larger (about 0.3 mm) than the size of the separation nail A207 in consideration of the deviation ΔW. Therefore, the difference in the engagement amount to the sheets 111 between the separation nail A207 and the separation nail B208 is made smaller, and the separating operation of the sheets 111 is done suitably, thereby effectively preventing the sheets from being doubly fed, obliquely fed, fed with folded comers, or subjecting to paper jamming.

Figure 24:
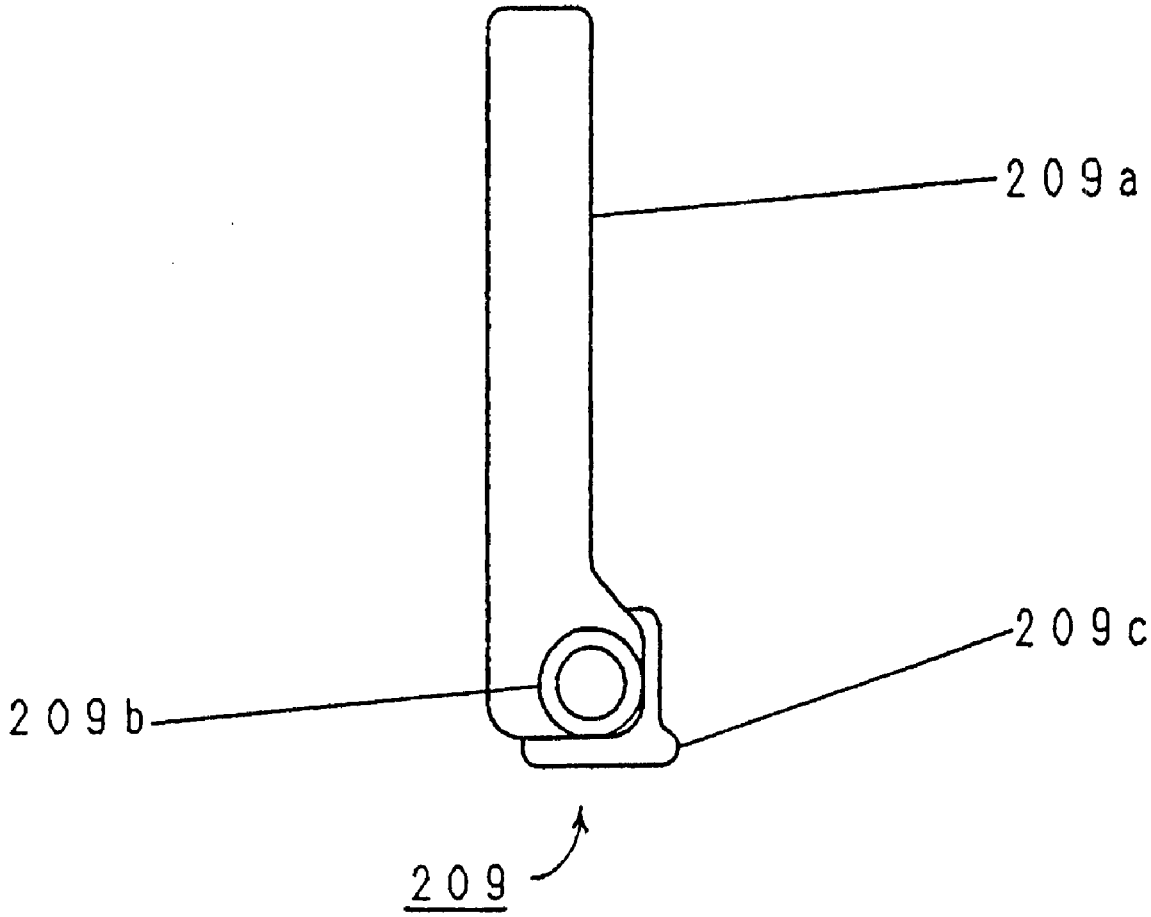
FIG. 24 is a side view showing a rear end limiting plate.

The rear end limiting plate 209 shown in FIG. 24 fits rotatably to a bearing 201*u* of the cassette 201 with a shaft 209*b* and can select two positions for a state that the plate is laid horizontally and a state that the plate is made substantially upright by a cam 209*c*. As described above, where the sheets in A4 size are stacked, the rear end limiting plate 209 is laid to extend horizontally, and where the sheets in LTR size are stacked, the rear end of the sheets 111 in LTR size is positioned by the guide surface 209*a* of the rear end limiting plate 209 as the plate is made substantially upright. Where the rear end limiting plate 209 is made upright, the guide surface 209*a* is located at a position of A4 portrait vertical size (297 mm) plus alpha (margin of the sheet 111) away from the sheet front end hitting surface 201*b*, and therefore, the rear end of the sheets 111 can be positioned suitably even where the LTR size of the sheets is deviated.

Pickup, Separating Operation

During a waiting state, a half moon surface of the feeding roller 112*e* orients to be parallel to the stacked sheets 111. The pressing plate 202 and the stacked sheets 111 on the pressing plate 202 are urged by the pressing plate spring 203 and receive force in a direction pressing the feeding roller 112*e*, but the rotation of the pressing plate 202 is limited by the separation nail A207 and the separation nail B208. At that time, there is a prescribed gap H1 between the half moon surface of the feeding roller 112*e* and the stacked sheets 111.

According to feeding instruction, when the feeding roller 112*e* starts rotating, the outer peripheral surface of the feeding roller 112*e* in an arc shape pushes down the pressing plate 202 and the sheets 111 on the pressing plate in opposing to urging force of the pressing plate spring 203. At that time, pressing force works between the sheets on the pressing plate 202 and the outer peripheral surface of the feeding roller 112*e* in the arc shape by the urging force of the pressing plate spring 203. This creates frictional force between the outer peripheral surface in the arc shape of the feeding roller 112*e* driven rotatively and the topmost sheet 111. As described above, because the frictional coefficient $\mu$3 between the feeding roller 112*e* and the topmost sheet 111*a* is higher than the frictional coefficient $\mu$1 between the sheets, the topmost sheet 111*a* is conveyed in the rotation direction of the feeding roller 112*e* according to the frictional force. At that time, both comers of the front end of the topmost sheet 111*a* hit hitting walls 207*b*, 208*c* of the separation nail A207 and the separation nail B208, respectively in the same prescribed amount. As the center portion of the topmost sheet 111 is conveyed, approximately the same loops are formed on the right and left sides, thereby promoting the separation from the second or more sheets 111. When the loop of the topmost sheet 111*a* reaches a prescribed amount or more, the sheet ends start sliding along the slopes 207*c*, 208*d* of the separation nail A207 and the separation nail B208, thereby being released from the separation nail A207 and the separation nail B208 and conveyed on the downstream side.

ASF Unit

Referring to FIG. 27 to FIG. 59, the ASF unit 112 as a feeding mechanism system is described next.

A structural outline of the whole ASF unit is described.

Figure 27:
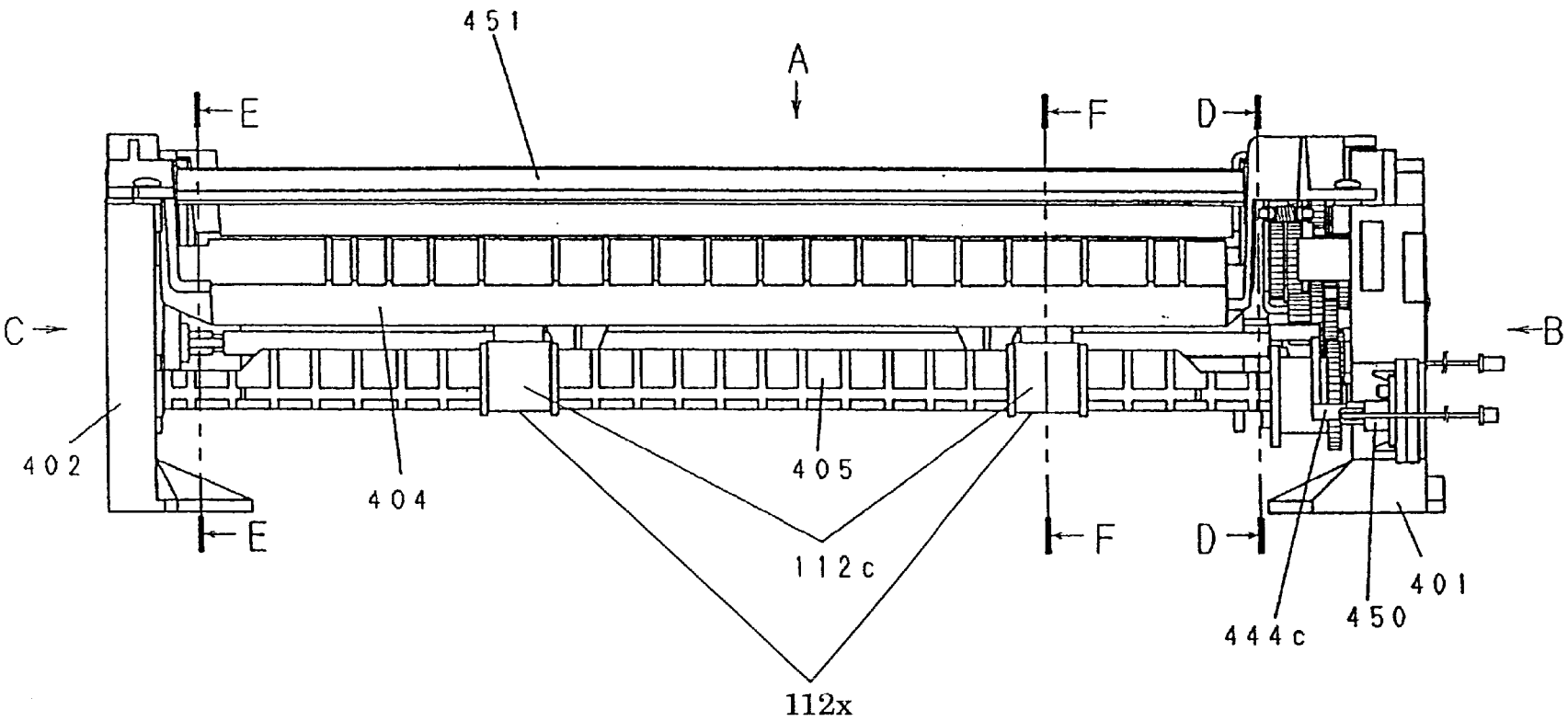
FIG. 27 is a front view showing an ASF unit.
Figure 28:
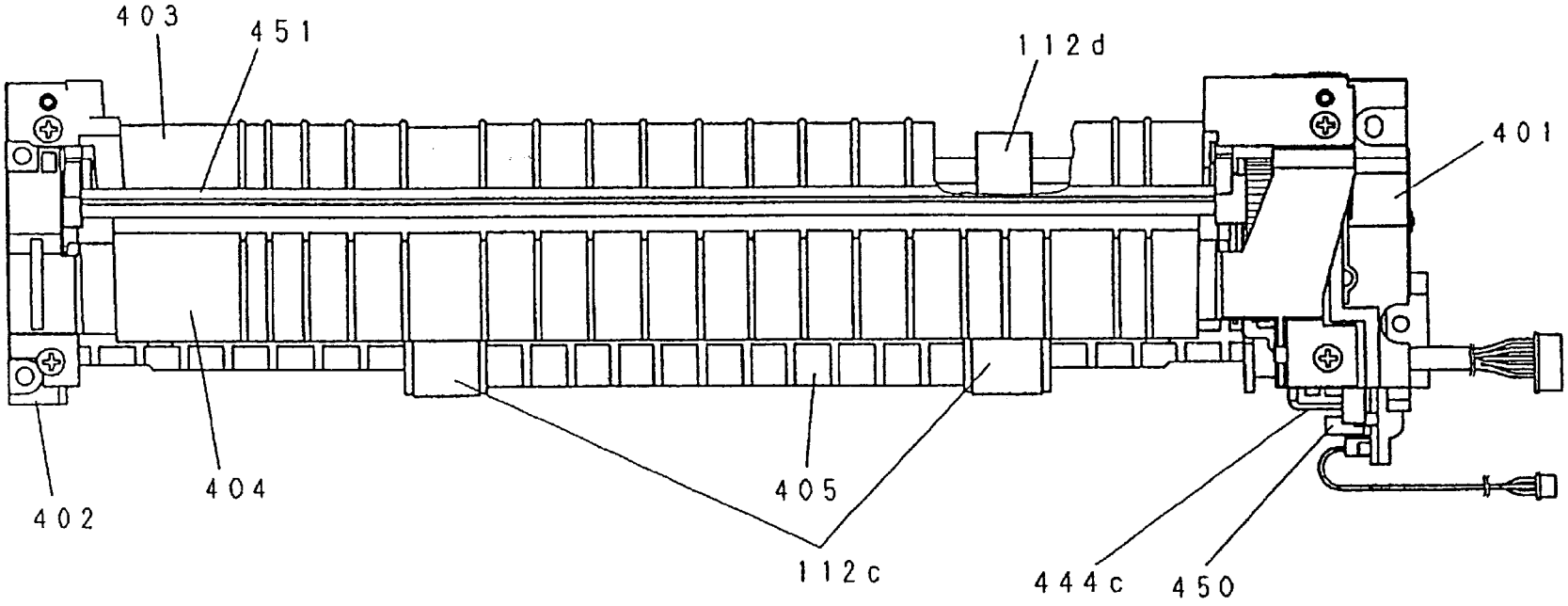
FIG. 28 is a top view showing the ASF unit.
Figure 29:
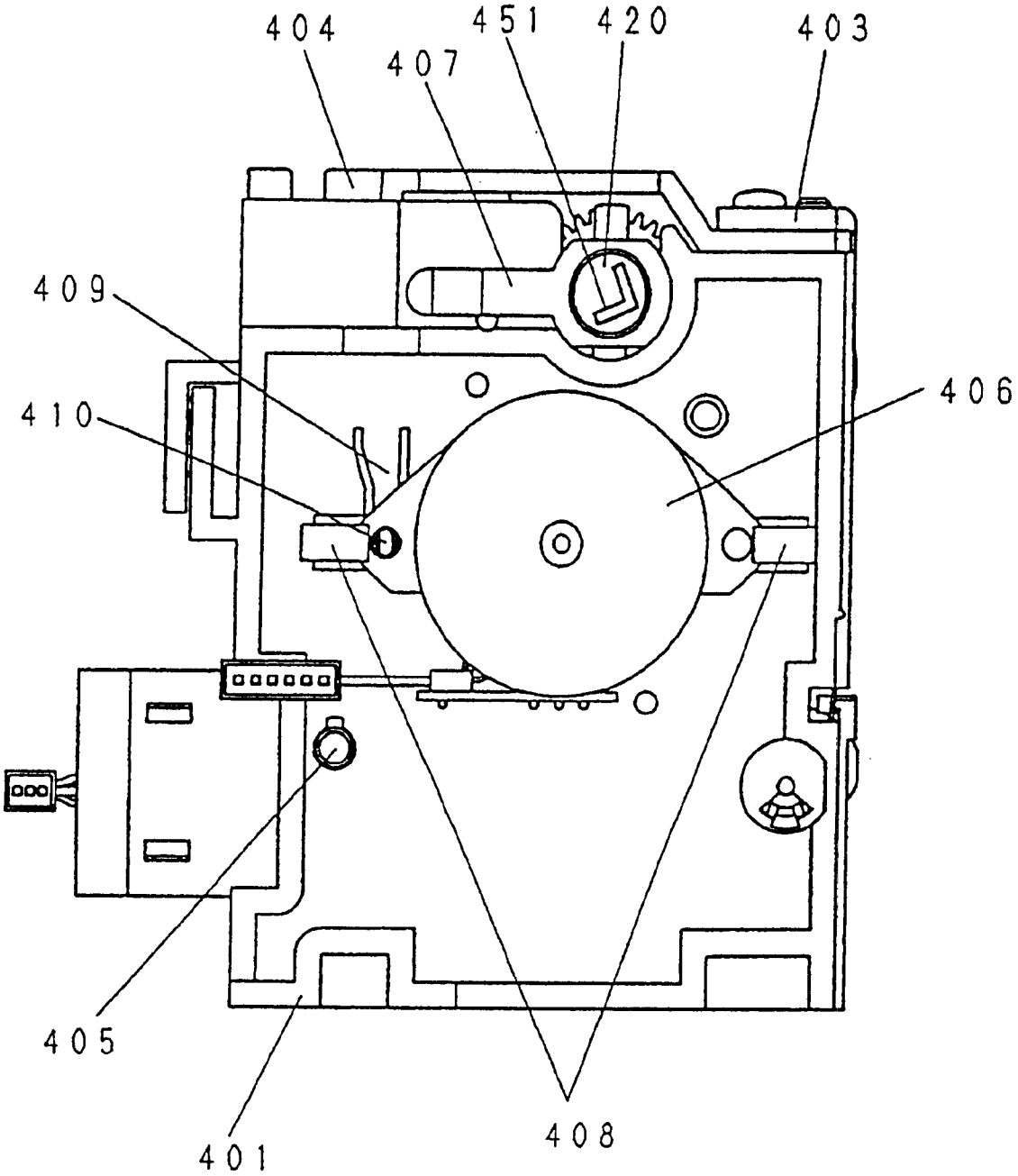
FIG. 29 is a right side view showing the ASF unit.
Figure 30:
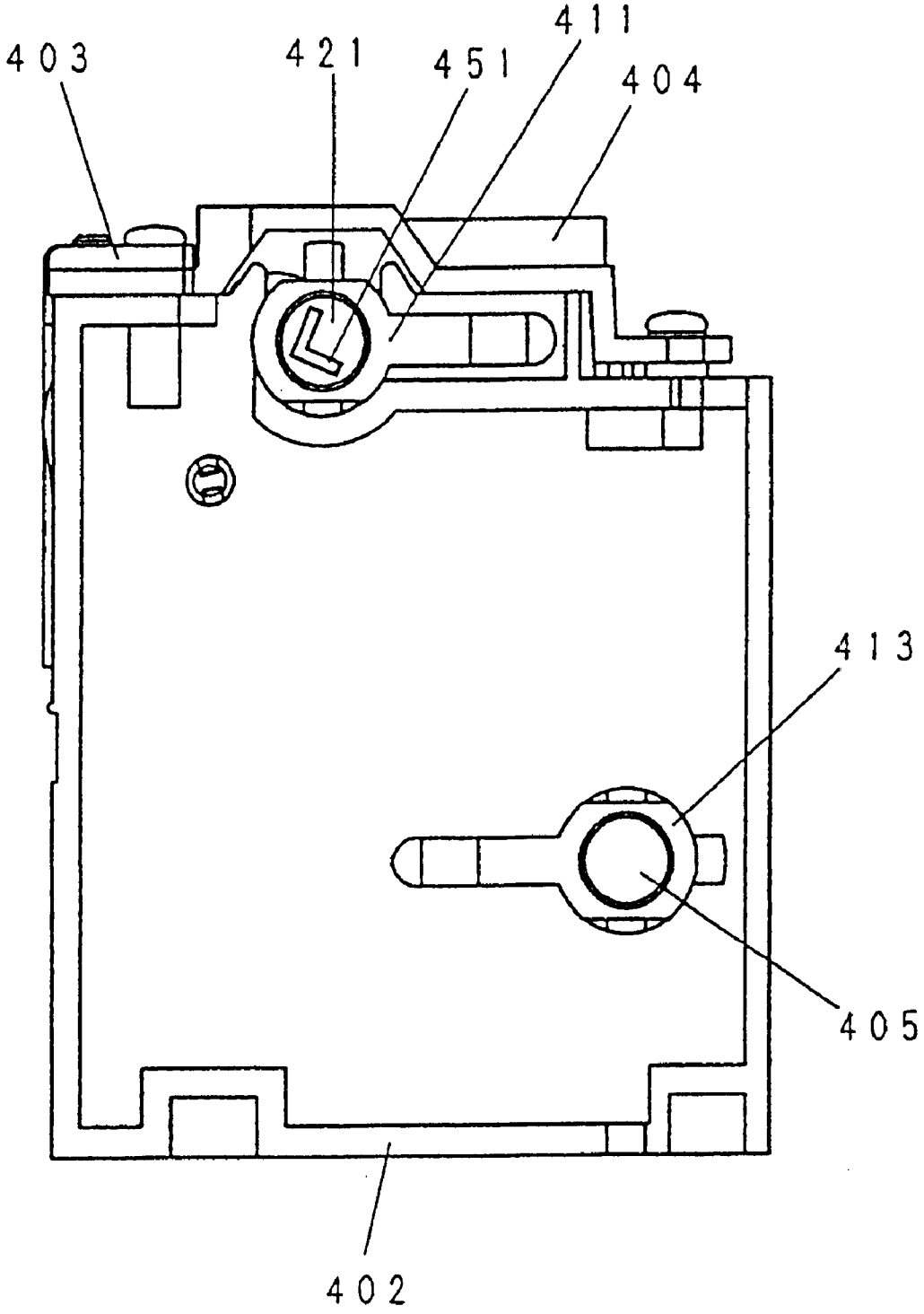
FIG. 30 is a left side view showing the ASF unit.

FIG. 27 to FIG. 39 show a appearance of the structure of the ASF unit. This ASF unit is secured to and contained in the apparatus body. FIG. 27 is a front view. FIG. 28 is a top view. A U-turn inner guide A403 and a U-turn inner guide B404 are screwed to a frame A401 and a frame B402. A feeding shaft 405 and a cam shaft 451 are rotatably supported to the frame A401 and the frame B402. The feeding roller 112*e* is formed of the feeding shaft 405 and a separation roller rubber 112*c*. The feeding roller 112*e* has a cutout portion 112*x* at a portion of the roller, and the feeding roller 112*e* does not contact with the sheet where the cutout portion 112*x* faces to the sheet conveyance direction upon rotation of the feeding roller 112*e*. The separation roller rubber 112*c* that rotates together with the feeding shaft 405 is adhered to two locations on the feeding shaft 405 in a range of the feeding roller. The separation roller rubber 112*c* has the same cross section at the two locations. FIG. 29 is a right side view of the AFS unit, when seen along the arrow B in FIG. 27. The ASF motor 406 is supported to the frame A401 by motor flange pressing members 408 formed at two locations together with the frame A401, and holes of the motor flanges are engaged with projections 410 for engaging the flange formed at a tip of an elastic portion 409 of the frame A401. The ASF motor 406 is coupled to a circuit board for apparatus body. Numeral 407 is a bearing A, supports rotatably a cam A420 as described below, and is secured to the frame A401. FIG. 30 is a left side view of the AFS unit, when seen along the arrow C in FIG. 27. A bearing B411 supports rotatably a cam B421 as described below, and is secured to the frame B402. The bearing C413 supports rotatably a feeding shaft 405 and is secured to the frame B402.

Figure 31:
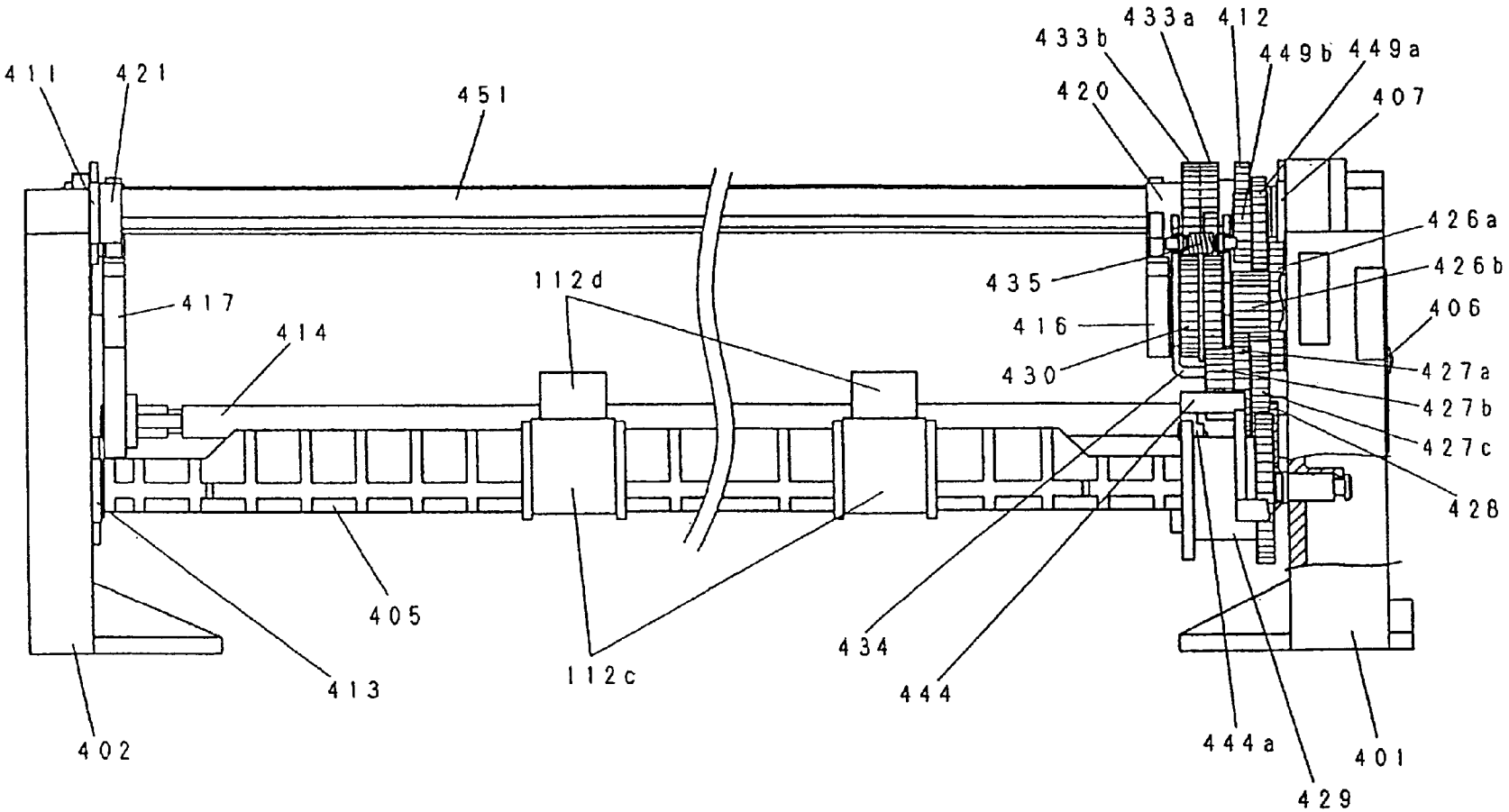
FIG. 31 is an approximately front view showing the ASF unit.
Figure 32:
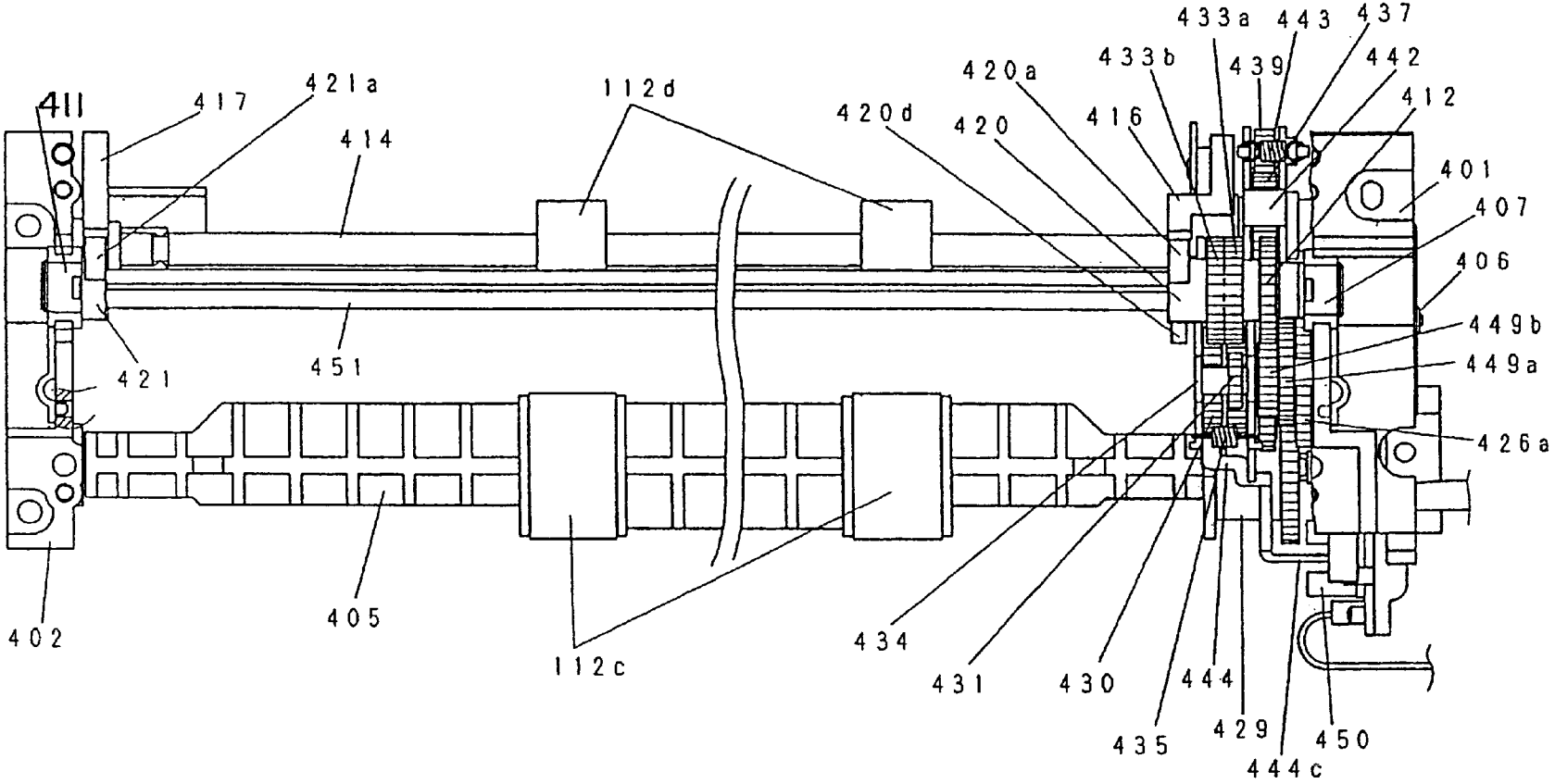
FIG. 32 is an approximately top view showing the ASF unit.
Figure 33:
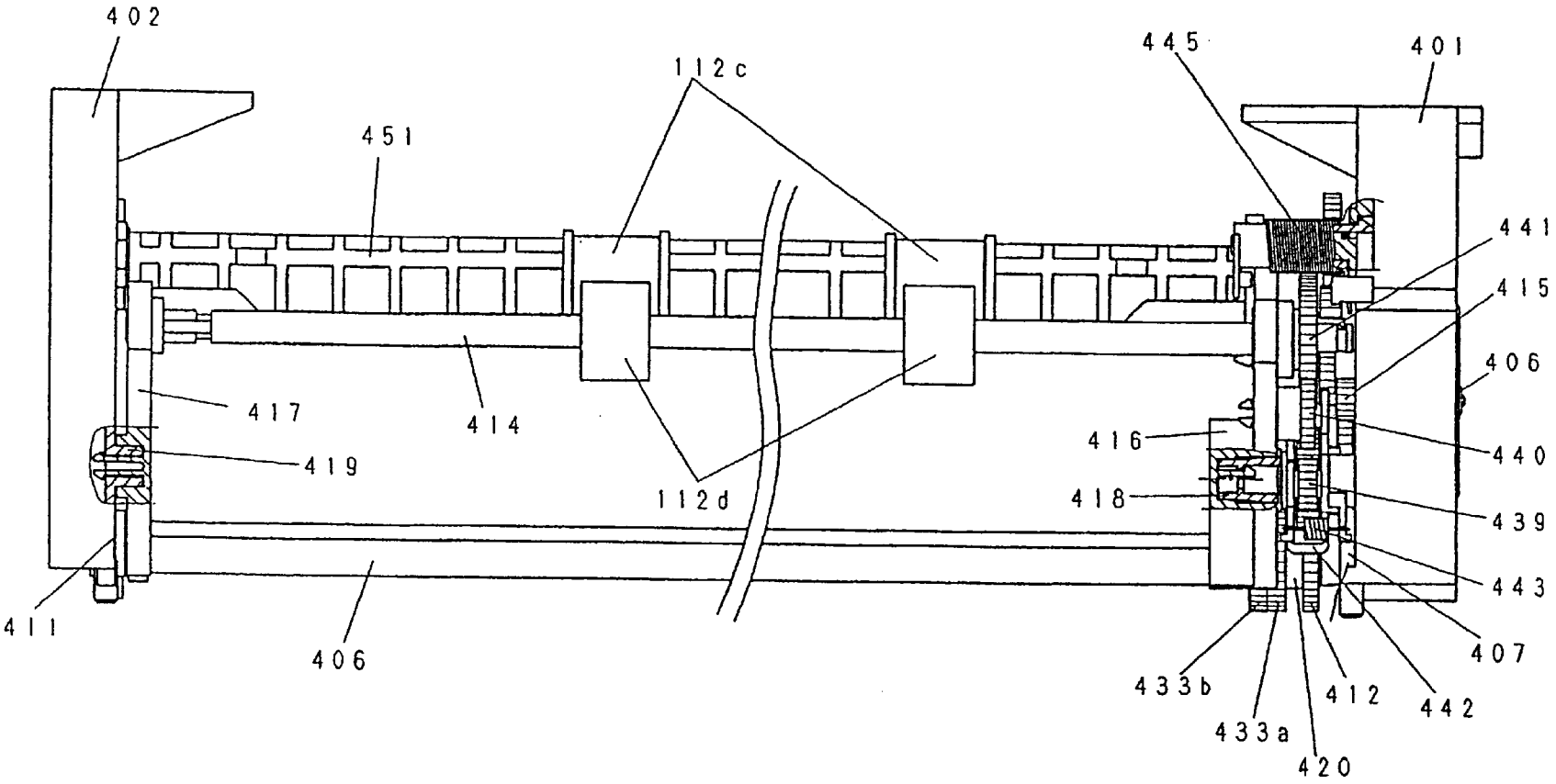
FIG. 33 is an approximately rear view showing the ASF unit.

FIG. 31 to FIG. 33 show the ASF unit in which the U-turn guide A and U-turn guide B are deleted. FIG. 31 is a front view; FIG. 32 is a top view; FIG. 33 is a rear view. An intermediate conveyance roller is made of a U-turn roller 112*d* and a U-turn roller shaft 414. A pair of the U-turn rollers 112*d* is secured to the U-turn roller shaft 414 and rotates unitedly with the U-turn roller shaft 414. A U-turn roller holder A416 and a U-turn roller holder B417 are supporting means for the pair of the intermediate conveyance rollers. The U-turn roller holder A416 is supported rotatably to a supporting shaft 418 of the frame A401, and the U-turn roller holder B417 is supported rotatably to a supporting shaft 419 of the frame B402.

Figure 34:
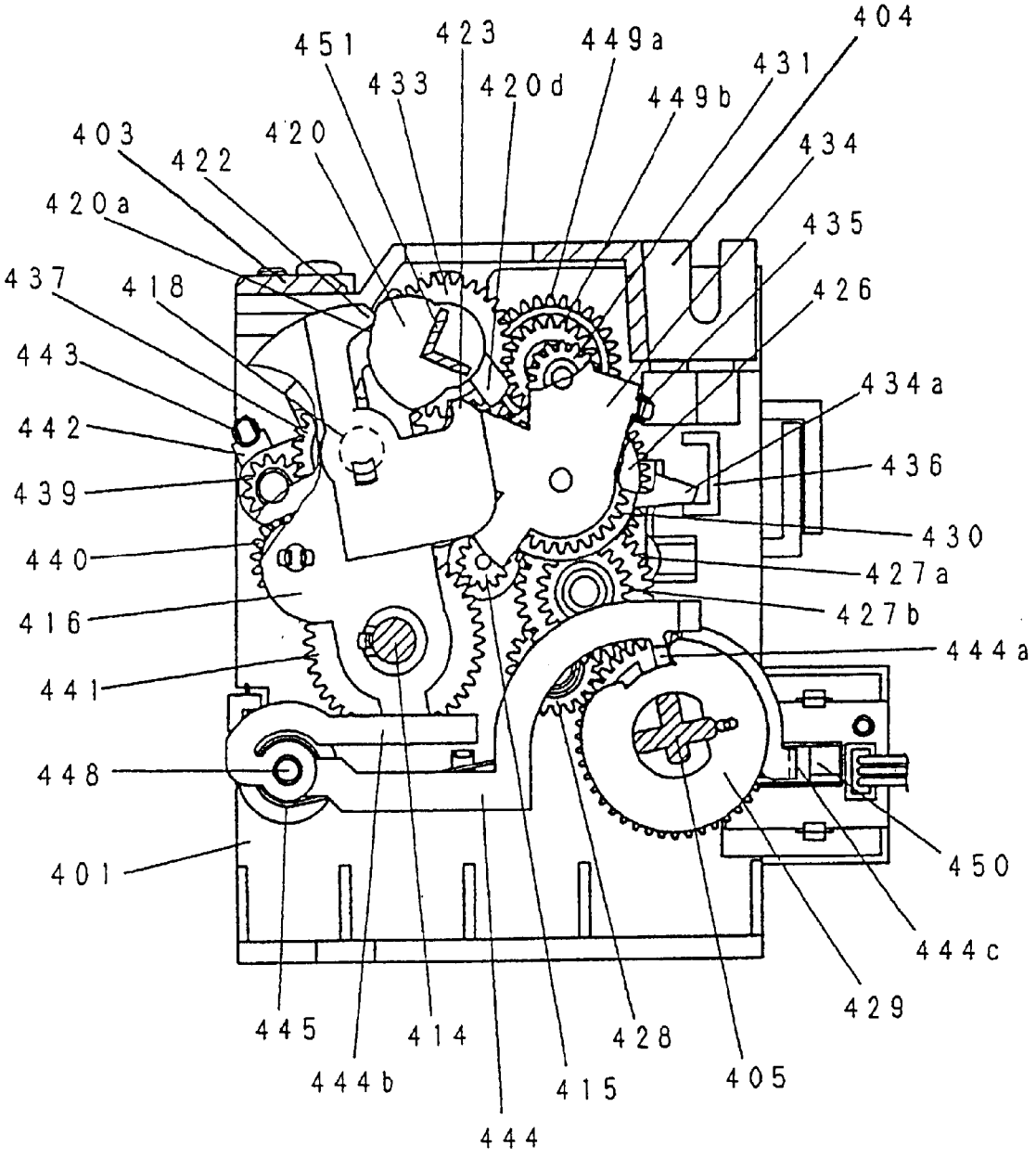
FIG. 34 is a cross section showing the ASF unit.
Figure 35:
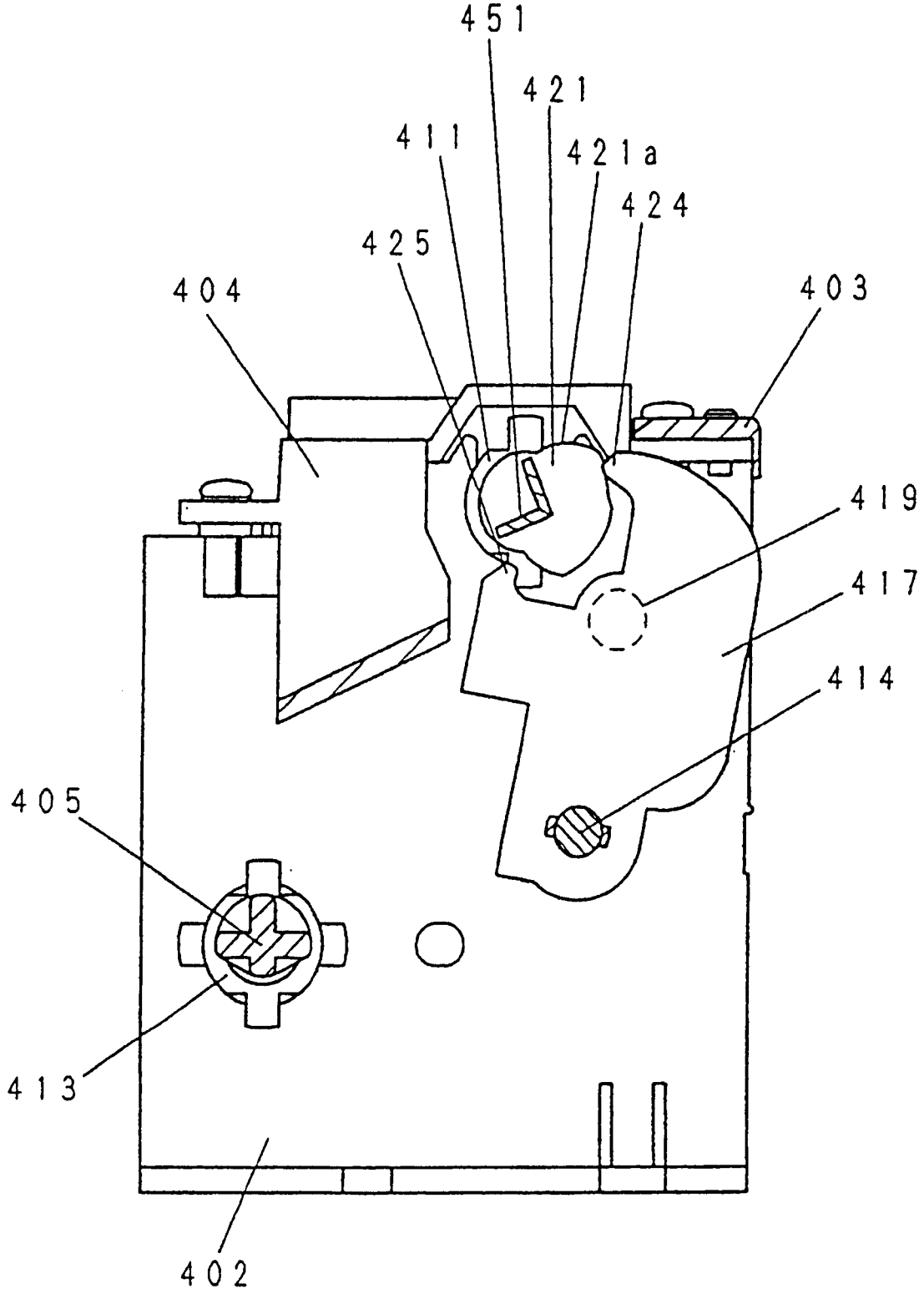
FIG. 35 is a cross section showing the ASF unit.

FIG. 34 and FIG. 35 are a D—D line cross section and an E—E line cross section, respectively, in FIG. 27. In FIG. 34, numeral 422 is an up cam follower portion; numeral 423 is a down cam follower portion; both are formed unitedly with the U-turn roller holder A416. Numeral 420*a* is a cam surface of the cain 420 driven rotatively by the ASF motor and swings the U-turn roller holder A416 around the supporting shaft 418 as a rotation center in operating to the up cam follower portion 422 and the down cam follower portion 423. In FIG. 35, numeral 424 is an up cam follower portion; numeral 425 is a down cam follower portion; both are formed unitedly with the U-turn roller holder B417. A cam surface 421*a* of the cam B421 swings the U-turn roller holder B417 around the supporting shaft 419 as a rotation center in operating to the up cam follower portion 424 and the down cam follower portion 425. The cam A420 and the cam B421 are coupled to a cam shaft 451 and rotate together. In this embodiment, the cam shaft 451 is made of a metal pressed article having an L-letter shaped cross section. The cam shapes of the cam A420 and the cam B421 are the same and rotate with the same phase. The shapes of the cam follower portions are the same at the right and left U-turn holders. It is to be noted that in FIG. 34, numeral 450 is an ASF sensor as described below and is a locking detecting means for detecting a clutch engaging means. The ASF sensor 450 is secured with respect to the frame A401 and is coupled to the circuit board of the apparatus body.

Before a description of the respective mechanical elements, an outline of feeding operation of this feeding system is described. FIG. 36 to FIG. 39 are structural views regarding F—F cross section in FIG. 27. Operation proceeds in the order from FIG. 36 to FIG. 39.

Figure 36:
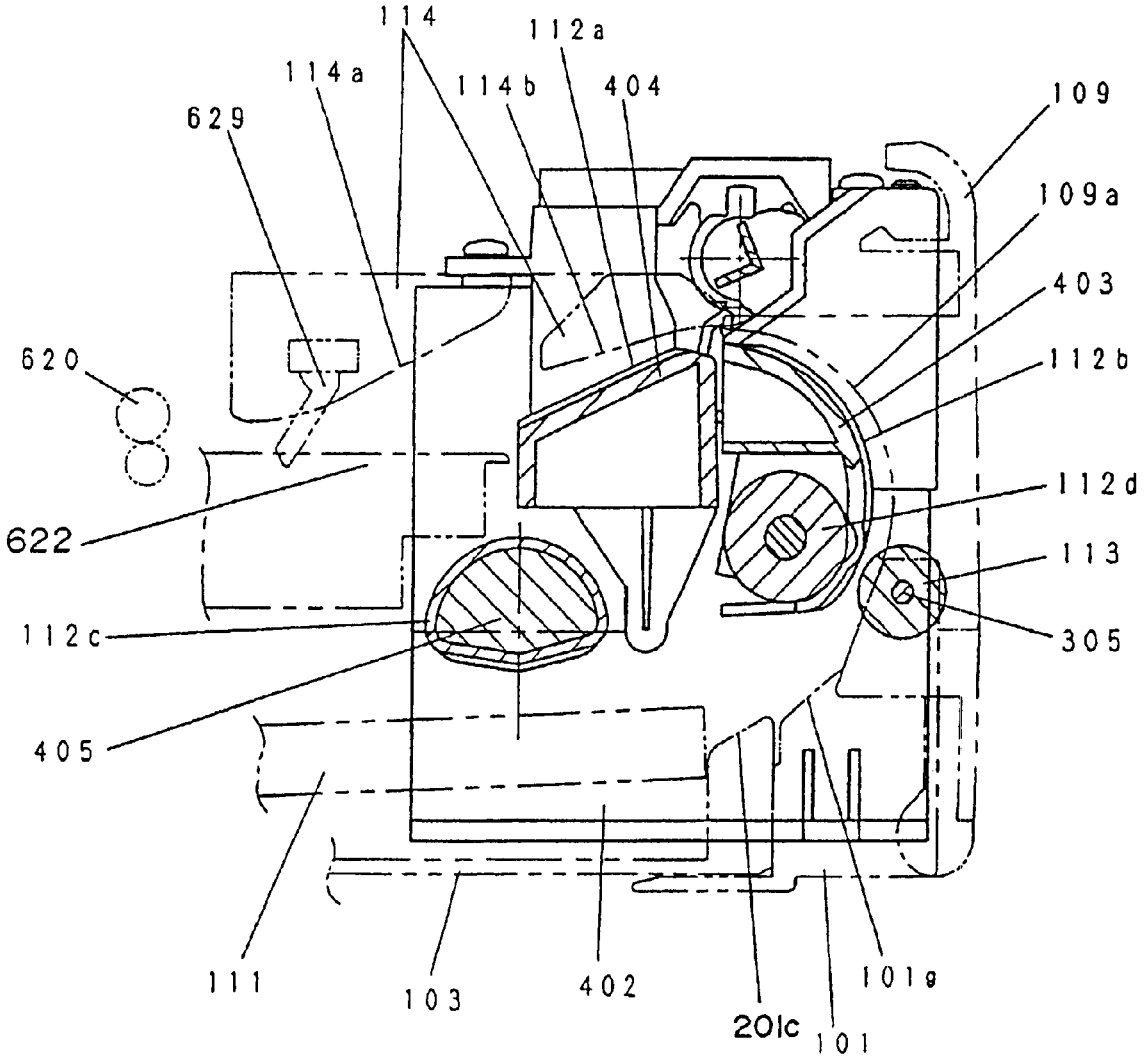
FIG. 36 is a cross-sectional diagram of a feeding route (feeding waiting state)

FIG. 36 shows a state that the apparatus waits feeding where the feeding cassette 103 is attached. The cross section of the separation roller rubber portion is in about a half moon shape, and a space is guaranteed over the top surface of the stacked sheets. The inner side of the feeding route up to the printer section are formed of a guide surface 112*b* of the U-turn inner guide A403, a guide surface 112*a* of the U-turn inner guide B404, and a platen 622. The outer side of the feeding route is formed of the bank 201*c* of the feeding cassette, the guide rib 101*g* of the bottom casing, the guide rib 109*a* of the U-turn cover 109, the guide rib 114*b* of the paper passing guide 114, and the guide surface 114*a*. At the feeding waiting state shown in FIG. 36, the U-turn roller 112*d* takes a position remote to the U-turn pinch roller 113 and escapes inward from the guide surface 112*b* of the U-turn inner guide A403.

Figure 37:
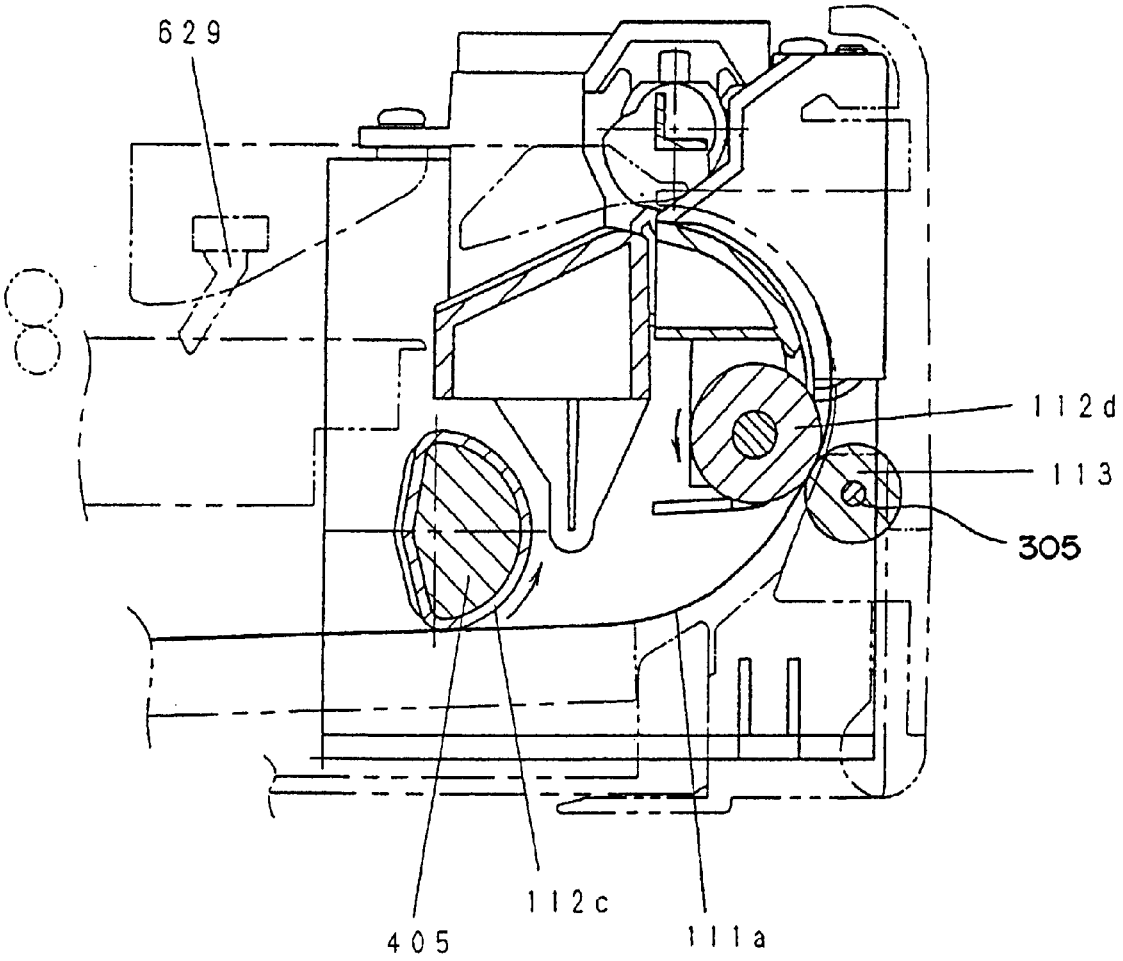
FIG. 37 is a cross-sectional diagram of the feeding route (sheet picking up)
Figure 38:
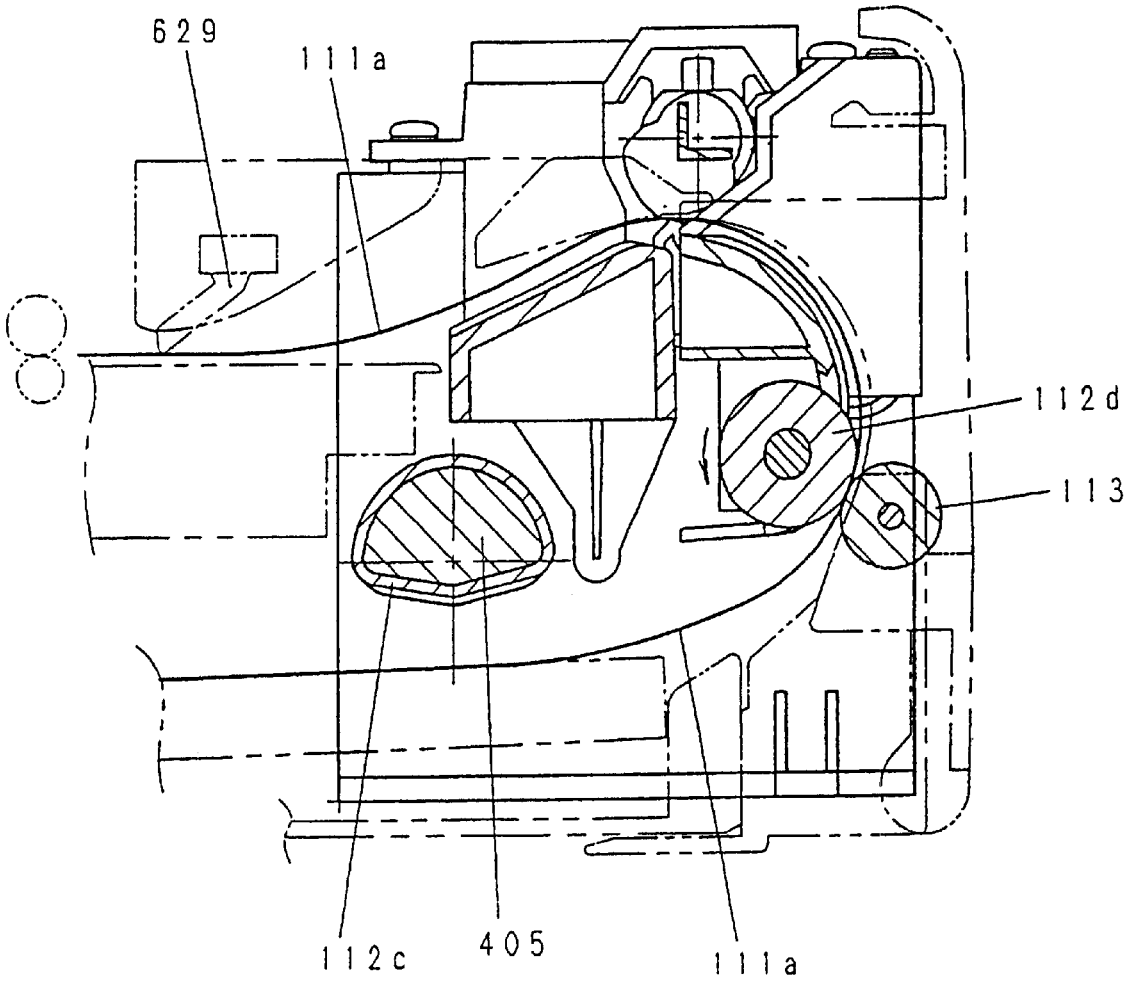
FIG. 38 is a cross-sectional diagram of the feeding route (sheet conveyance)
Figure 39:
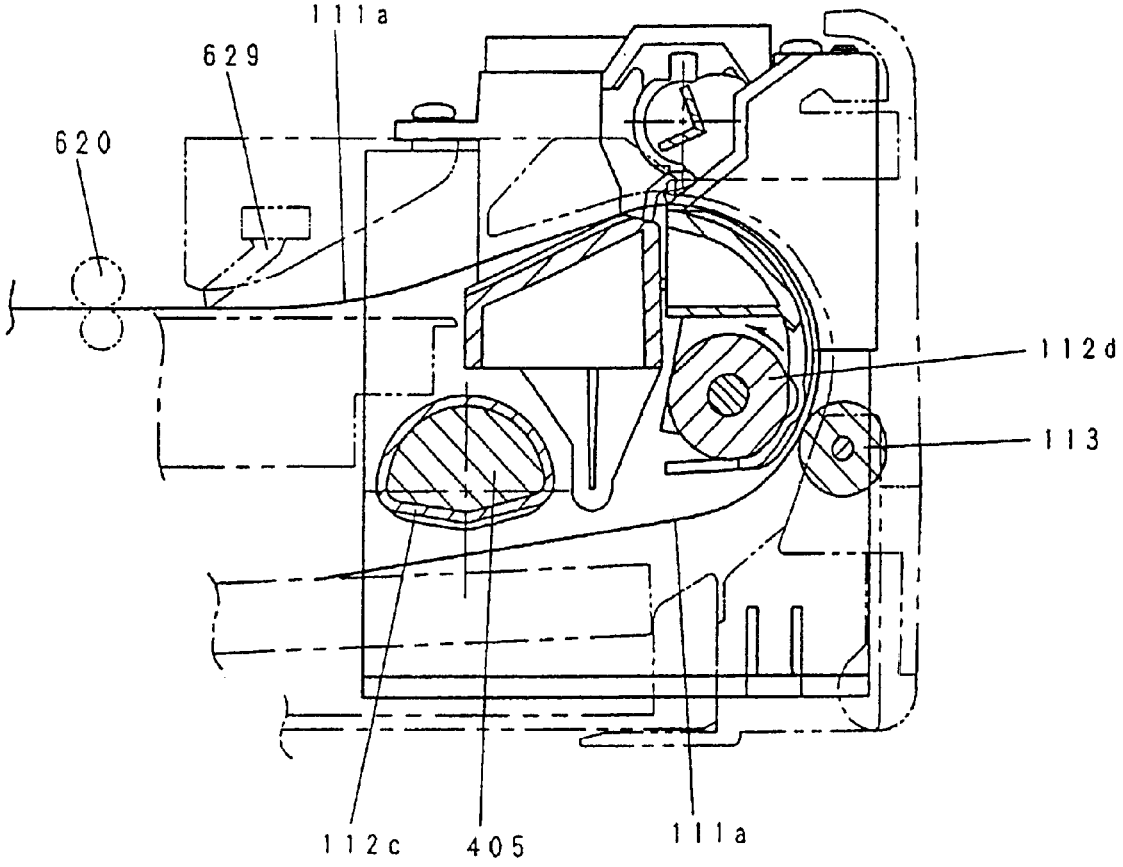
FIG. 39 is a cross-sectional diagram of the feeding route (U-turn roller escaping)

FIG. 37 shows a state that feeding operation begins and the sheet 111*a* is picked up and sent to the feeding route. The separation roller rubber 112*c* of the pickup portion rotates in the arrow direction and contacts with the sheet 111*a* to pick up the sheet 111*a*, and the U-turn roller 112*d* rotates in the arrow direction to be pushed toward the U-turn pinch roller 113. According to opposite force from deformation of the pinch roller shaft 305, conveyance force is exerted to the sheet arrived at a nip between the U-turn roller 112*d* and the U-turn pinch roller 113, and the feeding operation proceeds further. The drive speed reduction system is structured to render the peripheral speeds of the separation roller rubber 112*c* and the U-turn roller 112*d* the same. The feeding shaft 405 and the U-turn roller 112*d* rotate to feed the sheet, and when the feeding shaft makes one turn, the feeding operation proceeds upon continued rotation of the U-turn roller 112*d* only as shown in FIG. 38. When prescribed feeding ends from cooperation with the feeding roller 620 of the printer section, the U-turn roller 112*d* rotates in the arrow direction as shown in FIG. 39 and moves away from the U-urn pinch roller 113 while feeding. The feeding mechanism system returns to the feeding waiting state shown in FIG. 36.

That is, the sheet is released from any load on the upstream side of the printer section. Subsequently, where the printer section performs feeding and printing operations, almost none of paper passing load, or namely so-called back tension remains in the ASF feeding system, and therefore, the printer section can do sheet conveyance stably to obtain good recording ability.

Hereinafter, respective mechanical elements are described. For each description of the mechanical elements, only related parts are shown. The whole layout of the parts is shown from FIG. 31 to FIG. 34.

Figure 40:
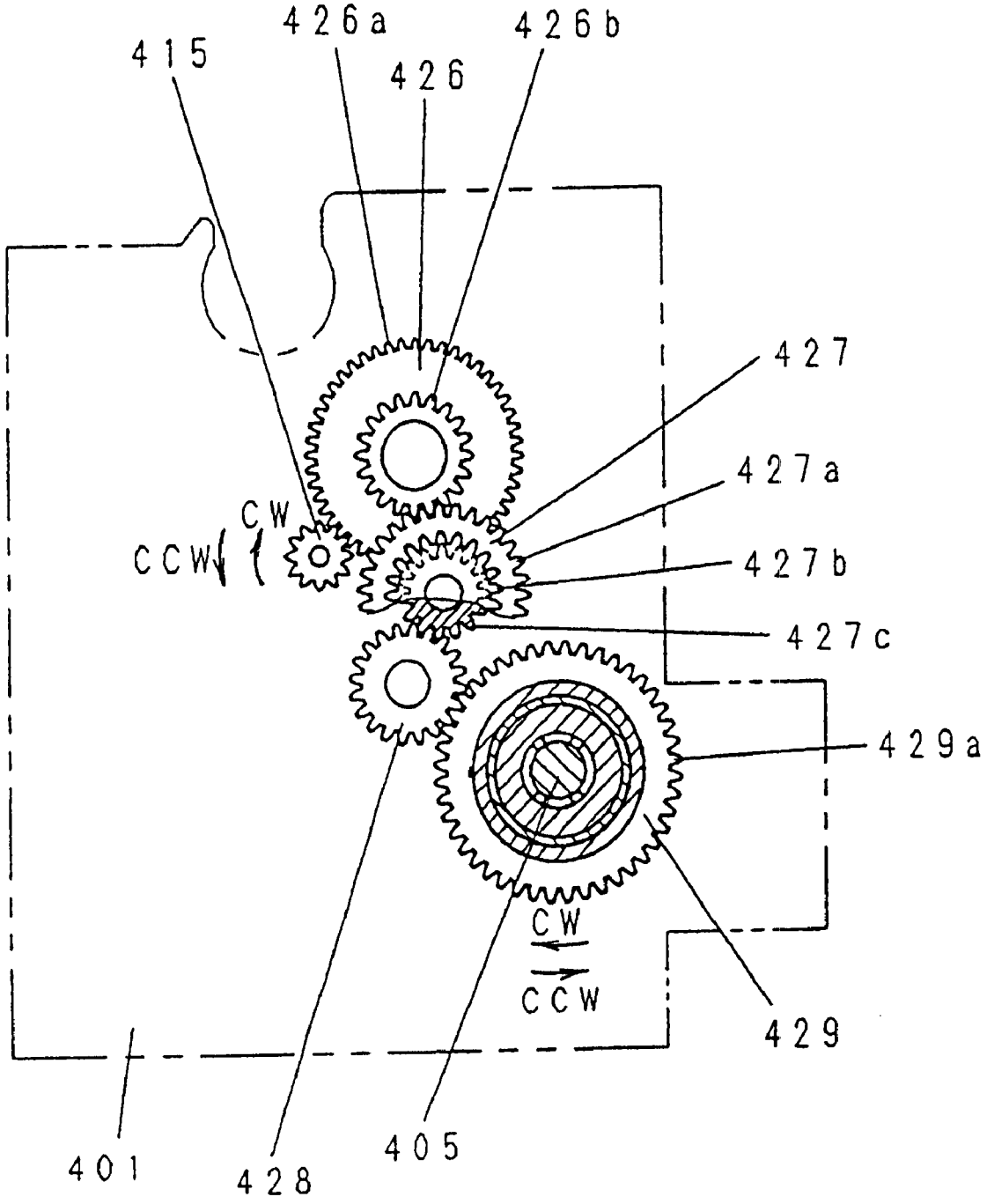
FIG. 40 is a gear train diagram of a feeding shaft drive system.

Now, a drive system of the feeding shaft 405 is described. FIG. 40 shows a gear train for driving the feeding shaft 405. Numeral 415 is a pinion gear placed at an output shaft of the ASF motor 406 as a drive source. Numeral 426 is a motor speed reduction gear supported rotatably to the frame A401 and is formed unitedly with an input gear 426*a* and an output gear 426*b*. Numeral 427 is a feeding speed reduction gear supported rotatably to the frame A401 and is formed unitedly with an input gear 427*a* and an output gear A427*b* as well as an output gear B427*a*, and the output gear B427*c* transmits the rotation to a feeding idler gear 428 supported rotatably to the frame A401. Numeral 429 is an ASF clutch, which has an input gear 429*a*. The ASF clutch 429 is a one-way clutch selectively capable of outputting input rotations, and detail thereof will be described below. Where the pinion gear 415 rotates in a clockwise direction (hereinafter referred to as CW rotation) as orienting toward the drawing, the input gear 429*a* of the ASF clutch 429 makes the CW rotation, and when the pinion gear 415 rotates in a counterclockwise direction (hereinafter referred to as CCW rotation) as orienting toward the drawing, the input gear 429*a* of the ASF clutch 429 makes the CCW rotation.

Next, an operation system of a swinging mechanism for the U-turn roller holder A416 serving as the intermediate conveyance roller moving mechanism, or a projecting and escaping mechanism for the U-turn roller 112*d*, is described. First, the layout and structures of the respective parts are described. As described above, the right and left U-turn roller holder A416 and U-turn roller holder B417 are swung in synchrony with each other with the same phase, and the drive system of the U-turn roller holder A416 serving on the drive side is described.

Figure 42C:
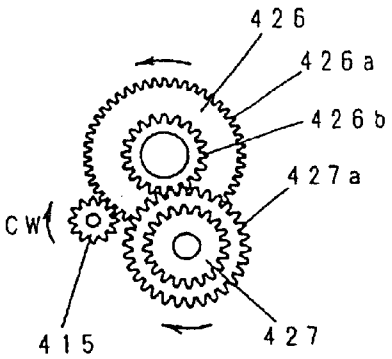
FIGS. 42(*a*)–42(*c*) is a diagram showing a projecting state of the U-turn roller.
Figure 42B:
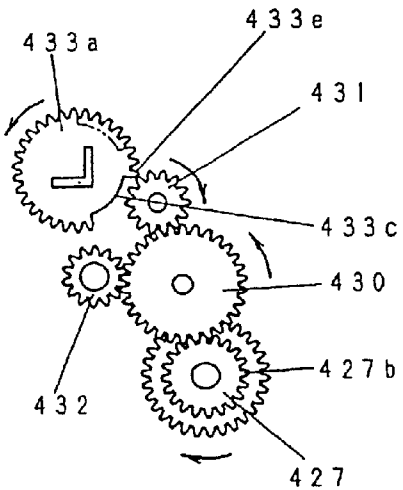
Figure 42A:
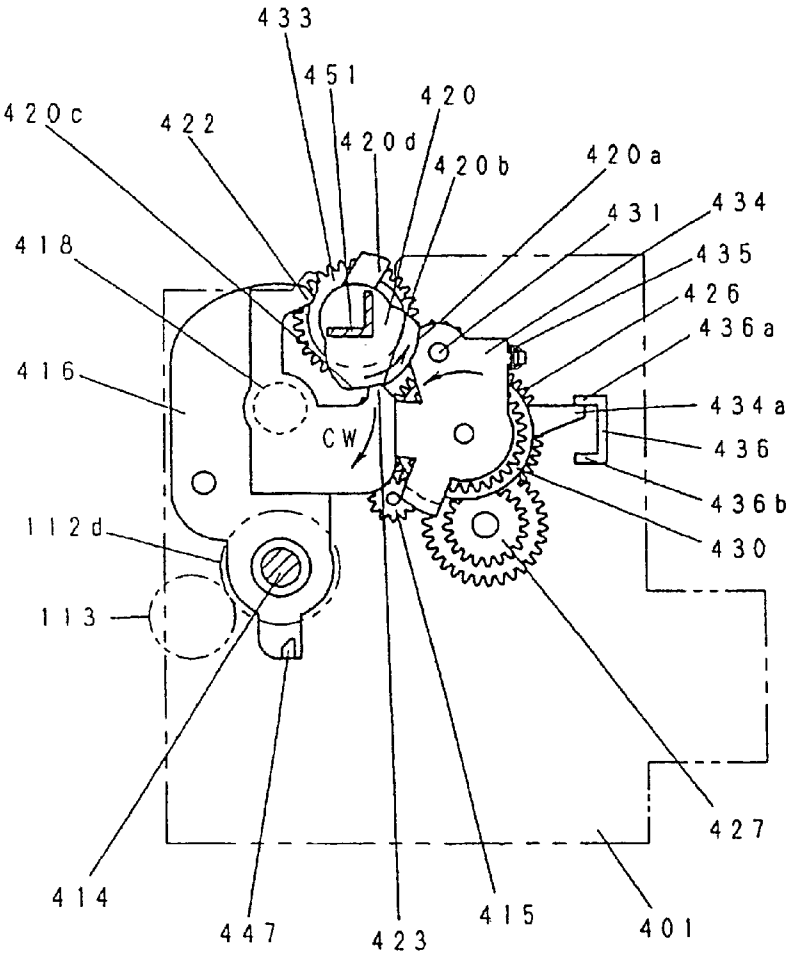
Figure 43C:
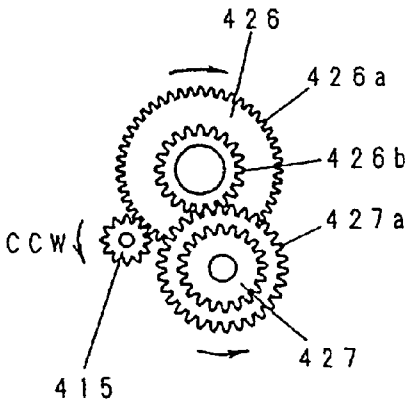
FIGS. 43(*a*)–43(*c*) is a diagram showing an escaping state of the U-turn roller.
Figure 43B:
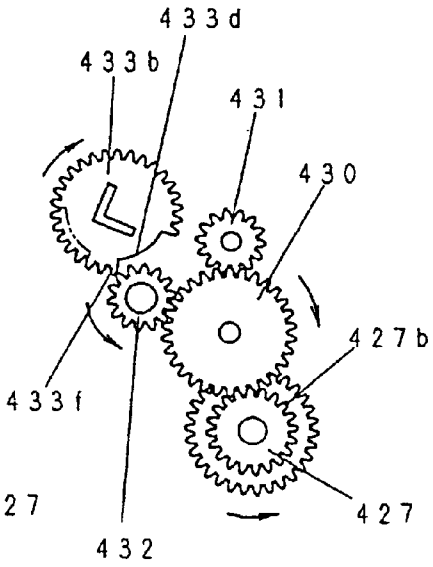
Figure 43A:
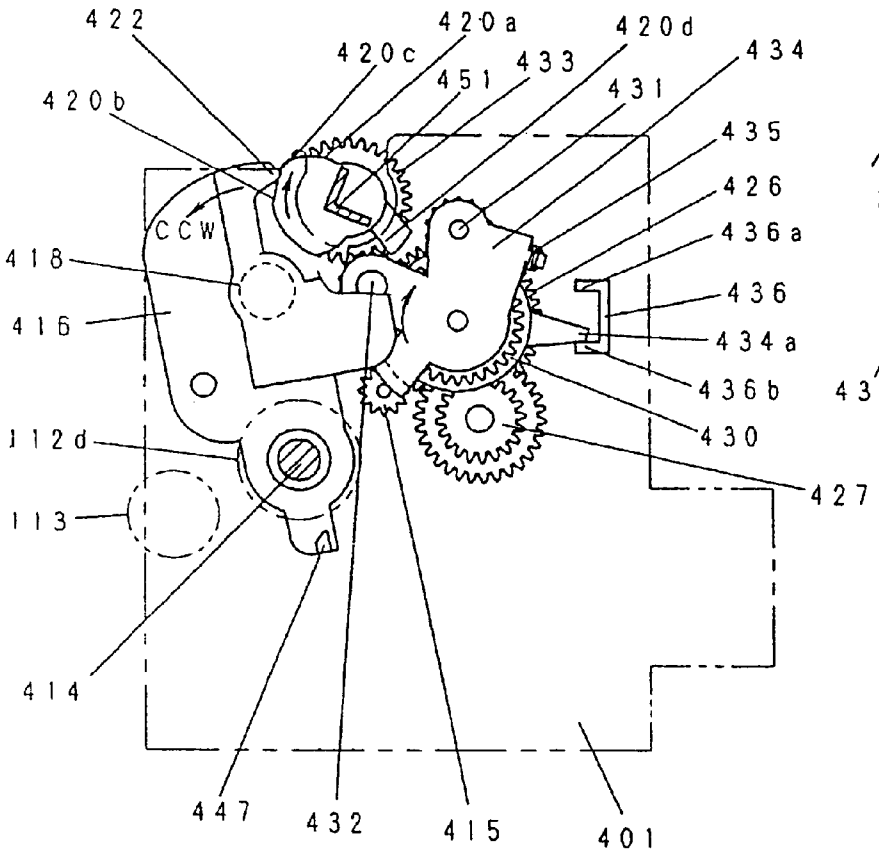

FIG. 42 shows a projecting state of the U-turn roller; FIG. 43 shows an escaping state of the U-urn roller. Referring to FIG. 42, the gear train driving the cam A420 is described. FIG. 42(*c*) shows a gear train from the pinion gear as the drive source to the feeding speed reduction gear 427 through the motor speed reduction gear 426. FIG. 42(*b*) shows a gear train from the feeding speed reduction gear 427 to a cam gear 433. In FIG. 42(*b*), the output gear A427*b* of the feeding speed reduction gear 427 is coupled to a cam sun gear 430. The cam sun gear 430 is supported rotatably to the frame A401 with a rotary shaft commonly used for the motor speed reduction gear 426. The cam sun gear 430 is coupled to a cam planet gear A431 and a cam planet gear B432 as a pair of swinging gears. The cam planet gear A431 and the cam planet gear B432 are sandwiched by a cam planet holder 434 having a rotation center coaxial with the cam sun gear 430 as to be rotatable together with the cam sun gear 430. Numeral 435 is a cam planet holder spring for giving sandwiching load to the cam planet gear A431 and is for rotating the cam planet holder 434 as the cam sun gear 430 rotates. The cam gear 433 is coupled selectively to the cam planet gear A431 or the cam planet gear B432.

Figure 44:
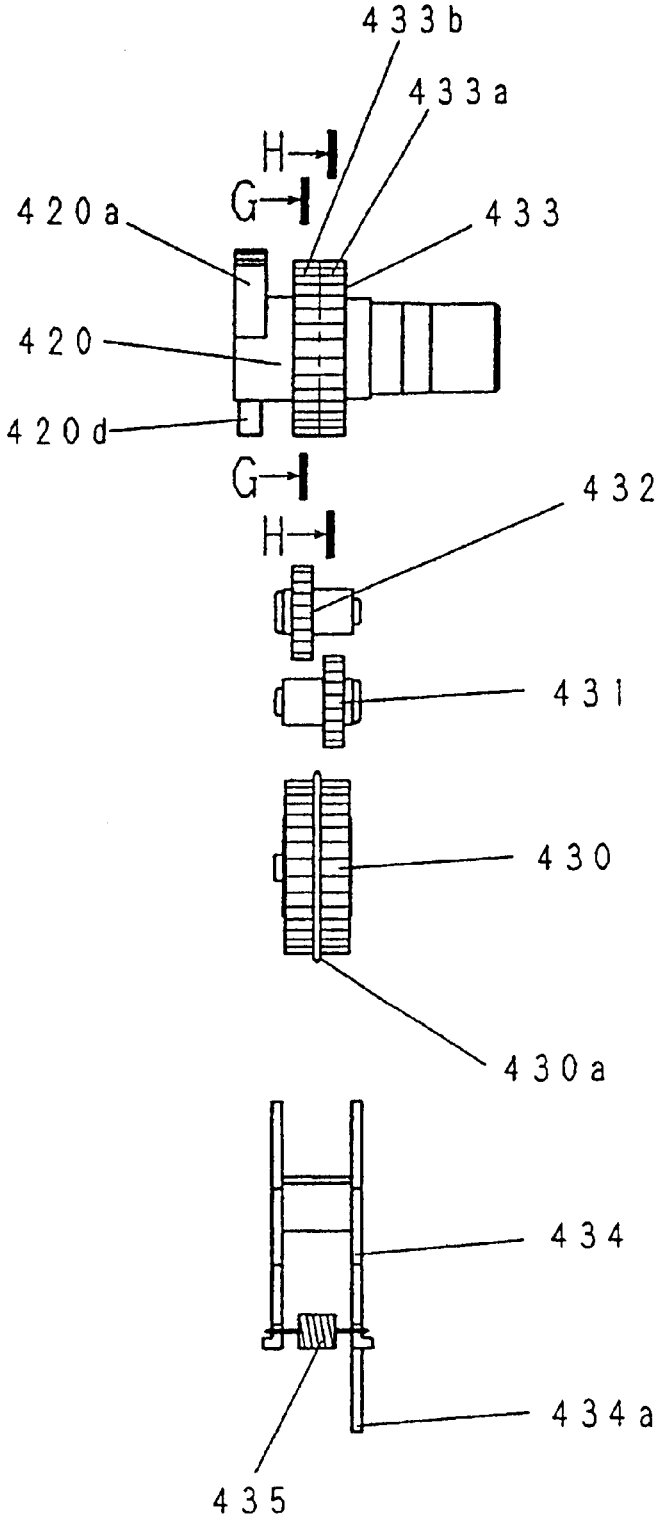
FIG. 44 is a phase relation diagram showing a cam planet holder, a cam sun gear, a cam planet gear, and a cam gear.

FIG. 44 shows a phase relation in the rotary shaft line direction among the cam planet holder 434, the cam sun gear 430, the cam planet gear A431, the cam planet gear B432, and the cam gear 433. Numeral 430*a* is a flange portion located at a center of a tooth width of the cam sun gear 430. The cam gear 433 is formed unitedly with the cam A420. The cam planet gear A431 can be coupled to a cam gear A433*a* on a right half side in the width direction of the cam gear 433, and the cam planet gear B432 can be coupled to a cam gear B433*b* on a left half side in the width direction of the cam gear 433. The cam gear A433*a* has a toothless portion A433*c* shown in FIG. 42(*b*), and an H—H line cross section in FIG. 44 is shown in FIG. 42(*b*). The cam gear B433*b* has a toothless portion B433*d* shown in FIG. 43(*b*), and a G—G line cross section in FIG. 44 is shown in FIG. 43(*b*).

Referring to FIG. 42 and FIG. 43, with a premise according to the description above, swinging operation of the U-turn roller holder A416, or namely, projection and escape of the U-urn roller 112*d* is described. FIG. 42 shows a projection state of the U-turn roller 112*d*; FIG. 43 shows an escaping state of the U-turn roller 112*d*.

The projecting operation of the U-turn roller 112*d* is operation from the state shown in FIG. 43 to the state shown in FIG. 42. Where the pinion gear 415 makes the CW rotation while in the escaping state shown in FIG. 43, the drive system is sequentially driven to rotate in the arrow direction as shown in FIG. 42. In FIG. 42, the cam planet gear A431 drives the cam gear A433*a*, and the cam 420 makes the CCW rotation to render the cam surface 420*a* operate to the down cam follower portion 423, thereby driving the U-turn roller holder A416 to perform the CCW rotation around the rotary shaft 418 as a center. The U-turn roller 112*d* is pressed to the U-turn pinch roller 113. In FIG. 42, the cam planet gear A431 drives the cam gear A433*a* up to the toothless portion A433*c*, and even where the pinion gear 415 continues to perform the CW rotation, the cam A420 cannot be driven to rotate. FIG. 42 shows a state that the U-turn roller holder A416 takes a stable position. An over cam A420*b* is a reverse tapered portion of the cam surface 420*a*, and operates to slightly over-rotate the cam A420 in use of the opposite force from the U-turn pinch roller 113. After the cam planet gear A431 drives the cam gear A433*a* up to reaching the toothless portion A433*c*, the cam A420*b* has an advantage to prevent a last tooth A433*e* of the cam gear A433*a* from beaten by tooth or teeth of the cam planet gear A431.

It is to be noted that numeral 434*a* is a planet stopper as a part of the cam planet holder 434, and the maximum rotation amount of the cam planet holder 434 is limited by contacting the stopper to a stopper rib 436 formed at the frame A401.

That is, in FIG. 42, by contacting the planet stopper 434*a* with the stopper rib A436*a*, the apparatus can prevent the cam planet gear A431 from overly entering in the toothless portion A433*c* of the cam gear A433*a*, and in FIG. 43, by contacting the planet stopper 434*a* with the stopper rib B436*b*, the apparatus can prevent the cam planet gear B432 from overly entering in the toothless portion A433*d* of the cam gear B433*b*.

The escaping operation of the U-turn roller 112*d* is operation from the state shown in FIG. 42 to the state shown in FIG. 43. Where the pinion gear 415 makes the CW rotation while in the projecting state shown in FIG. 42, the drive system is sequentially driven to rotate in the arrow direction as shown in FIG. 43. In FIG. 43, the cam planet gear B432 drives the cam gear B433*b*, and the cam A420 makes the CW rotation to render the cam surface 420*a* operate to the up cam follower portion 422, thereby driving the U-turn roller holder A416 to perform the CCW rotation around the rotary shaft 418 as a center. The U-turn roller 112*d* is moved away from the U-turn pinch roller 113. In FIG. 43, the cam planet gear B432 drives the cam gear B433*b* up to the toothless portion B433*d*, and even where the pinion gear 415 continues to perform the CCW rotation, the cam A420 cannot be driven to rotate. FIG. 43 shows a state that the U-turn roller holder A416 takes a stable position. An over cam B420*c* is a reverse tapered portion of the cam surface 420*a*, and operates to slightly over-rotate the cam A420 in use of the opposite force made from weights of the U-turn roller 112*d* and the U-turn roller shaft 414. After the cam planet gear B432 drives the cam gear B433*b* up to reaching the toothless portion B433*d*, the cam B420*c* has an advantage to prevent a last tooth B433*f* of the cam gear B433*b* from beaten by tooth or teeth of the cam planet gear B432.

It is to be noted that numeral 420*d* is a cam stopper formed unitedly with the cam A420. When the U-turn roller operates to escape, the cam A420 and the U-turn roller holder A416 may over-rotate because drive opposing force is weak from exertion of only weights of the U-turn roller 112*d* and the U-turn roller shaft 414. At that time, the cam stopper 420*d* and the down cam follower portion 423 interfere with each other, thereby preventing each from over-rotating.

As described above, the drive system for projection and escape of the U-turn roller 112*s* is structured of rotational operations, which obtains high reliability in operation of the mechanical system.

Figure 45:
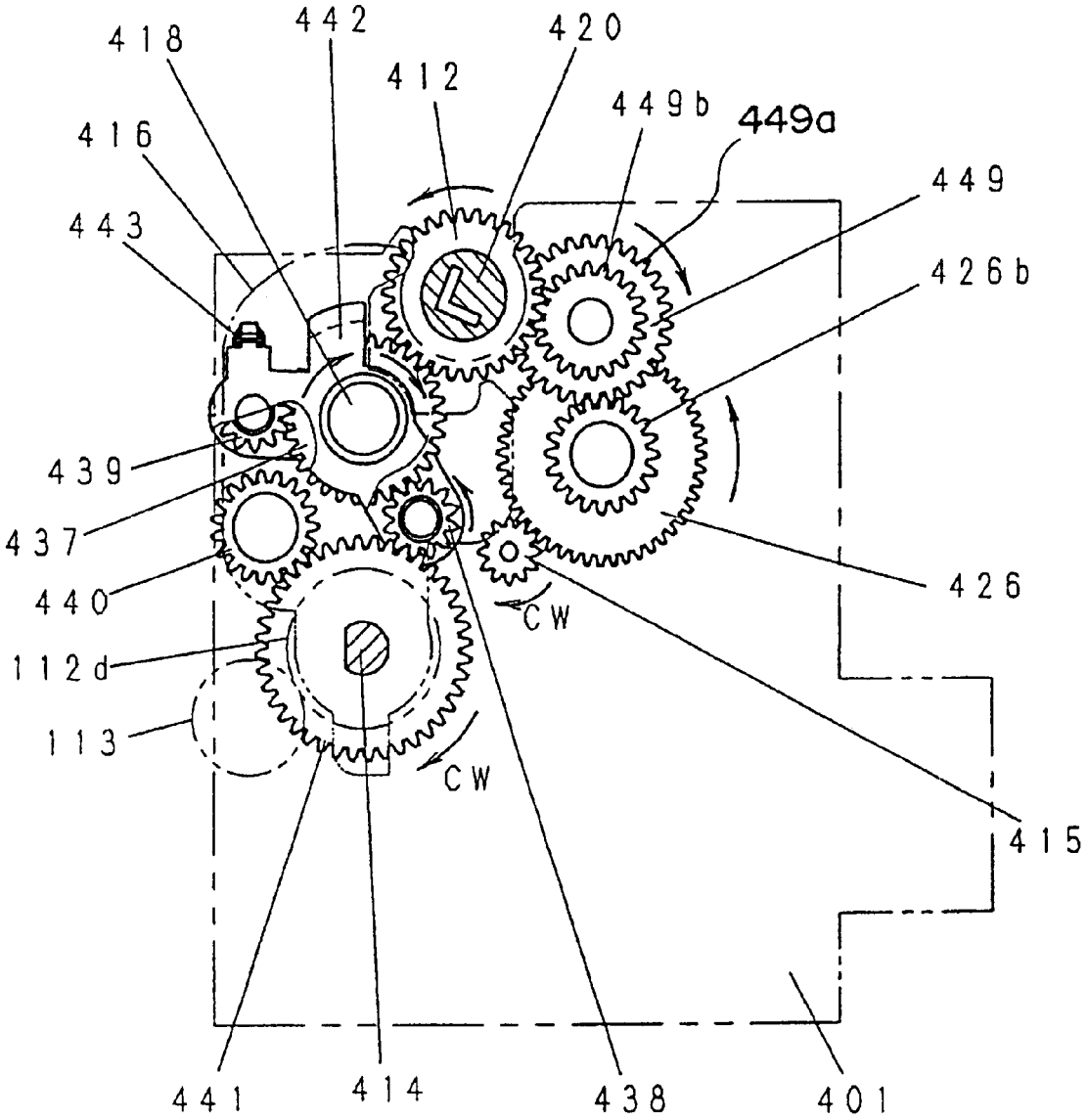
FIG. 45 is a diagram of the U-turn roller drive system (pinion gear CW rotation)
Figure 46:
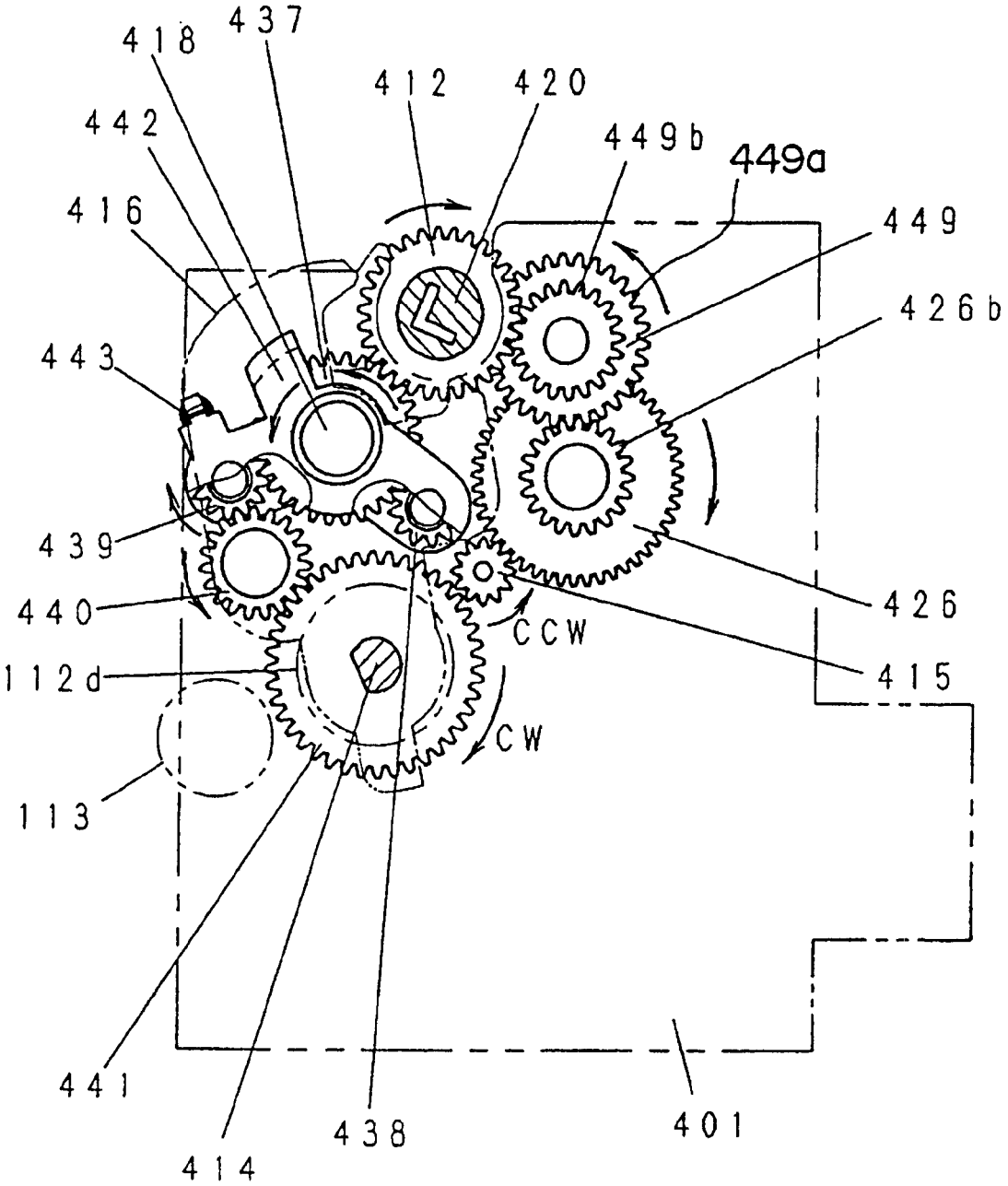
FIG. 46 is a diagram of the U-turn roller drive system (pinion gear CC rotation)

Next, the gear train for rotating drive of the U-turn roller 112*d*, serving as an intermediate conveyance roller feeding mechanism, is described. FIG. 45 and FIG. 46 show the drive system of the U-turn roller 112*d*.

In both drawings, the rotation of the pinion gear 415 of the drive source is transmitted to the U-turn speed reduction gear 449 rotatably supported to the frame A401 through the motor speed reduction gear 426. The U-turn speed reduction gear 449 is made unitedly of an input gear 449*a* and an output gear 449*b*. The rotation of the U-turn speed reduction gear 449 is transmitted to a U-turn sun gear 437 through a U-turn idler gear A412 having the cam A420 as the rotary shaft. The U-turn sun gear 437 is rotatably supported to the frame A401 with the rotary shaft 418 commonly used for the U-turn roller holder A416. The rotation of the U-turn sun gear 437 is transmitted to a U-turn planet gear A438 and a U-turn planet gear B439, as a pair of the swinging gears. The U-urn planet holder 442 is rotatably supported to the rotary shaft 418 as a rotation center which commonly used for the U-turn sun gear 437, thereby sandwiching the U-turn planet gear A438 and the U-turn planet gear B439 as to be rotatable. Numeral 443 is a U-turn planet holder spring for providing a sandwiching load to the U-turn planet gear B439 and render the U-turn planet holder 442 rotate as the U-turn sun gear 437 rotates. The U-turn idler gear B440 is supported rotatably to the U-turn roller holder A416. The U-turn roller gear 441 is supported rotatably to the U-turn roller holder A416. The U-turn roller shaft 414 is supported to the U-turn roller gear 441 so as to rotate together with the U-turn roller gear 441.

The U-turn roller 112*d*, as described below, can make always the CW rotation, namely rotate in the feeding direction, even where the pinion gear 415 makes the CW rotation or the CCW rotation. Moreover, the roller 112*d* does not require any special clutch or the like and is structured only of a pair of the swinging gears but obtains high reliability.

FIG. 45 shows a drive state where the pinion gear 415 makes the CW rotation. At that time, the U-turn planet gear 437 and the U-turn planet holder 442 make the CW rotation, and the U-turn planet gear A438 engages with the U-turn roller gear 441 to make the U-turn roller 112*d* perform the CW rotation.

FIG. 46 shows a drive state where the pinion gear 415 makes the CCW rotation. At that time, the U-turn planet gear 437 and the U-turn planet holder 442 make the CCW rotation, and the U-turn planet gear B439 engages with the U-turn idler gear B440 to make the U-turn roller 112*d* perform the CW rotation.

The structure and operation principle of the ASF clutch 429, serving as a one-way clutch, and the locking mechanism to the ASF clutch 429 are described next. First, the ASF clutch 429 is described, and with this, the clutch locking mechanism is described subsequently.

Figure 41:
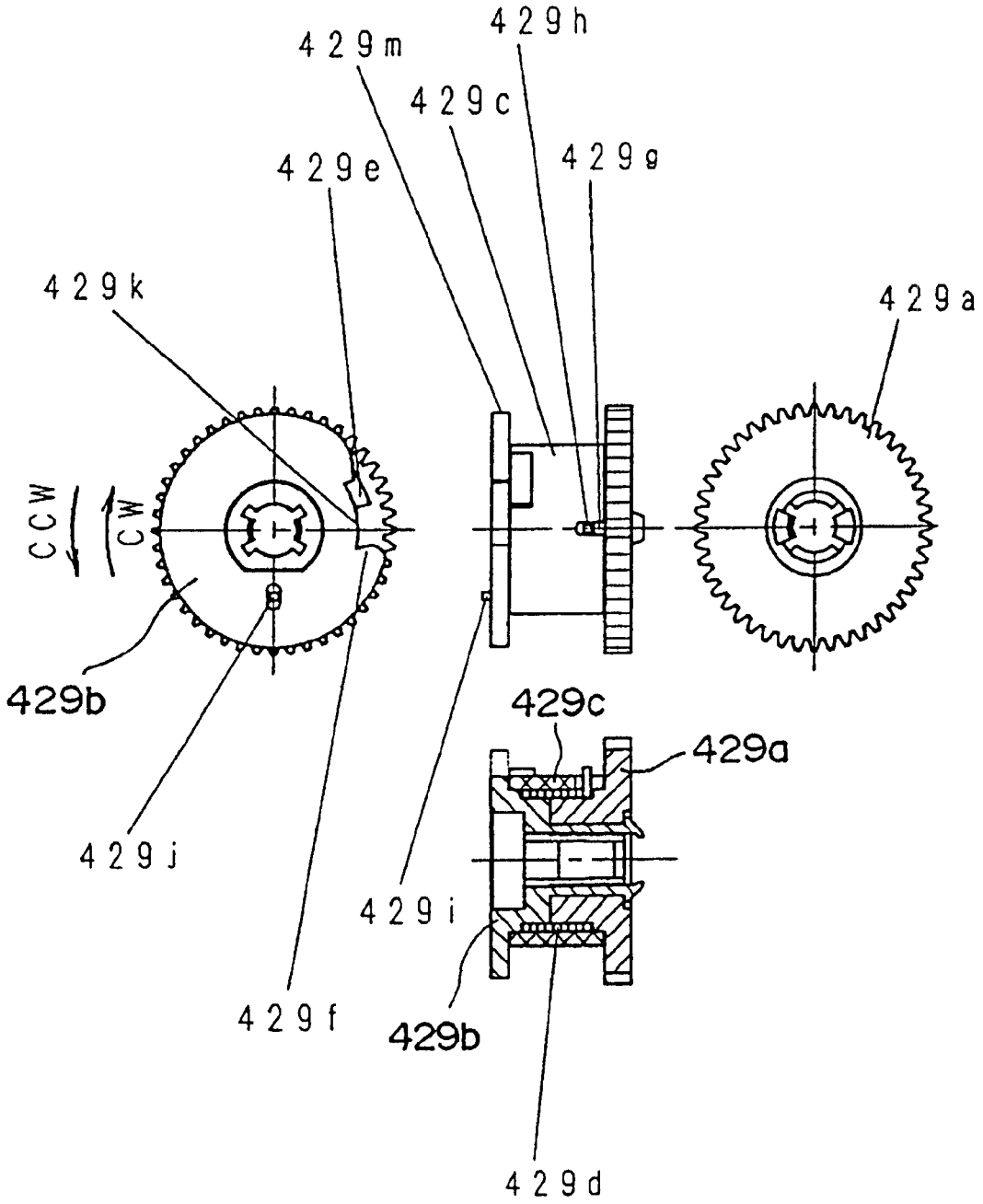
FIG. 41 is a structural diagram of an ASF clutch.

The structure of the ASF clutch 429 is shown in FIG. 41. Numeral 429*a* is an input gear; numeral 429*b* is an output shaft. A clutch spring 429*d* is wound around the input gear 429*a* and the output shaft 429*b*. Numeral 429*c* is a releasing collar and is attached rotatably to an outer side of the clutch spring 429*d*. In the clutch spring 429*d*, one end 429*h* on a side winding around the input gear 429*a* is engaged with a cutout groove 429*g* of the releasing collar 429*c*, and the other end 429I on a side winding around the output shaft 429*b* is engaged with a hole 429*j* of an output shaft 429*b*. Where the CW rotation is inputted to the input gear 429*a*, the clutch spring tends to be tightened, and to the contrary, where the CCW rotation is inputted to the input gear 429*a*, the clutch spring 429*d* is wound as to tend to be loosened. That is, where the input gear 429*a* receives the CW rotation torque input, the clutch spring 429*d* tends to be tightened, thereby being capable of transmitting adequate torque to the output shaft 429*b*.

On the other hand, the input gear 429*a* can be idled without transmitting any torque to the output shaft 429*b* even where the input gear 429*a* receives torque input of the CW rotation or the CCW rotation. If there is an input of the CW rotation, winding loosing occurs at one end 429*h* of the clutch spring 429*d* to idle only the input gear 429*a* where a rotation inhibition load is given to an engagement portion 429*e* of the releasing collar 429*c*. If there is an input of the CCW rotation, winding loosing occurs at the other end 429*i* of the clutch spring 429*d* to idle only the input gear 429*a* in the counterclockwise direction where a rotation inhibition load is given to a flange engagement portion 429*f* of the output shaft 429*b*. It is to be noted that the output shaft 429*b* is attached to the feeding shaft 405 as to rotate unitedly with the feeding shaft 405.

A clutch locking mechanism capable of giving a rotation inhibition load and releasing the rotation inhibition load of the ASF clutch 429 is described in reference to FIG. 47 through FIG. 54. In FIG. 47 to FIG. 50, the rotational phase of the feeding shaft 405 is written together.

Figure 47:
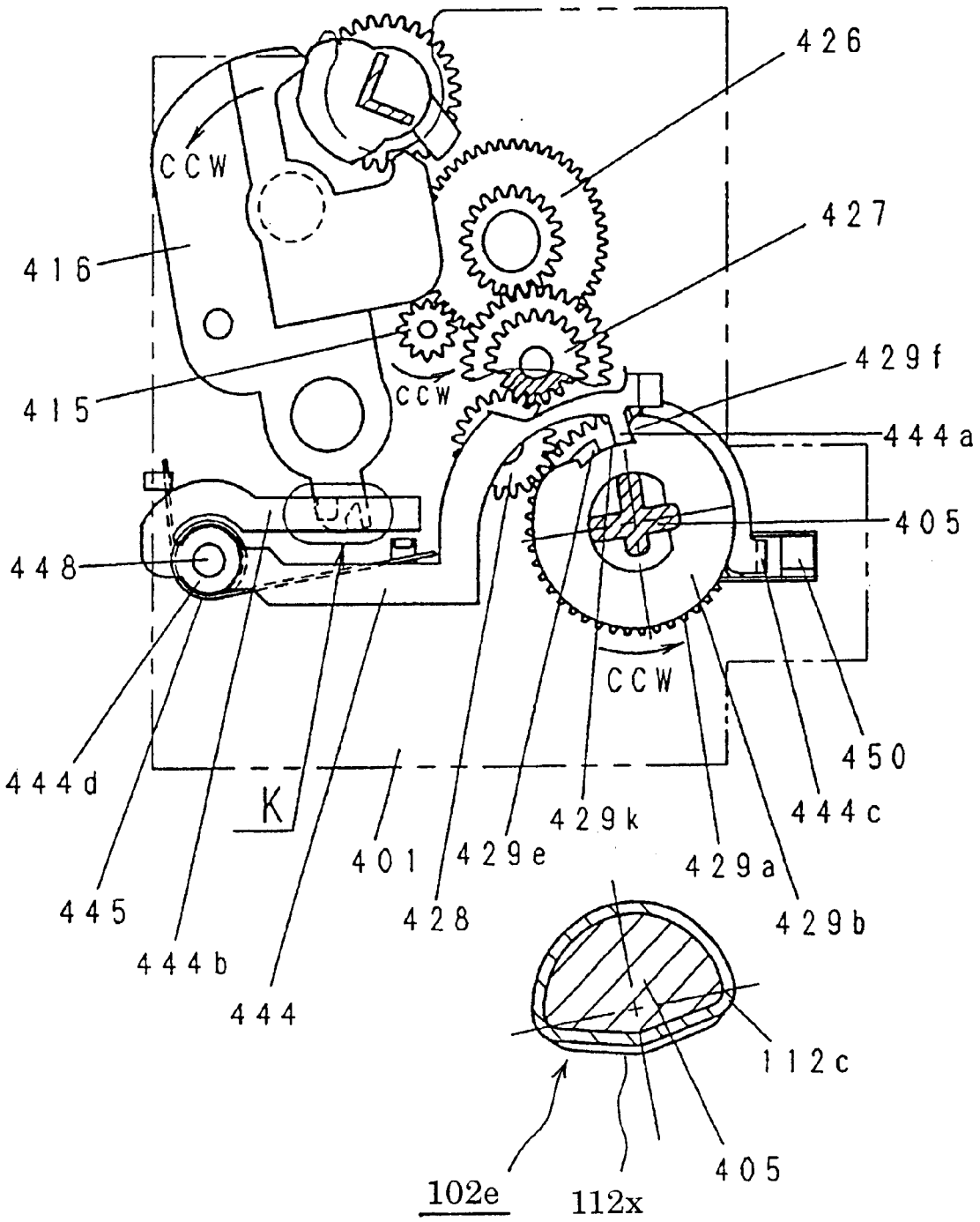
FIG. 47 is a diagram of a locking mechanism of the ASF clutch (CCW rotation, locking state)

FIG. 47 shows a waiting state before a sheet is picked up. As for the previous operation, a pinion gear ends with the CCW rotation. Numeral 444 is an ASF lock as a clutch engaging means. The ASF lock 444 is supported rotatably to a lock nail shaft 448 of the frame A401. Numeral 444*a* is a lock nail formed unitedly with the ASF lock 444, and in the waiting state shown in FIG. 47, the lock nail 444*a* is in contact with the flange engagement portion 429*f* of the ASF clutch 429. Numeral 44*b* is a lock elasticity portion formed unitedly with the ASF lock 444 and has a spring property in a direction perpendicular to the drawing surface. The lock spring 445 is a twisted coil spring wound around a rotary shaft 444*d* of the ASF lock 444, one end of which is engaged with the frame A401 and the other end of which is engaged with the ASF lock 444. The ASF lock 444 is urged in the clockwise direction by operation of the lock spring 445, or namely, the lock nail 444*a* is urged to a cutout portion 429*k* of the output shaft 439*b* of the ASF clutch 429.

Figure 51:
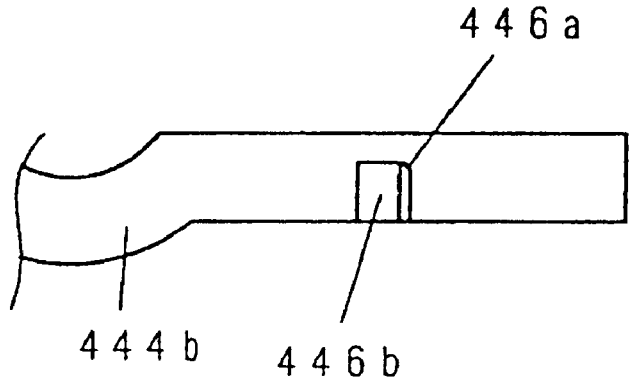
FIG. 51 is an enlarged view of a locking elastic portion of the ASF clutch.
Figure 51:
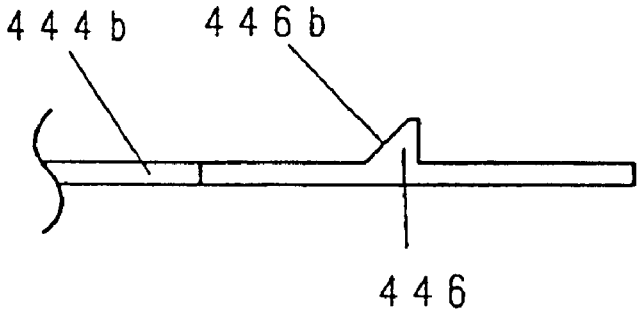
Figure 51:
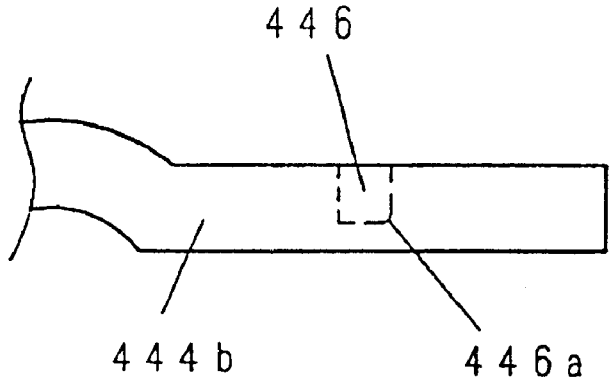
Figure 52:
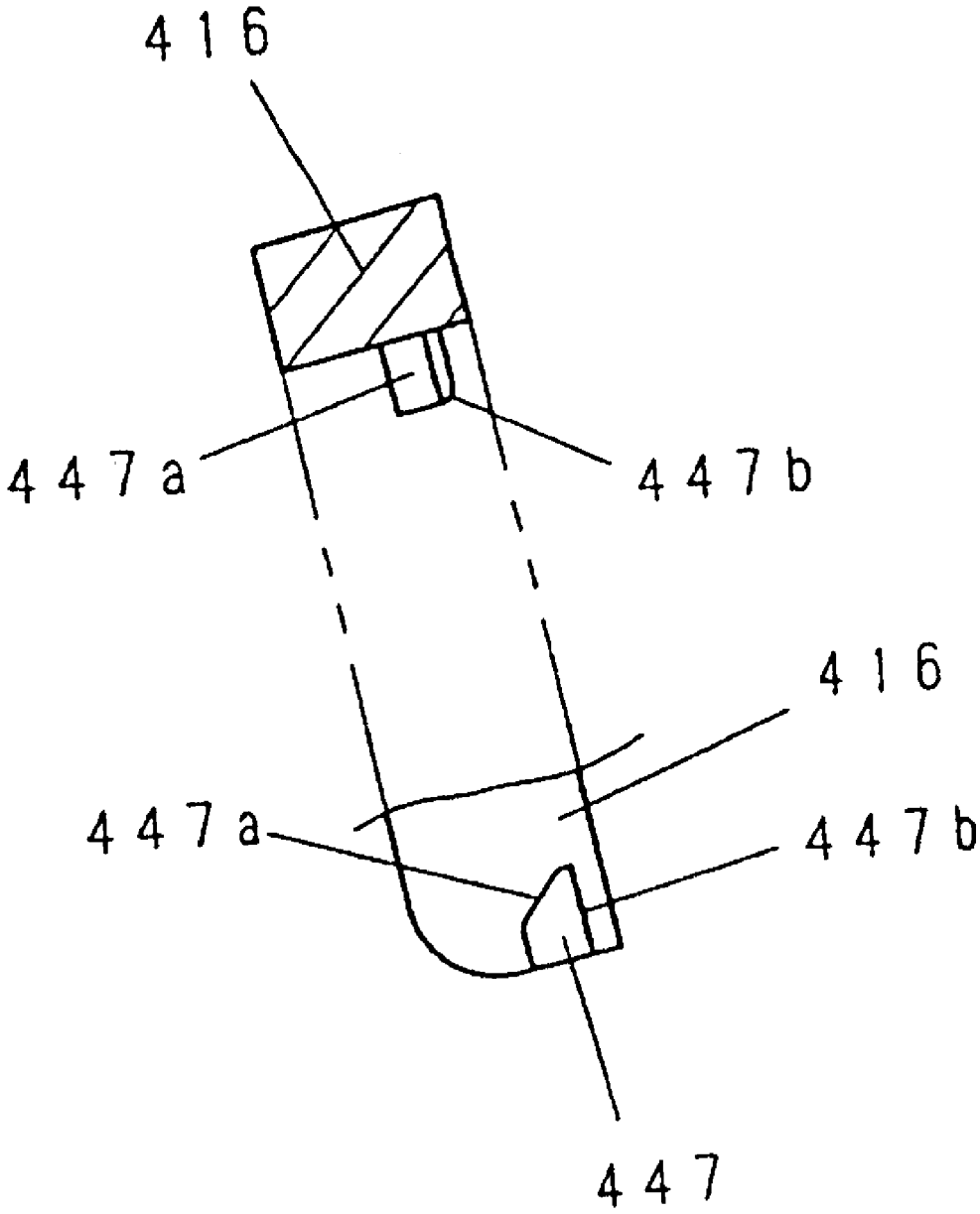
FIG. 52 is an enlarged view showing a drive projecting portion of a U-turn roller holder A.

FIG. 51 and FIG. 52 show enlarged views of a K portion in FIG. 47. It is to be noted that the K portion in FIG. 47 represents an unlocking portion in the clutch locking mechanism, or namely, a portion for disengaging the ASF lock 444. FIG. 51 shows the lock elasticity portion 444*b* of the ASF lock 444; FIG. 52 shows a drive projection 447 of the U-turn roller holder A416. In FIG. 51, numeral 446 is a driven projection formed unitedly with the lock elasticity portion 444*b* and has a driven edge 446*a* and a driven slope 446*b*. In FIG. 52, numeral 447 is a drive projection formed unitedly with the U-turn roller holder A416 and has a drive slope 447*a* and a drive edge 447*b*.

Figure 48:
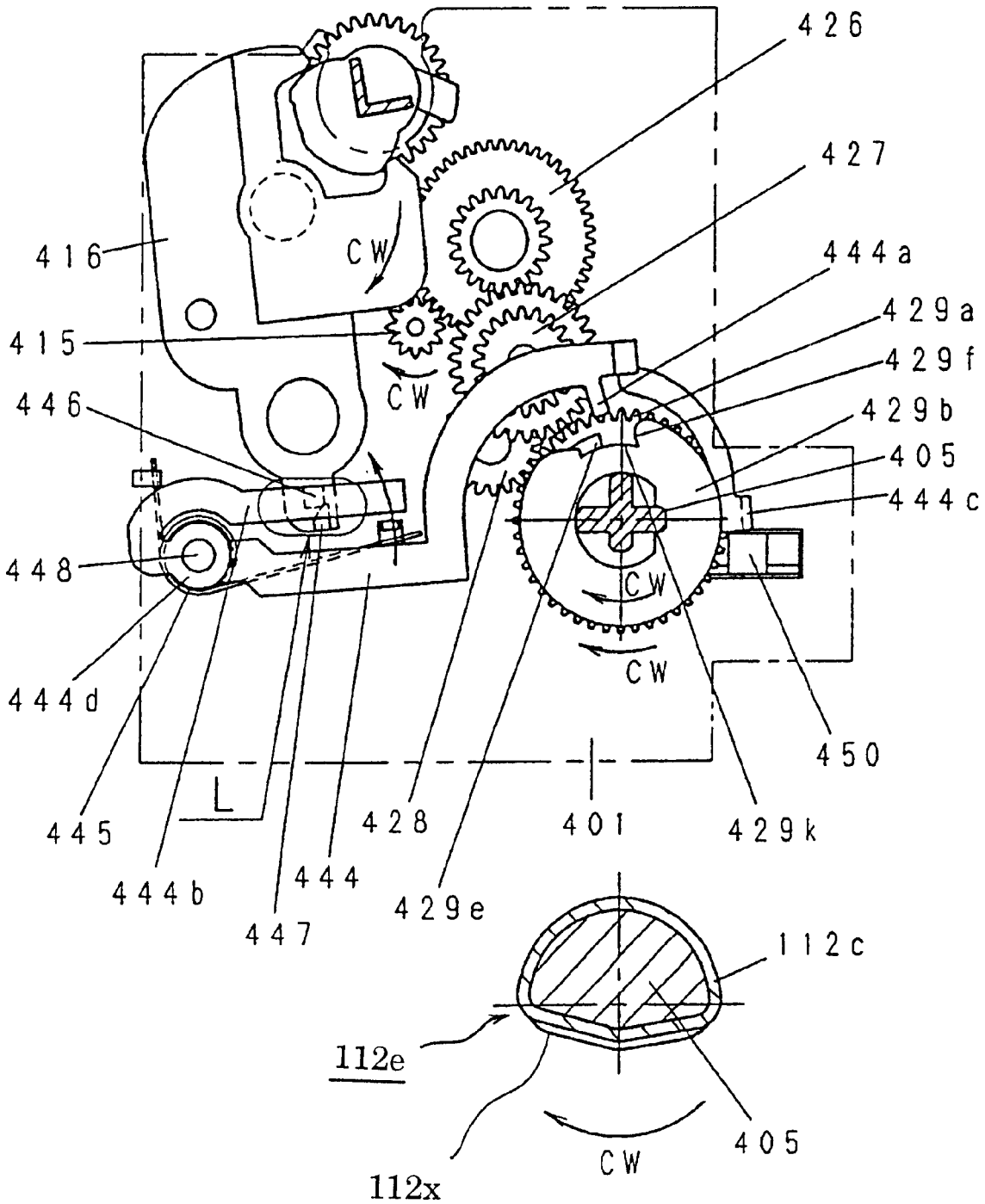
FIG. 48 is a diagram of the locking mechanism of the ASF clutch (unlocking operation)

As described above, where the pinion gear 415 begins the CW rotation, the U-turn roller holder A416 starts the CW rotation, and the input gear 429*a* begins the CW rotation. This state is shown in FIG. 48.

Figure 49:
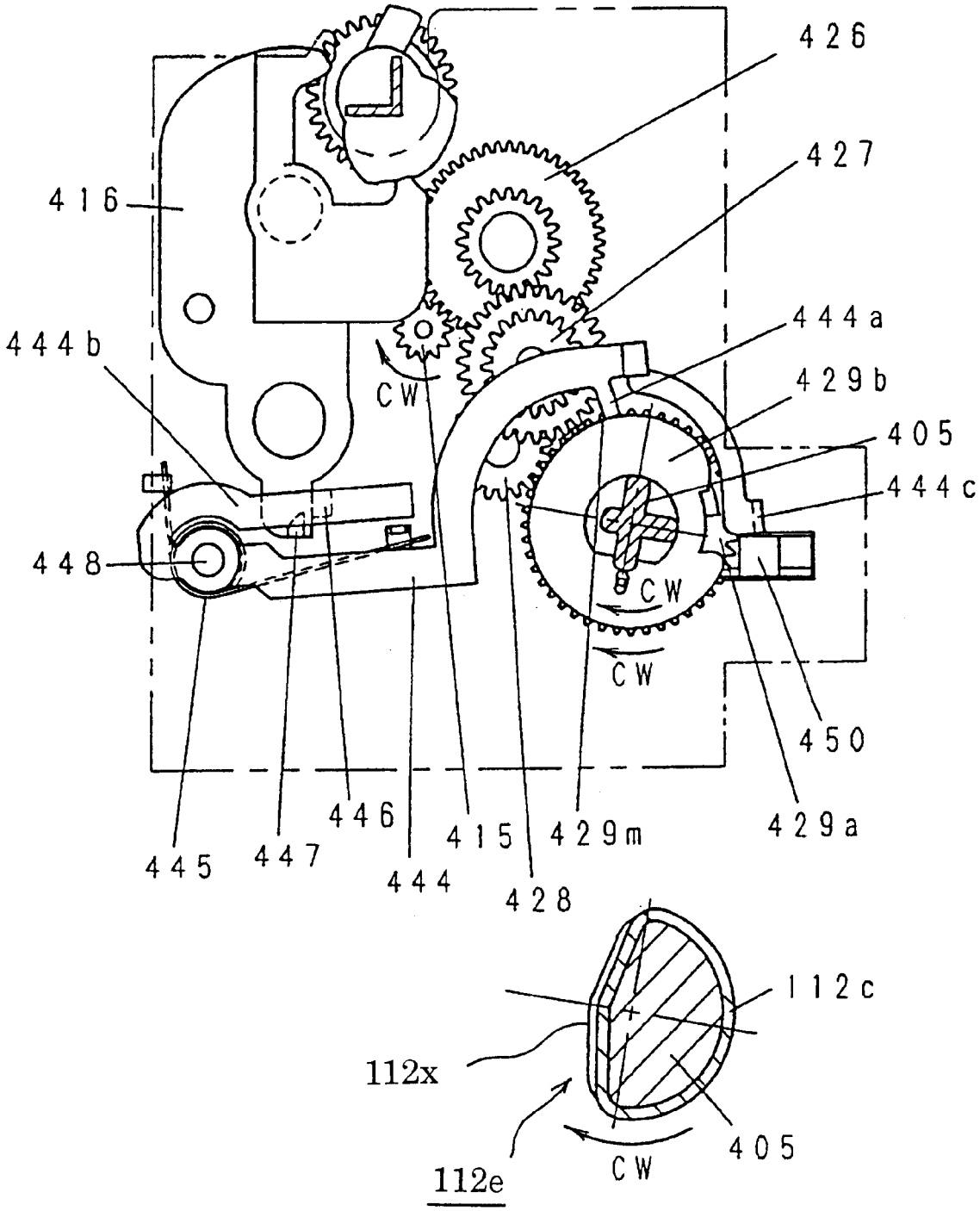
FIG. 49 is a diagram of the locking mechanism of the ASF clutch (clutch output shaft, CW rotation state)
Figure 50:
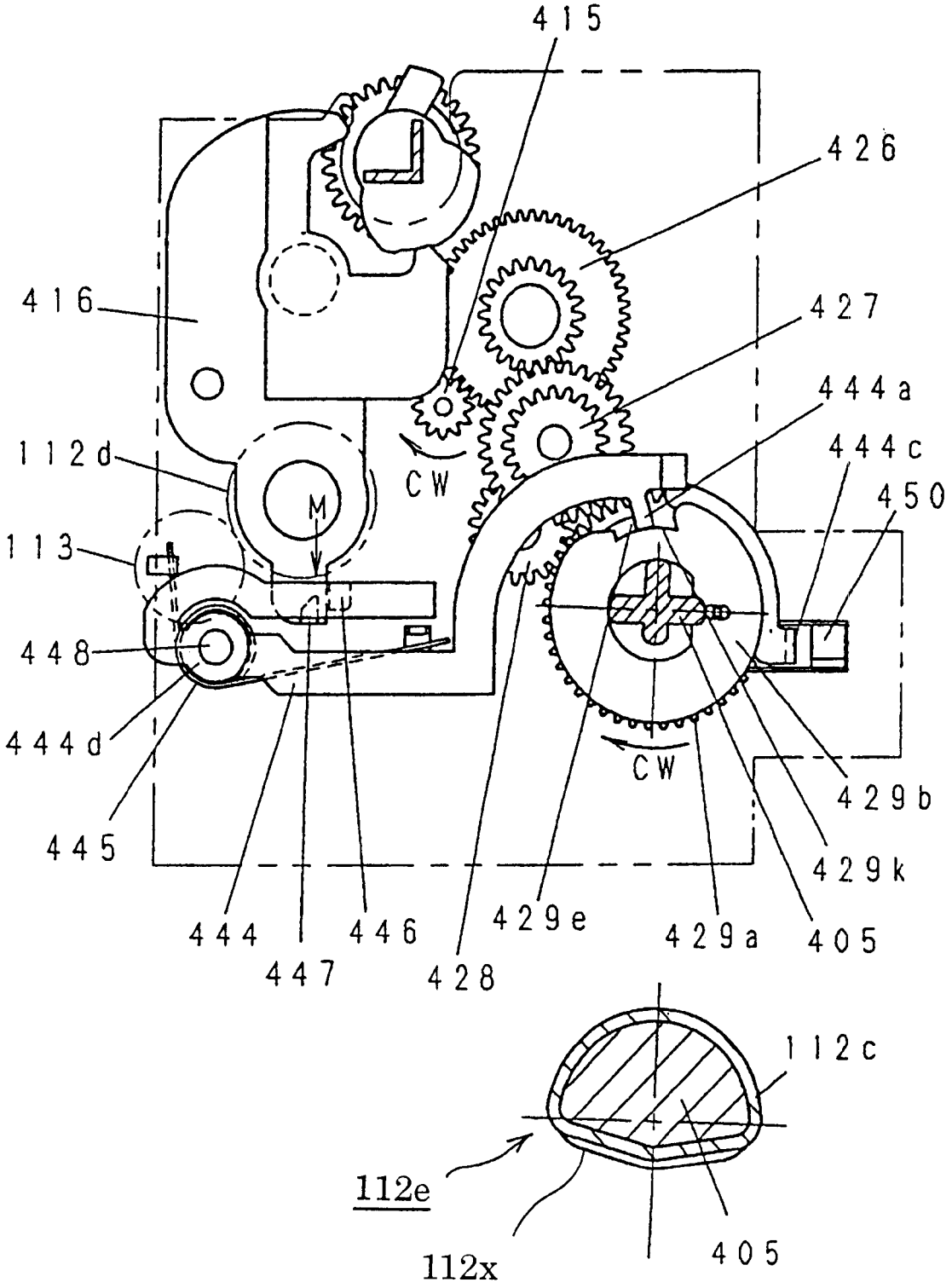
FIG. 50 is a diagram of the locking mechanism of the ASF clutch (CW rotation locking state)
Figure 53:
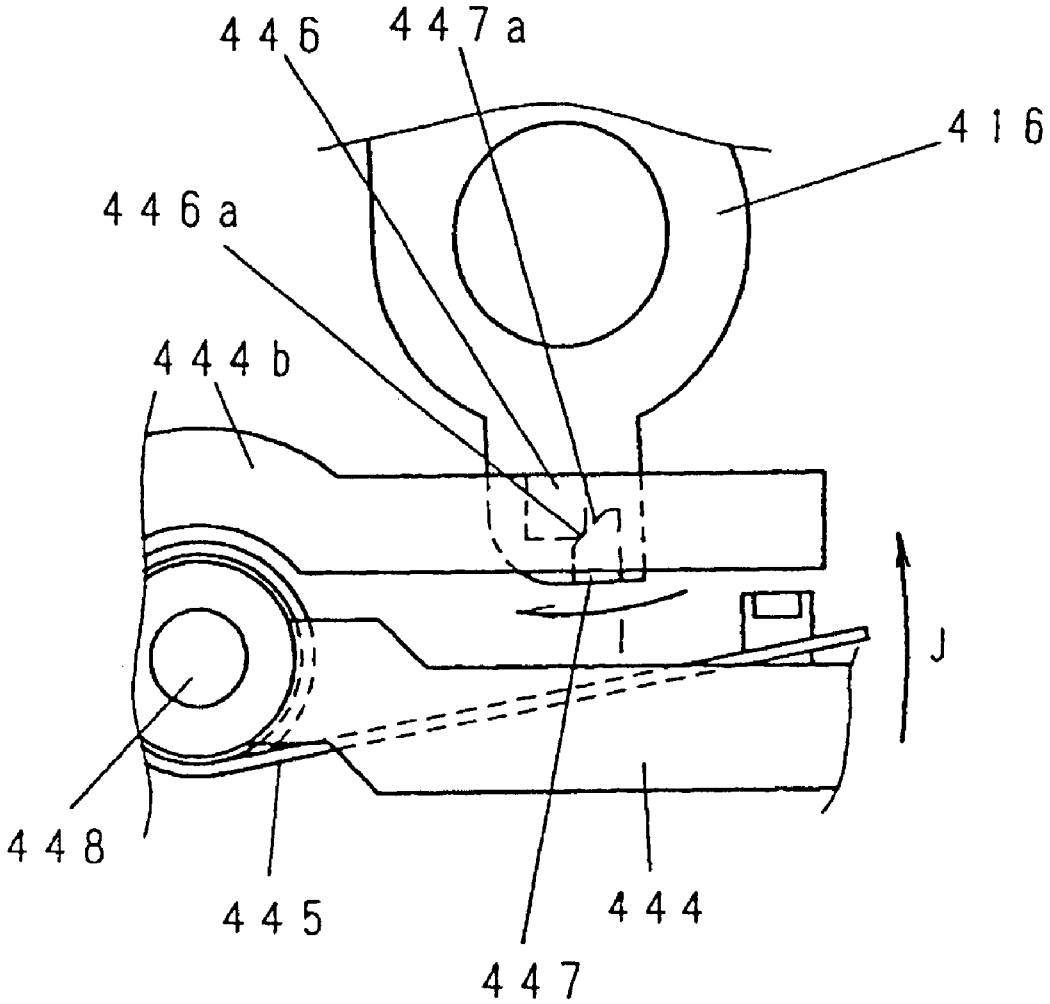
FIG. 53 is an enlarged view showing the unlocking portion (unlocking operation)

From interference between the drive projection 446 of the U-turn roller holder 416 and the driven projection 447 of the ASF lock 444, the ASF lock 444 is driven in the counterclockwise direction in opposing to the urging force of the lock spring 445. That is, the lock nail 444*a* passes through toward an upper portion of the cutout portion 429*k*. Consequently, the output shaft 429*b* of the ASF clutch 429 is in a state for rendering the CW rotation. This situation is described in reference to FIG. 53. FIG. 53 is an enlarged view of an L portion in FIG. 48. Where the U-turn roller holder A416 rotates in the direction of an arrow I, the drive slope 447*a* of the drive projection 447 pushes up the driven edge 446*a* of the driven projection 446, thereby driving the ASF lock 444 in the direction of the arrow I.

Where the pinion gear 415 further continues to make the CW rotation, the state becomes as shown in FIG. 49. In this state, the feeding shaft 405 continues the CW rotation drive, and the pair of the separation roller rubbers 112*c* pickup the sheet on the cassette. The U-turn roller holder A416 and the ASF lock 444 are in respective stable positions and non-operative. Because a lift-up process of the drive projection 446 is completed by the drive projection 447, the ASF lock 444 is rotatable in the clockwise direction by urging force of the lock spring 445, and takes a stable position where the lock nail 444*a* contacts with a flange outer periphery 429*m* of the output shaft 429*b*.

Where the pinion gear 415 further continues to make the CW rotation, the state becomes as shown in FIG. 50. The input gear 429*a* of the ASF clutch 429 continues the CW rotation, but the feeding shaft 405 completes the one turn process and does not rotate any more. The cutout portion 429*k* faces down and enters in a state that facing to the sheet conveyance route to ensure the clearance between the separation roller rubbers 112*c* and the sheet. Therefore, the separation roller rubber 112*c* does not give any load to the sheet. The reason that the feeding shaft 405 does not rotate, or namely the output shaft 429*b* does not rotate, is that the lock nail 444*a* is engaged with the engagement portion 429*e* of the releasing collar 429*c*, which is as described in the description of the ASF clutch 429. With this state, as described in FIG. 45, the U-turn roller 112*d* only conveys the sheet. The state shown in FIG. 50 continues until the prescribed sheet conveyance operation ends.

The pinion gear 415 makes the CCW rotation at the final state of the feeding operation to do escaping movement, and the apparatus enters in the state shown in FIG. 47 again. Where the pinion gear 415 makes the CCW rotation from the state shown in FIG. 50, the input gear 429 of the ASF clutch 429 makes the CCW rotation as shown in FIG. 47, and the U-turn roller holder A416 makes the CCW rotation. At that time, the drive projection 447 and the driven projection 446 interfere with each other, but the lock elasticity portion 444*b* absorbs the interference load by elastic deformation, so that the ASF lock does not rotate, and so that the lock nail 444*a* is urged to the cutout portion 429*k* as it is.

Figure 54A:
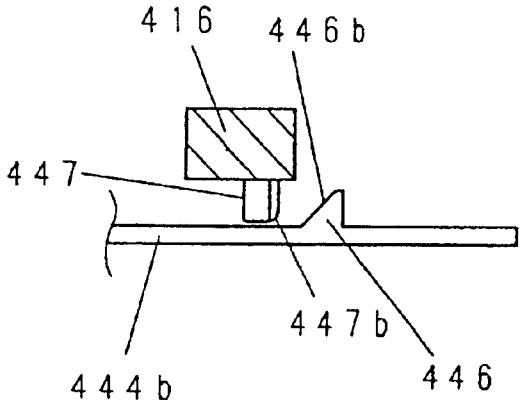
FIGS. 54(*a*)–54(*c*) is an enlarged view showing the unlocking portion (locking elastic portion kicking operation)
Figure 54B:
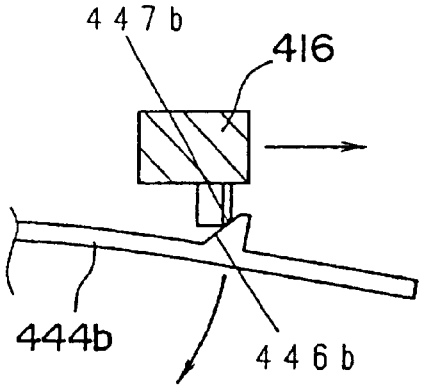
Figure 54C:
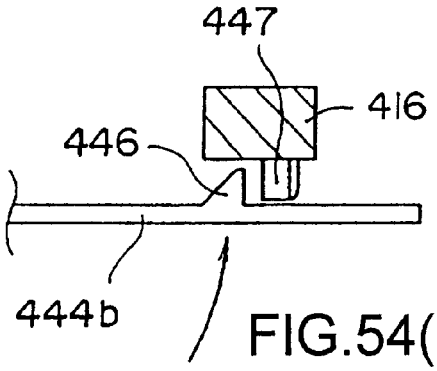

FIG. 54 shows an illustration when seen in a direction of an arrow M in FIG. 50. During the escaping operation, the apparatus enters in the state shown in FIG. 54(*c*) from the state shown in FIG. 54(*a*) through FIG. 54(*b*). Where the U-turn roller holder A416 renders the escaping operation from the state shown in FIG. 54(*a*), the drive edge 447*b* operates to the driven slope 446*b* as shown in FIG. 54(*b*), and the lock elasticity portion 444*b* escapes in deforming elastically. Where the U-turn roller holder A416 further makes the escaping operation and exceeds the interference region, the lock elasticity portion 444*b* returns to the original state as shown in FIG. 54(*c*) and enters in the state shown in FIG. 47. Meanwhile, the input gear 429*a* of the ASF clutch 429 continues the CCW rotation even in those operations. However, at that time, as shown in FIG. 47, the flange engagement portion 429*f* hits the lock nail 444*a*, so that the output shaft 429*b* does not make the CCW rotation by the clutch mechanism as described above. That is, the feeding shaft 405 does not rotate, and maintains the waiting state. When prescribed operations are completed, the ASF motor stops driving to finish the escaping operation.

It is to be noted that in FIG. 47 to FIG. 50, numeral 444*c* is a lock sensor plate formed unitedly with the ASF lock 444 and moves up and down according to rotation of the ASF lock 444. In FIG. 32 and FIG. 34, a positional relation of the lock sensor plate 444*c* and an ASF sensor 450 is shown. The ASF sensor 450 is a transmission type photo sensor. In the waiting state shown in FIG. 34 and FIG. 47, the lock sensor plate 444*c* cuts off the beam between the light emitting portion and the light receiving portion of the ASF sensor 450, and it is recognized as the controlling logic that the ASF clutch 429 sensor 450 is turned on. Where the lock nail 444*a* is located upward to render the output shaft 429*b* at the unlocking state as in the sheet pickup state in FIG. 49, the plate does not cut off the beam between the light emitting portion and the light receiving portion of the ASF sensor 450, and it is recognized as the controlling logic that the ASF clutch 429 sensor 450 is turned off.

The description above is for the respective mechanical elements. The outlined feeding operation is described before the description of the mechanical elements, but hereinafter, with the above description of the structural elements, the main feeding operation is described in which the structural elements operates together.

FIG. 34 shows the waiting state as an initial state and corresponds to FIG. 36 for description of outlined operations. When a feeding instruction is executed, the ASF motor 406 first starts rotating normally, or namely the pinion gear 415 begins the CW rotation. The U-turn roller holder A416 is released to a position shown in FIG. 42 by the cam A420, and during this operation, as shown in FIG. 48, the ASF lock 444 is driven upward by the drive projection 447, thereby unlocking the lock nail 444*a*. The feeding shaft 405 rotating unitedly with the output shaft 429*b* of the unlocked ASF clutch 429 rotates normally in the sheet pickup direction as shown in FIG. 49, so that the sheet in the feeding cassette is picked up.

In a meantime, the U-turn roller 112*d* is pushed to the U-turn pinch roller 113 as shown in FIG. 42, and the U-turn roller gear 441 at the same time rotates normally in the feeding direction as shown in FIG. 45. The ASF motor 406 rotates normally, and the U-turn roller 112*d* continues rotating normally in keeping a position contacting to the U-turn pinch roller 113. The feeding shaft 405 continues normal rotation, and the sheet picked up by the separation roller rubbers 112*c* reaches the nip portion between the U-turn roller 112*d* and the U-turn pinch roller 113. From this for a while, sheet conveyance is made by the separation roller rubbers 112*c* and the U-turn roller 112*d* which have the same feeding speed, and it is a state shown in FIG. 37 for the outlined operation description.

The ASF motor 406 further normally rotates, and the U-turn roller 112*d* continues sheet conveyance. The feeding shaft 405 also continues normal rotation, but when the shaft 405 is turned one time, the lock nail 444*a* falls in the cutout portion 429*k* formed at the output shaft 429*b* of the ASF clutch 429, thereby engaging the engagement portion 429*e* of the releasing collar 429*c* with the lock nail 444*a*. Then, even where the input gear 429*a* of the ASF clutch 429 rotates normally, the output shaft does not rotate. The rotational angle phase of the feeding shaft 405 is constant, and a space is ensured between the separation roller rubbers 112*c* and the sheet on the feeding cassette. It is a state shown in FIG. 38 for the outlined operation description.

The ASF motor 406 further continues the normal rotation, and the U-turn roller 112*d* continues to convey the sheets. The ASF motor 406 rotates normally until the end of prescribed sheet conveyance with respect to the sheet conveyance to the printer unit 600 accompanied with temporary stops. When the prescribed sheet conveyance ends, the ASF motor 406 temporarily stops rotating.

Then, the ASF motor 406 begins rotating reversely to render the pinion gear 415 begins the CCW rotation. The U-turn roller holder A416 is made to escape to a position shown in FIG. 43 by the cam A420, and during the movement, the drive projection 447 knocks down the driven projection 446 as shown in FIG. 54 to make the ASF lock 444 inactive. At that time, the U-turn roller 112*d* while rotating normally in the feeding direction as shown in FIG. 46 moves away from the U-turn pinch roller 113, and no back tension from the drive system occurs at the sheet. Concurrently, the input gear 429*a* of the ASF clutch 429 makes the CCW rotation and rotates reversely the output shaft 429*b* in the reverse feeding direction. As shown in FIG. 47, since the flange engagement portion 429*f* engages with the lock nail 444*a* at that time, the output shaft 429*b* does not rotate reversely, and only the input gear 429*a* continues the CCW rotation. The rotational angle phase of the feeding shaft 405 is constant, and a space is ensured between the separation roller rubbers 112*c* and the sheet on the feeding cassette.

The ASF motor 406 stops after reverse rotation in a predetermined amount and enters in the waiting state. This is the state shown in FIG. 39 in the outlined operation description. When the motor enters in the waiting state, the lock nail 444*a* falls in the cutout portion 429*k* of the ASF clutch 429 as shown in FIG. 47. Therefore, even where the feeding shaft 405 is rotated due to some external interference, the engagement portion 429*a* of the release collar 429*c* or the flange engagement portion 429*f* of the output shaft 429*b* hits the lock nail 444*a*, so that the feeding shaft 405 does not rotate overly and the phase is stable. This is the description for associated operations of the structural elements.

Figure 55:
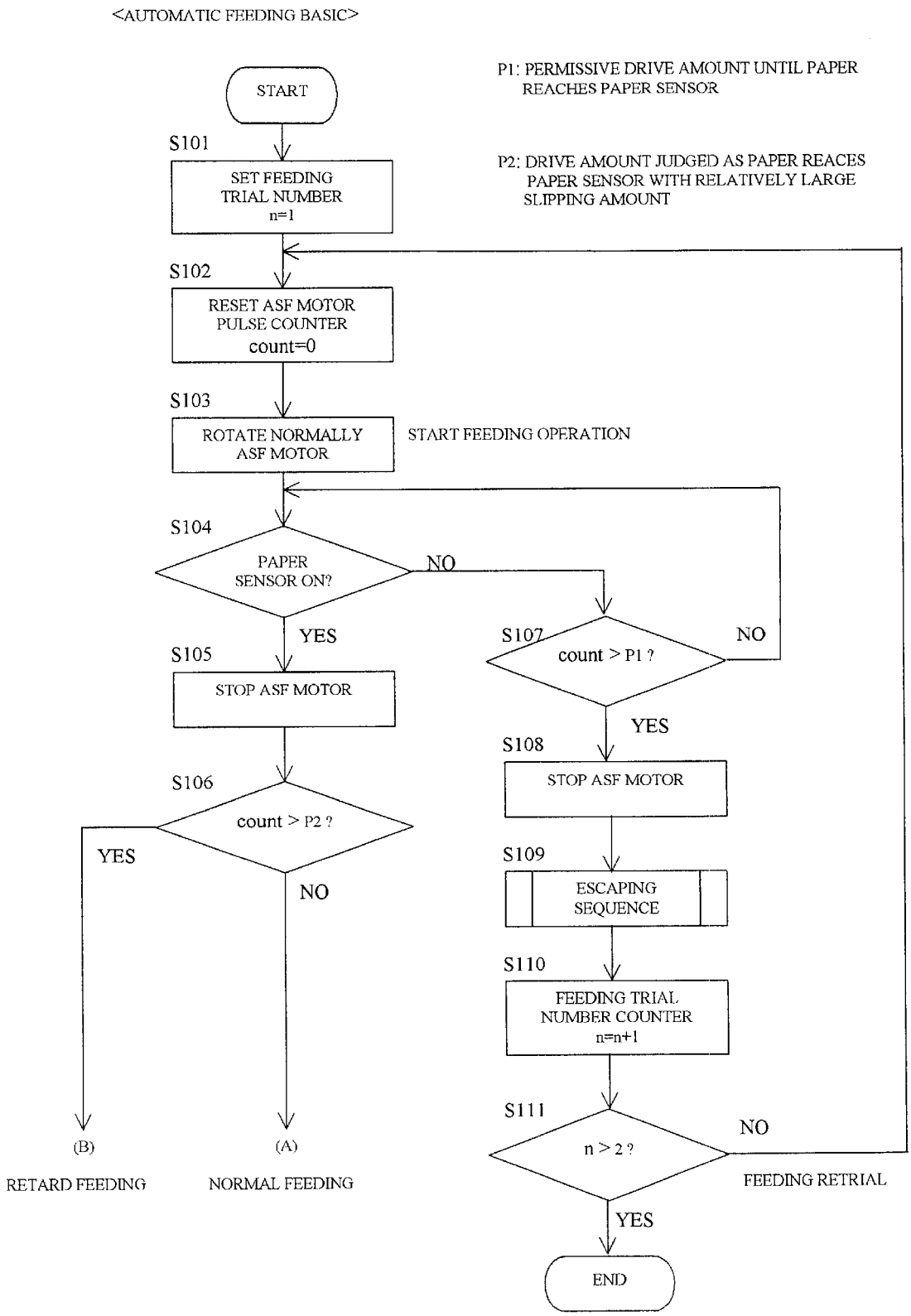
FIG. 55 is a flowchart of automatic feeding (basic flow)
Figure 56:
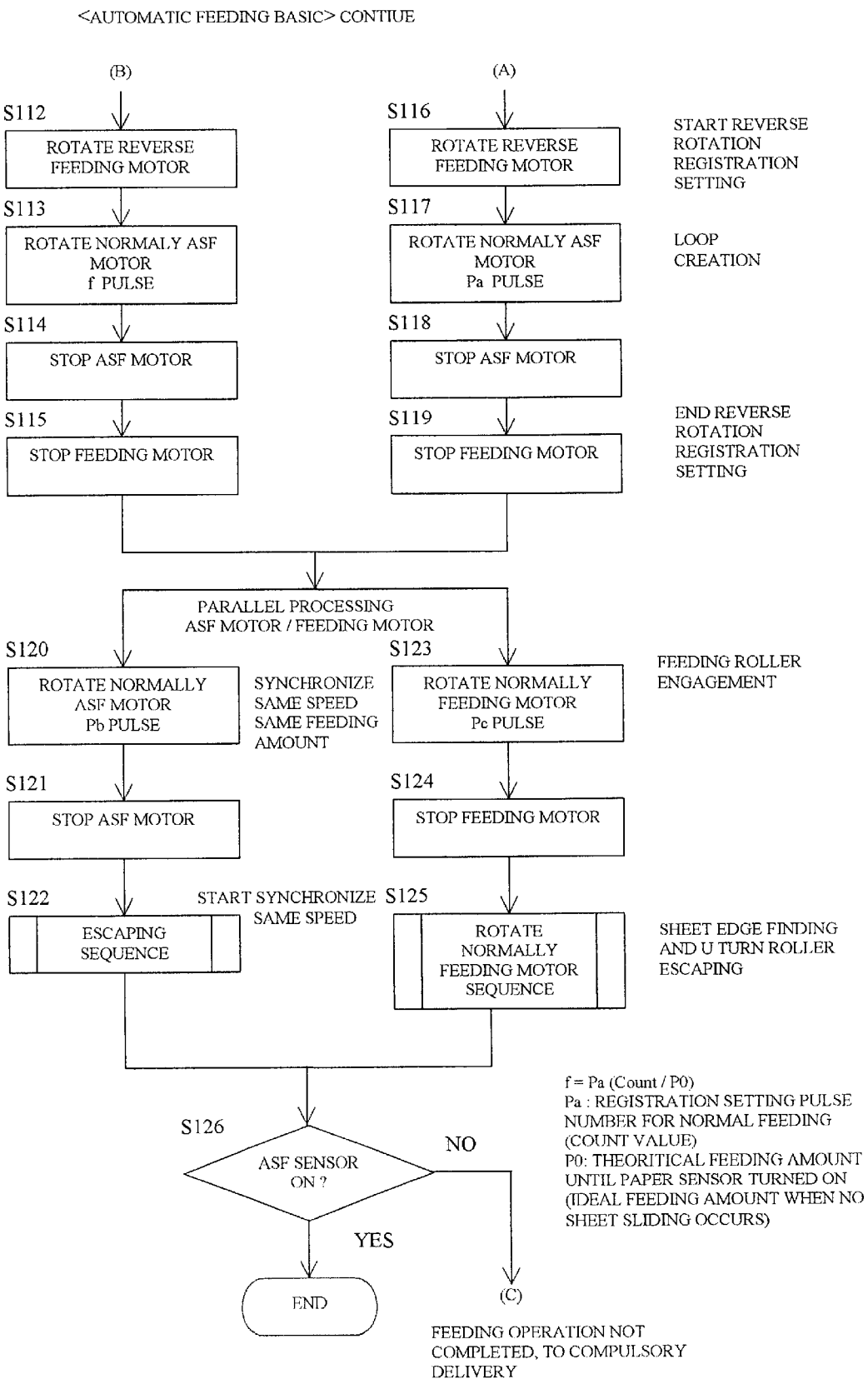
FIG. 56 is a flowchart of automatic feeding (basic flow)
Figure 57:
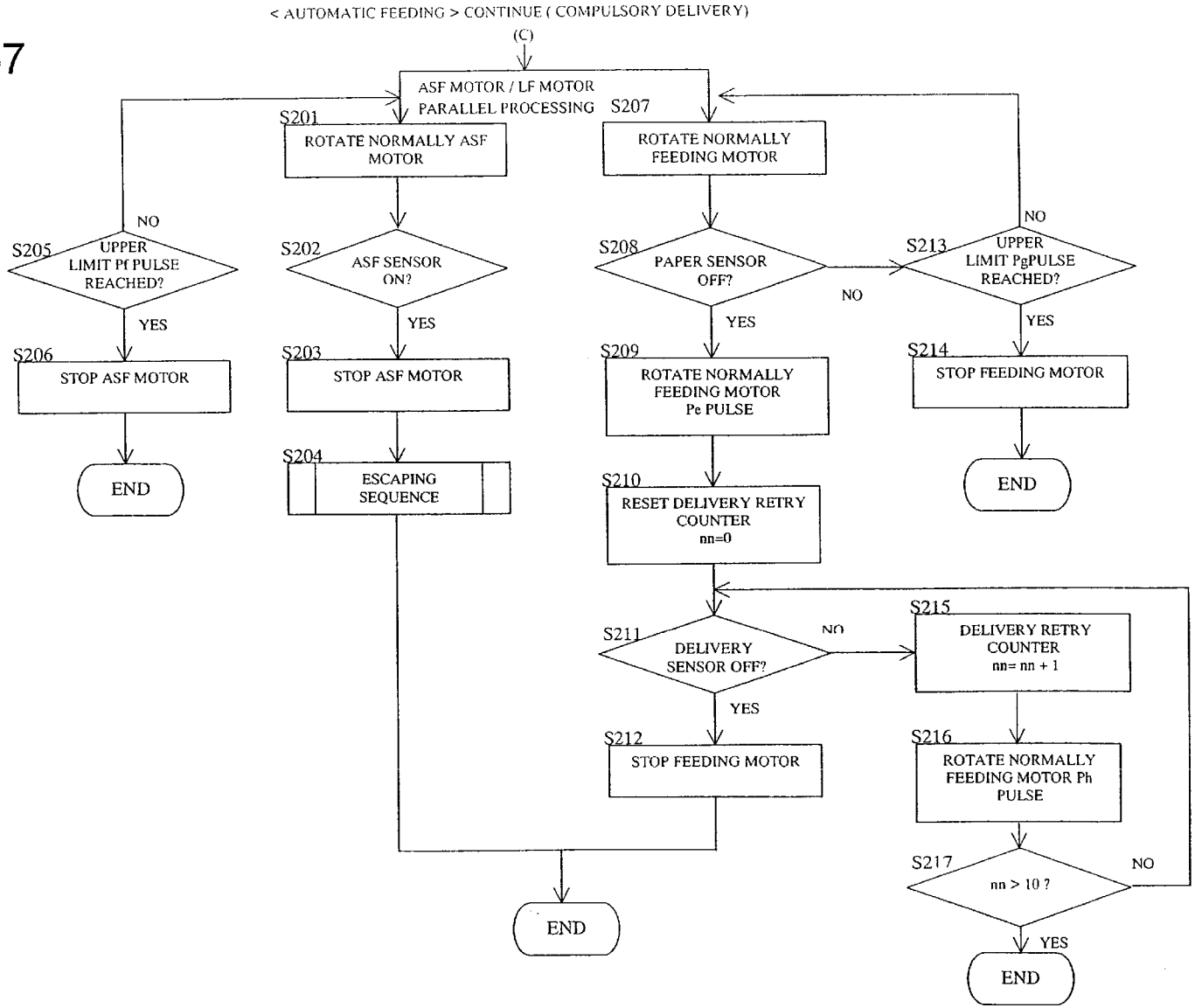
FIG. 57 is a flowchart of automatic feeding (compulsive delivery flow)
Figure 58:
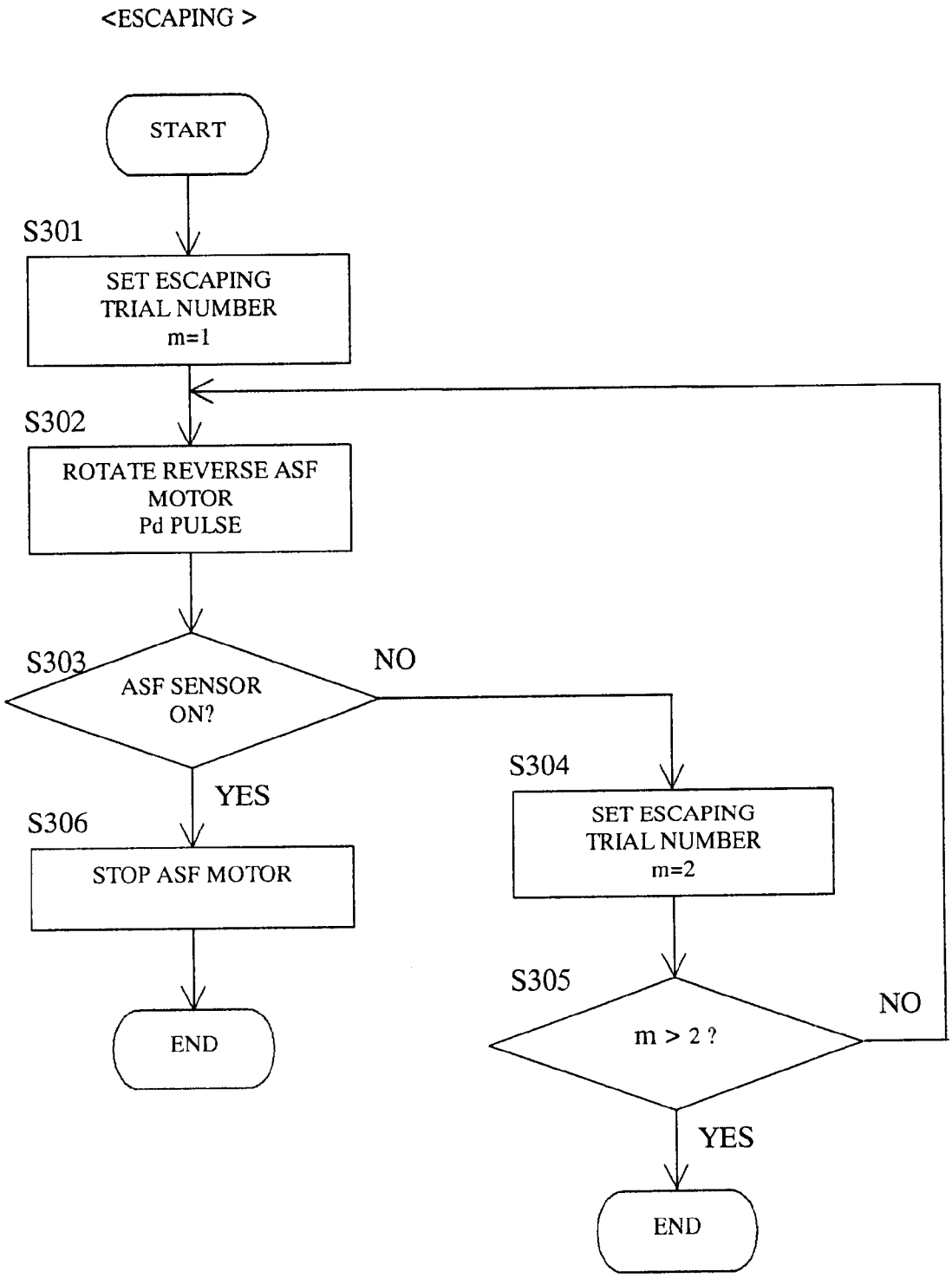
FIG. 58 is a flowchart of automatic feeding (escaping flow)

In use of flowcharts shown in FIG. 55 to FIG. 58, the flow of the whole feeding control is described. FIG. 55 and FIG. 56 are basic flows for automatic feeding; FIG. 57 shows a compulsory delivery flow; FIG. 58 shows an escaping flow of the U-turn roller. It is to be noted that those flows are executed by an apparatus control circuit constituted of CPU, controller, ROM, RAM, and the like, and a block diagram is described below. Hereinafter, the flow for feeding operation is described.

Now, the basic flows in FIG. 55, FIG. 56 are described. When the automatic feeding starts, the feeding trial time is initialized to start first trial (S101). The rotation amount counter of the ASF motor is reset. In this embodiment, the ASF motor is made of a stepping motor, which counts drive pulse number (S102). The ASF motor is made to normally rotate to begin the feeding operation (S103). The normal rotation denotes a CW rotation of the pinion gear in the description of the mechanical system. When the feeding operation starts, the status of the paper sensor is monitored (S104). The paper sensor is numeral 629 in FIG. 2, and FIG. 36 to FIG. 39, which shows the OFF state when no sheet exists and the ON state when the sheet is passing. The ASF motor continues normal rotation until the paper sensor is turned on up to a predetermined permissive drive amount P1 pulse as a limitation (S104, S107). If the paper sensor is turned on before reaching the permissive drive amount P1, the ASF motor is temporarily stopped to move the subsequent sequence (S105). If the pulse counter value exceeds the P1 pulse as the paper sensor is turned off, the ASF motor is stopped (S108), and the escaping sequence is executed (S109).

The escaping sequence is to escape the U-turn roller by reverse rotation of the ASF motor and to return the drive system to the initial state. FIG. 58 shows the flow. The escaping trial time is initialized (S301), and the ASF motor is made to reverse rotate with a predetermined Pd pulse (S302). The reverse rotation denotes a CCW rotation of the pinion gear in the description of the mechanical system. If the ASF sensor is turned on (S303), it is judged as escaping operation is normal, and the ASF motor is stopped (S306) to end the program, thereby entering a state movable to the subsequent sequence. If the ASF sensor is turned off, escaping retrial is made once (S303, S304, S305). If the ASF sensor is not yet turned on, the sequence ends with an escaping error.

Returning to the description in FIG. 55, if the escaping sequence is completed (S109), a feeding retrial is executed once (S110, S111). If the paper sensor is not turned on even where the retrial is made, the sequence ends with a feeding error (S104, S107 through S111).

If the sheet is conveyed to the paper sensor and if the paper sensor is turned on, registration setting operation is executed upon judgment of step S106 after the ASF motor is stopped (S105). The pulse count value is compared with a predetermined sliding feeding judgement reference value P2 at step S106, a sliding degree of the sheet is judged. If it is judged as the sheet is conveyed with relatively large slide, the program goes to FIG. 56(B), and the apparatus executes registration setting in consideration of sliding. If it is judged as the sheet is not conveyed with relatively small slide, the program goes to FIG. 56(A), and the apparatus performs a normal registration setting operation. Both registration setting operations are performed upon creation of sheet loop.

In FIG. 56(A), the feeding motor is rotated reversely in the reverse direction to the sheet conveyance (S116), and the ASF motor rotates normally to render the sheet hit the nip of the feeding roller to produce a sheet loop (S117). The feeding pulse number Pa of the ASF motor is a prescribed pulse number to gain the suitable sheet loop amount. The ASF motor is stopped (S118), and the feeding motor is stopped (S119), thereby ending the registration setting operation.

In FIG. 56(B), the registration setting operation is made at steps S112 to S115, but the ASF motor rotates with a different normal rotation pulse number from that in the above flow (A). At step S113, the ASF motor normal rotation pulse number is increased to f pulse in consideration of sliding easiness of the sheet. Sliding increasing rate is a value in which the feeding amount needed to the paper sensor actually is divided by a preset theoretical feeding amount P0 to the paper sensor. This sliding increasing rate is multiplied by the loop production pulse Pa during normal feeding to obtain a value f. To increase the f pulse, a proper loop amount is ensured.

Steps S120 to S125 are a sheet end finding sequence for printer section and an escaping sequence for the U-turn roller, and the ASF motor and the feeding motor are driven in synchrony with each other. At steps S120 and S123, the ASF motor and the feeding motor begin driving at the same time, and both normally rotate with a rotation number such that the U-turn roller and the feeding roller have the same feeding speed. The motors are driven by the Pb pulse and the Pc pulse, which are preset as to feed the sheet in the same feeding amount. Both motors are temporarily stopped at steps S121, S124. This renders the sheet engaged with the feeding roller stably, and hereinafter, sheet end finding is made by the feeding motor as a main drive source. At steps S122, S125, the ASF motor begins execution of the escaping sequence, and at the same time, the feeding motor executes the preset sheet end finding sequence according to various printing conditions. The ASF motor at that time reversely rotates at a prescribed rate, and the U-turn roller escapes as normally rotating in the feeding direction with the same feeding speed as that of the feeding roller. Accordingly, when the sheet end is found in the printer section, any load occurs due to the U-turn roller, so that sheet end finding becomes accurate. The apparatus confirms the state of the ASF sensor at the final stage, and if the ASF sensor is turned on, it is judged as normal and the automatic feeding is completed (S126). Although recording operation is executed thereafter, no back tension occurs because the U-turn roller escapes, so that good recording quality can be obtained.

Compulsory delivery control is described next. If the ASF sensor is turned off at the final step S126 in FIG. 56, the feeding shaft is not located at an appropriate waiting position and stopped with an improper rotational phase. For example, if the feeding shaft 405 exists at a position shown in FIG. 37, the separation roller rubbers 112*c* press the sheet 111*a* on the cassette, thereby creating back tension to the printer section after finding the sheet end. Such a situation may occur in the case of the feeding retrial in FIG. 55. That is, first feeding renders the sheet reach a position right before the paper sensor as sliding, and the retrial renders the sheet reach the paper sensor with a small feeding amount, thereby entering a state finishing the sheet end finding operation and the escaping operation of the U-turn roller. The feeding shaft at that time stops in a midway of the rotation. In this embodiment, in consideration of guaranteeing recording property and unintended attachment and detachment of the cassette, the sheet is delivered under such a situation, and the feeding system is returned to the initial state completely, thereby restarting the feeding operation.

FIG. 57 shows a flow for compulsory delivery. If the ASF sensor is turned off at the final step S126 in FIG. 56, the sheet that the sheet end finding is already completed from cooperation of the ASF motor and the feeding motor as shown in FIG. 57 is delivered. First, the ASF motor is rotated normally (S201), and the feeding motor is rotated normally (S207), thereby starting feeding of the sheet. The ASF motor stops the normal rotation (S203) when the ASF sensor is turned on (S202), thereby executing the escaping sequence (S204). With this situation, the lock nail engages with the output shaft of the clutch, and namely, the position of the feeding shaft is initialized. Since the U-turn roller is made to escape, the compulsory delivery is performed thereafter by the conveyance system of the printer section. If the ASF sensor is not turned on even where the drive amount of the ASF motor reaches the prescribed upper limitation Pf Pulse, jamming of the sheets or the like may be possible, and the sequence is completed as a compulsory delivery error (S205, S206). On the other hand, the feeding motor that starts the normal rotation as well as the ASF motor, rotates normally with a prescribed Pe pulse when the paper sensor is turned off (S208), thereby delivering the sheet from the delivery roller. If the paper sensor is not turned off even where the drive amount of the feeding motor reaches a prescribed upper limitation Pg pulse, paper jamming may be possible, so that the sequence ends with a compulsory delivery error (S213, S214). After the Pe pulse is sent at step S209, the delivery retrial counter is reset (S210), and if the delivery sensor is turned off (S211), the feeding motor is stopped to end the sequence (S212). If the delivery sensor is turned on (S211), the retrial number is counted up to execute additional sending of a prescribed amount of Ph pulse because the sheet remains at the delivery sensor portion, and if the delivery sensor remains turned on even where the additional sending of ten times is executed, the sequence ends with a compulsory delivery error (S215, S216, S217). This is a description of the flow for automatic feeding.

Figure 59:
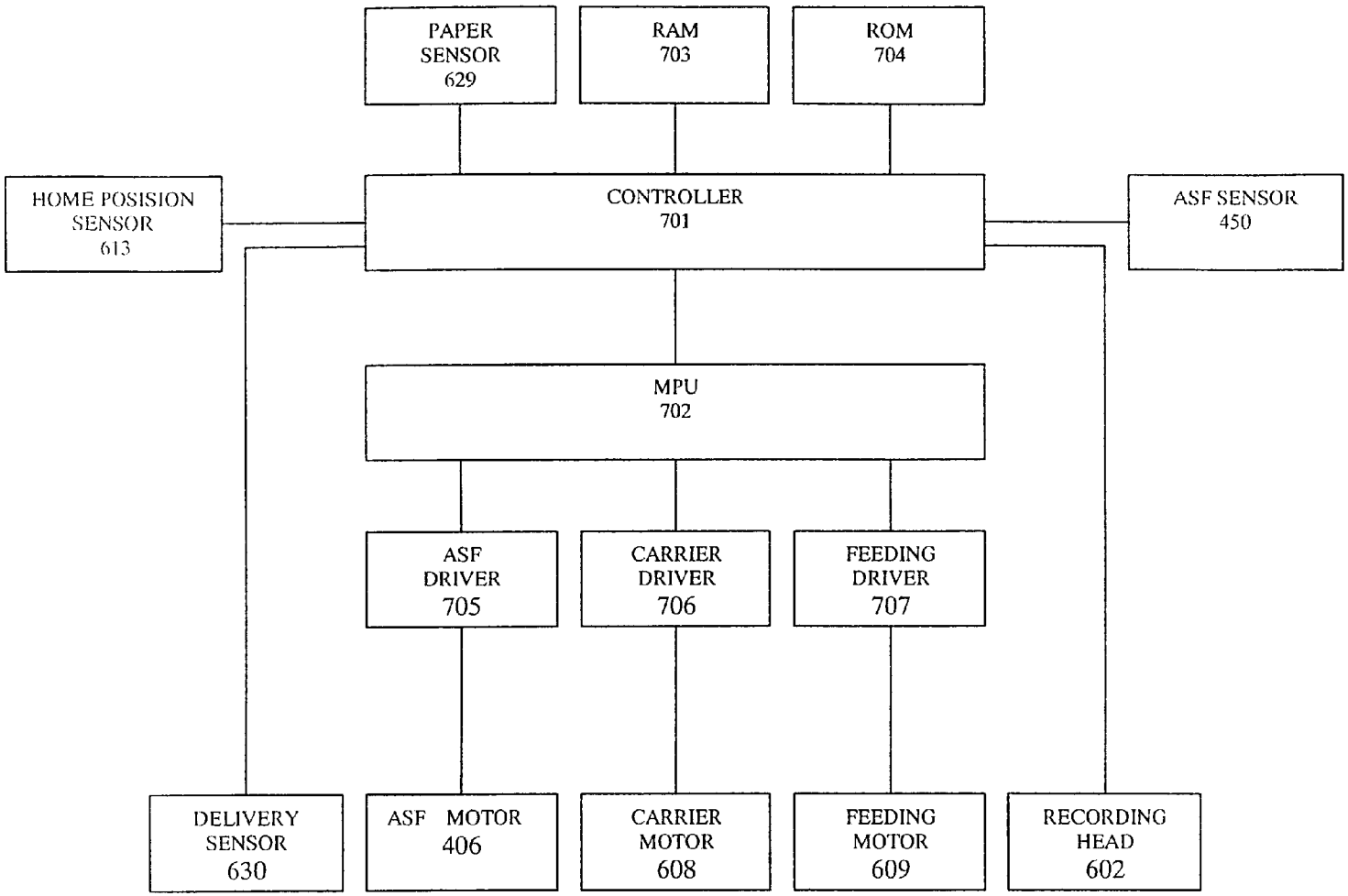
FIG. 59 is a block diagram showing a control system.

Referring to a block diagram shown in FIG. 59, the apparatus body control circuit for controlling the whole apparatus including the above feeding control is described. Numeral 701 is a controller for executing various programs, has gate array circuits for high speed processing of data, and has various timers and counters for various timing controls. A ROM 704 stores a variety of reference information such as control tables, set value information, and the like. An MPU 702 is a so-called central processing chip for computing various data or the like. Numeral 703 is a RAM used as a work region mainly for the controller and the MPU. Various computations and instructions are executed by cooperation of the controller 701, the MPU 702, the RAM 703, and the ROM 704 to control the apparatus. The statuses of the ASF sensor 450, the paper sensor 629, the home position sensor 613, and the delivery sensor 630 are used for conditional judgments at the various controls according to necessity. The ASF motor 406 is driven through an ASF driver 705; a carrier motor 608 is driven through a carrier driver 706; the feeding motor 609 is driven through a feeding driver 707. The recording head 602 executes recording operation in reception of the output from the gate array circuit of the controller 701.

Printer, Carrier Scanning Section

Figure 60:
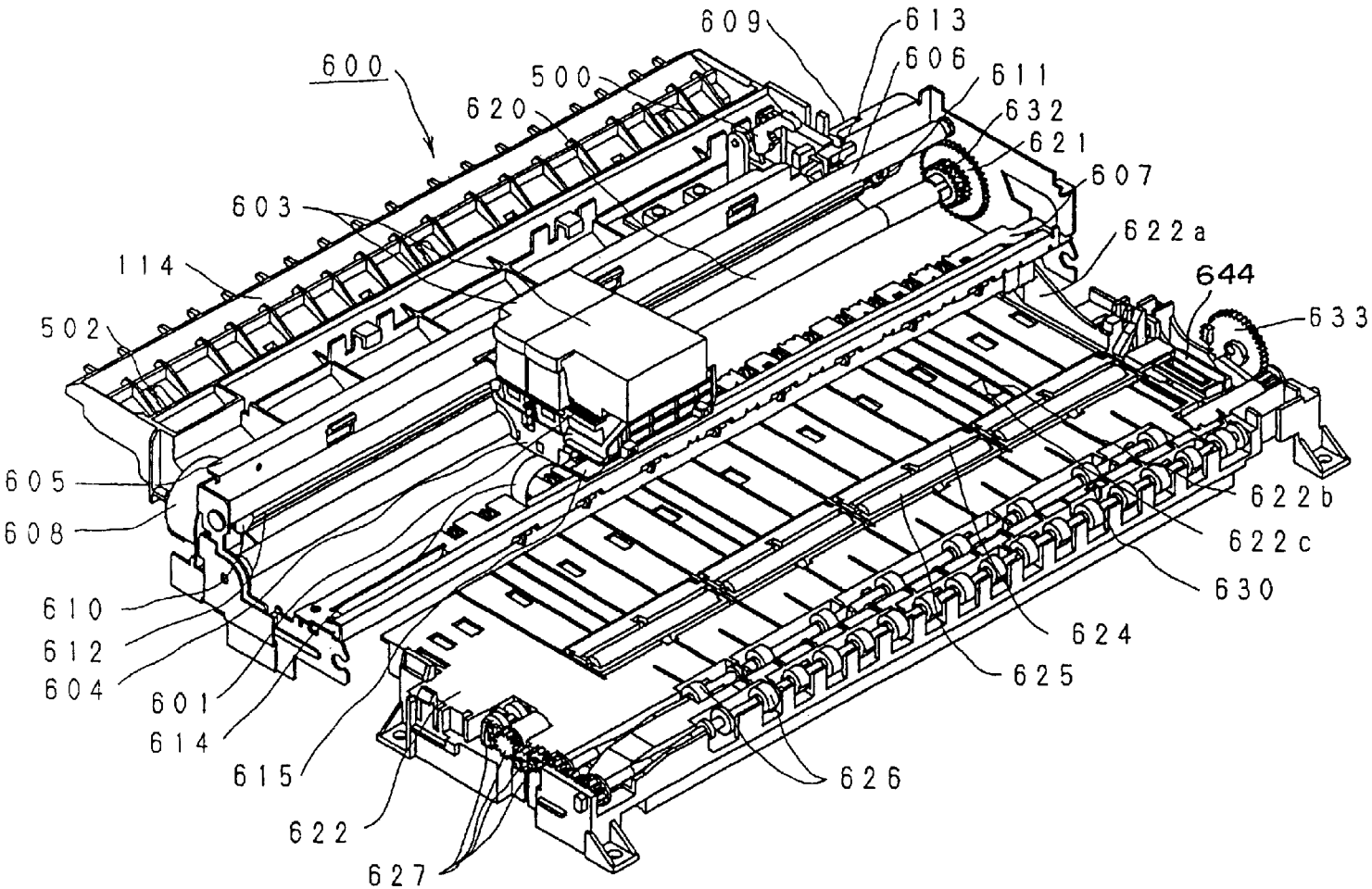
FIG. 60 is an exploded perspective view showing an inner structure of a printer portion of a recording apparatus as an embodiment of the invention when seen from a delivery side.

FIG. 60 is an exploded perspective view showing a recording apparatus printer section inner structure as an embodiment of the invention when seen on the delivery side.

This apparatus includes a carrier 604 holding detachably a recording head cartridge 601. The carrier 604 is secured to a printer frame 605 at each end and is supported slidably in a main scanning direction extending perpendicular to the conveyance direction of the recording sheets, not shown (or recording media including flexible sheets capable of recording such as plastic sheets and the like) parallel to the surface of the recording sheet, to a guide shaft 606 and a guide rail 607 disposed in parallel to each other.

The guide shaft 606 is a shaft having a smooth surface with a filled interior, whose one end is fonned with a groove portion to be secured to the printer frame 605.

The carrier 604 is coupled to a portion of a belt 612 tensioned around a drive pulley 610 rotatively driven by a carrier motor 608 secured to the printer frame 605 and an idler pulley 611 slidable in a direction parallel to the guide shaft 606 and supported rotatably to the printer frame 605 through a spring not shown, and when the carrier motor 608 is driven, the belt 612 is driven to move reciprocally the carrier 604 in the above direction along the guide shaft 606 and the guide rail 607. It is to be noted that the belt 612 is formed with a molded belt engagement portion made of a urethane based flexible material in this embodiment, so that an axial shaped portion of the belt engagement portion is secured rotatably and slidably in a very small range to a bearing of the carrier 604.

An ink tank 603 is detachably mounted to the recording head cartridge 601, and when the ink is made empty from recording, the subsequent recording can be made by replacement of the ink tank 603.

The apparatus also includes a home position sensor 613 for detecting the position of the carrier 604 by detecting the passage of the carrier 604, and a flexible cable 614 for transmitting electric signals from a main substrate 302 to the recording head cartridge 601.

A flexible guide 615 made of a flexible material is formed to restrict the position of the flexible cable 614 around the outlet of the carrier 604.

Printer, Feeding Portion

Referring to FIG. 60, a structure to convey the recording sheets 111 is described.

The feeding roller 620 is supported rotatably to the printer frame 605, and an LF gear 621 is secured to the shaft end of the feeding roller 620. The feeding roller 620 is a shaft with a filled interior having an outer diameter of 7.561 mm coated with a urethane resin to increase the frictional coefficient with respect to the recording sheets The feeding roller 620 is rotatably driven by the feeding motor 609 through the LF gear 621.

Figure 62:
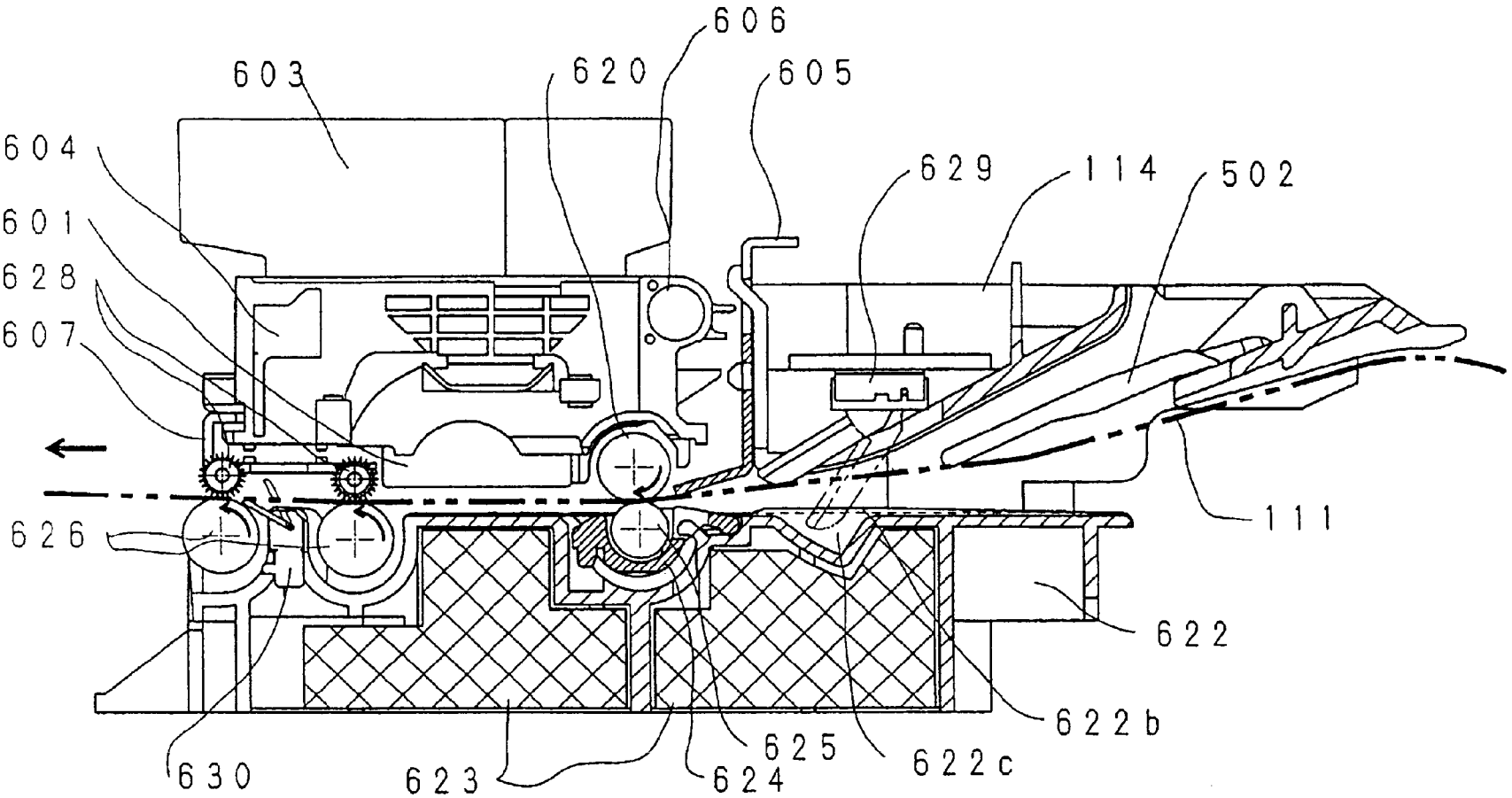
FIG. 62 is a side cross section showing the printer portion of the recording apparatus as the embodiment of the invention.

FIG. 62 shows a side cross section of a recording apparatus printer section as an embodiment of the invention. As shown in FIG. 62, a platen 622 is mainly placed on a lower side of the paper conveyance surface. The platen 622 is securely incorporated in the base 101 and forms a box structure having a gap to the base 101 for containing a waste ink absorber 623 as described below. Any warp is corrected in the part basis by screwing the platen 622 and the base 101 at this state, thereby improving the rigidity of the apparatus.

Projecting ribs **622*b* for reducing sliding load during conveyance are formed on the surface of the platen 622 in plural rows along the conveyance direction of the recording sheets 111**.

A pinch roller 625 held by a pinch roller holder 624 rotatably attached to the platen 622 is pressed to the feeding roller 620 from a lower side by a spring, not shown, and the recording sheet, not shown, nipped between the feeding roller 620 and the pinch roller 625 is conveyed by drive of the feeding motor 609.

The pinch roller 625 has an outer peripheral portion for nipping the recording sheets 111 with the feeding roller 620 having a diameter, slightly small and approximately equal to that of the feeding roller 620, of 6 mm. A ratio of an outer diameter of the rotary shaft portion held by the pinch roller holder 624 to a diameter of the outer peripheral portion of the pinch roller 625 is 1 to7.5, and the shaft diameter is 0.8 mm. According to this, since the rotation load is so light, the recording sheets 111 can be conveyed without almost any loss. Because the outer diameter of the pinch roller 625 and the outer diameter of the feeding roller 620 are nearly the same, the recording sheets, not shown, are readily introduced to the contact point (nipping portion) between the pinch roller 625 and the feeding roller 620 when the sheets are fed, and therefore, force for pushing the front end of the sheet into the nipping portion can be reduced.

A nickel plating processing is made on the outer peripheral portion and the shaft of the pinch roller 625. The apparatus can reduce corrosions caused by ink mists sprayed from the recording head cartridge 601 and included in the atmosphere in the apparatus and wearing occurring when the roller 625 slides on the pinch roller holder 624 over a long period of time, so that the pinch roller 625 does not increase the rotation load even after long time use.

Delivery rollers 626 are attached to the platen 622 as extending as two rows for delivering the recorded recording sheet outside the apparatus on the opposite side to the feeding roller 620 astride the recording head cartridge 601. The delivery roller 626 rotates in synchrony with the feeding roller 620 from receiving the drive force from the feeding roller 620 through an idler gear series 627. A spur 628 attached to the guide rail 607 is disposed above the delivery roller 626, and the recording sheet is conveyed in nipped between the delivery roller 626 and the spur 628 where the delivery roller 626 is pressed to the spur 628 by a spring, not shown, from the lower side.

The paper sensor 629 is provided on a side of the manual feeding opening 102*e* opposite to the recording head cartridge 601 astride the feeding roller 620, and the delivery sensor 630 is provided between the delivery rollers 626 arranged in the two rows. Existence and non-existence of the recording sheet are detected near those sensors.

The platen 622 has a paper guide portion 622*a* serving as a rough reference when the recording sheets 111 are inserted to the left end. A rib closest to the paper guide portion 622*a* among the plural projecting ribs 622*b* formed on the surface of the platen 622, has a gentle slope on the opposite side to the paper guide portion 622*a* to prevent the recording sheet from being trapped when the recording sheet is pushed to the paper guide portion 622*a* (see, FIG. 61).

This structure is designed because where the recording sheet is manually fed from the manual feeding opening 102*e*, the sheets may be inserted obliquely according to insertion degree of the operator and may contact to the paper guide portion 622*a*, though the sheets, in general, may not positively contact to the paper guide portion 622*a* because the recording sheets 111 conveyed from the ASF unit to the printer unit 600 are conveyed while the U-turn roller 112*d* holds the position.

Figure 61:
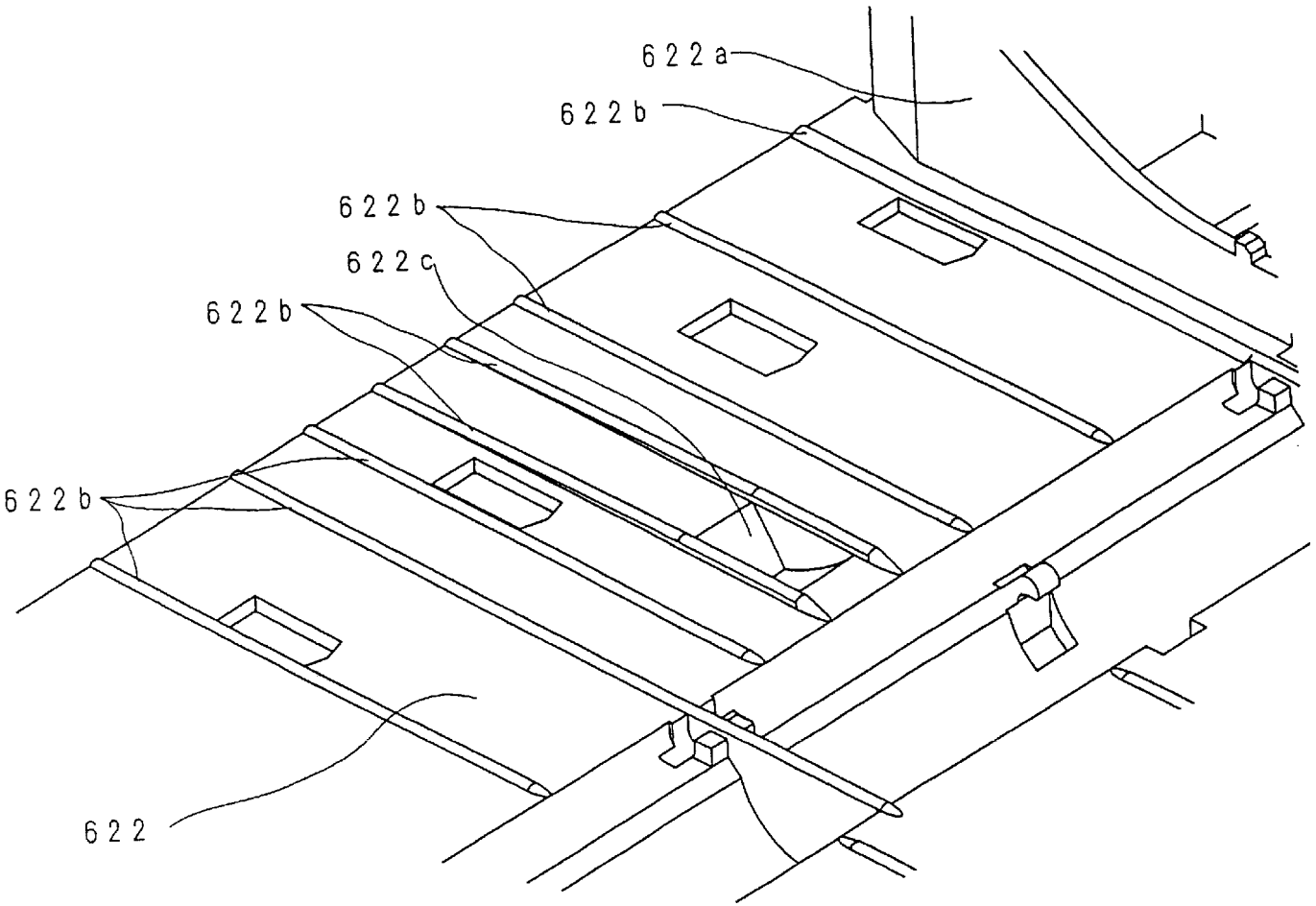
FIG. 61 is an enlarged perspective view showing a platen of the printer portion of the recording apparatus as the embodiment of the invention when seen from a delivery side.

Moreover, the platen 622 has a recess 622*c* and contains a tip of the paper sensor 629 when the recording sheet is not inserted. It is to be noted that the ribs 622*b* as described above are provided on both side of the recess 622*c* of the platen 622, but those ribs only are made about 0.55 mm higher in height in comparison with other ribs 622*b*. With this structure, the tip of the paper sensor 629 can surely be contained, and erroneous detection may be prevented by bending the sheet partially by the lever pushing force of the paper sensor 629. Where the recording sheet 111 is located near the paper sensor 626 and is conveyed in a direction reverse to the normal delivery direction, the paper sensor may be forcedly returned to a state detecting no recording sheet where the tip of the paper sensor 629 is engaged to the recording sheet 111. By rendering higher those ribs, the angle formed between the lever of the paper sensor 629 and the recording sheet 111 becomes shallow and eliminates the engaged situation as described above, so that damages on the paper sensor 629, erroneous detection, scratches on the recording sheets, or the like can be prevented (FIG. 61).

When the recording operation to the recording sheet 111 ends according to the steps as described below, the recording sheet 111 is nipped between the delivery roller 626 and the spur 628 and delivered onto the delivery tray 110 according to so-called delivery operation by means of the rotation of the delivery roller 626. If the recording sheet 111 is not delivered completely on the delivery tray 110 at that time, and if the sheet remains on the delivery roller 626, the subsequent sheet may hit this sheet when the recording operation starts for the subsequent sheet, thereby possibly causing paper jamming. In this embodiment, after the delivery sensor 630 confirms that the recording sheet is completely delivered, the subsequent recording sheet is fed.

Printer, Recording Portion

A function as a recording apparatus of this apparatus is to make one line recording on a recording sheet by spraying ink downward in FIG. 62 corresponding to recording signals by means of the recording head cartridge 601 in synchrony with the reciprocal movements of the carrier 604. That is, this recording head cartridge 601 includes fine liquid spraying openings (orifices), liquid routes, energy operation portions formed at a portion of each liquid route, and energy generating means for generating droplet forming energy operable to the liquid located at the operation portion.

As the energy generating means for generating such energy, there are a recording method using an electric-mechanical converter such as piezo-electric device or the like, a recording method using energy generating means generating heats in radiating electromagnetic wave such as laser beam and spraying droplets by operation from the generated heats, a recording method using energy generating means heating the liquid by an electric-heat converter such as a heat generating device having resistance for generating heats and spraying the liquid, and the like.

A recording head used for an inkjet recording method in which heat energy sprays liquid, inter alia, can make recordings with a high definition because the liquid spraying openings for spraying liquid for recording and forming sprayed droplets can be arranged with a high density. The recording head using the electric-heat converters as energy generating sources, inter alia, readily makes the size compact, adequately utilizes advantages in IC technology and micro-fabrication technology in which technology in the semiconductor field is so advanced recently and in which reliability is improved significantly, readily allows a high density assembly, and makes the production costs inexpensive, and therefore, it is highly advantageous.

Where one line recording is made by move of the recording head cartridge 601, the recording sheet 111 is conveyed by one line in a direction of the arrow indicated as in the conveyance direction on the recording sheet 111 in FIG. 62 by means of the feeding motor 609, and is prepared for recording for the next line.

Printer, Recovery Portion

This apparatus has a recovery mechanism as described below for removing ink and foreign objects staffed in the nozzles in the recording head cartridge 601 by absorption. This apparatus also performs preliminary spraying operation in which foreign objects or ink in a small amount remaining in the nozzles even where the recovery operation is made is removed. The preliminary spraying operation is to perform recording head drive, which is generally implemented for printing, at a prescribed position other than on the recording sheet. The waste ink removed by those operations is contained in the waste ink absorber 623 incorporated in an inner wall of the platen 622.

Figure 63:
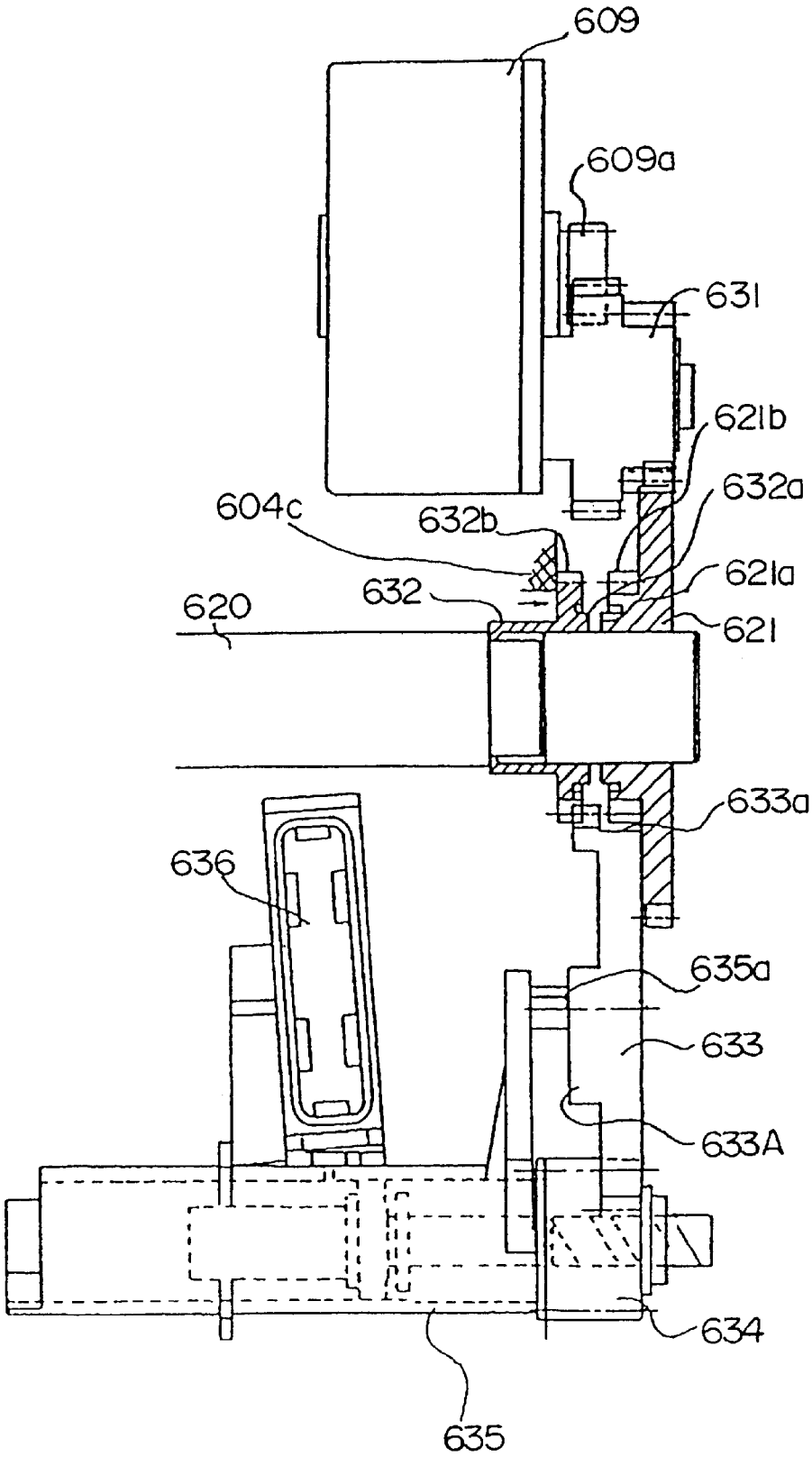
FIG. 63 is a diagram showing a piston drive transmission route from a feeding motor to a recovery system in the printer portion of the recording apparatus as the embodiment of the invention.

FIG. 63 is a diagram showing a piston drive transmission route from the feeding motor to the recovery system in the recording apparatus as an embodiment of the invention.

Rotation of the feeding motor 609 is transmitted to the LF gear 621 through an LF motor gear 609*a* and an LF double gear 631, thereby rotating the feeding roller 620. When the carrier 604 reaches a non-recording region and when a trigger gear 632, which is slidably and rotatably attached coaxially to the feeding roller, is pushed by a clutch switching projection 604c formed at the carrier 604, the trigger gear 632 moves in a direction toward the LF gear 621, and drive of the LF gear 621 is transmitted to the trigger gear 632 according to an engagement shape as described below in detail. Because the trigger gear 632 and a pump gear 633 are engaged with each other at this state, the drive is transmitted to the pump gear 633. Since the trigger gear 632 is normally remote to the LF gear 621, and since the pump gear 633 has a toothless portion at the engagement position for the LF gear 621, the drive from the LF gear 621 is not transmitted to the pump gear 633.

The carrier 604 moves to a capping position at the same time as engagement of the LF gear 621 and the pump gear 633, thereby closing ink spraying openings of the recording head cartridge 601 by a cap 636. The pump gear 633 moves a piston in a cylinder 635 through a cylinder gear 634, and according to this, ink is absorbed into the cylinder 635 from the ink spraying openings of the recording head cartridge 601 through the cap 636, thereby restoring the ink spraying function of the recording head cartridge 601.

Thus, the transmission of the drive force from the feeding motor to the pump gear 633 is controlled by movements of the pump gear 634, the LF gear 621, the trigger gear 632, and the carrier 604.

Figure 64:
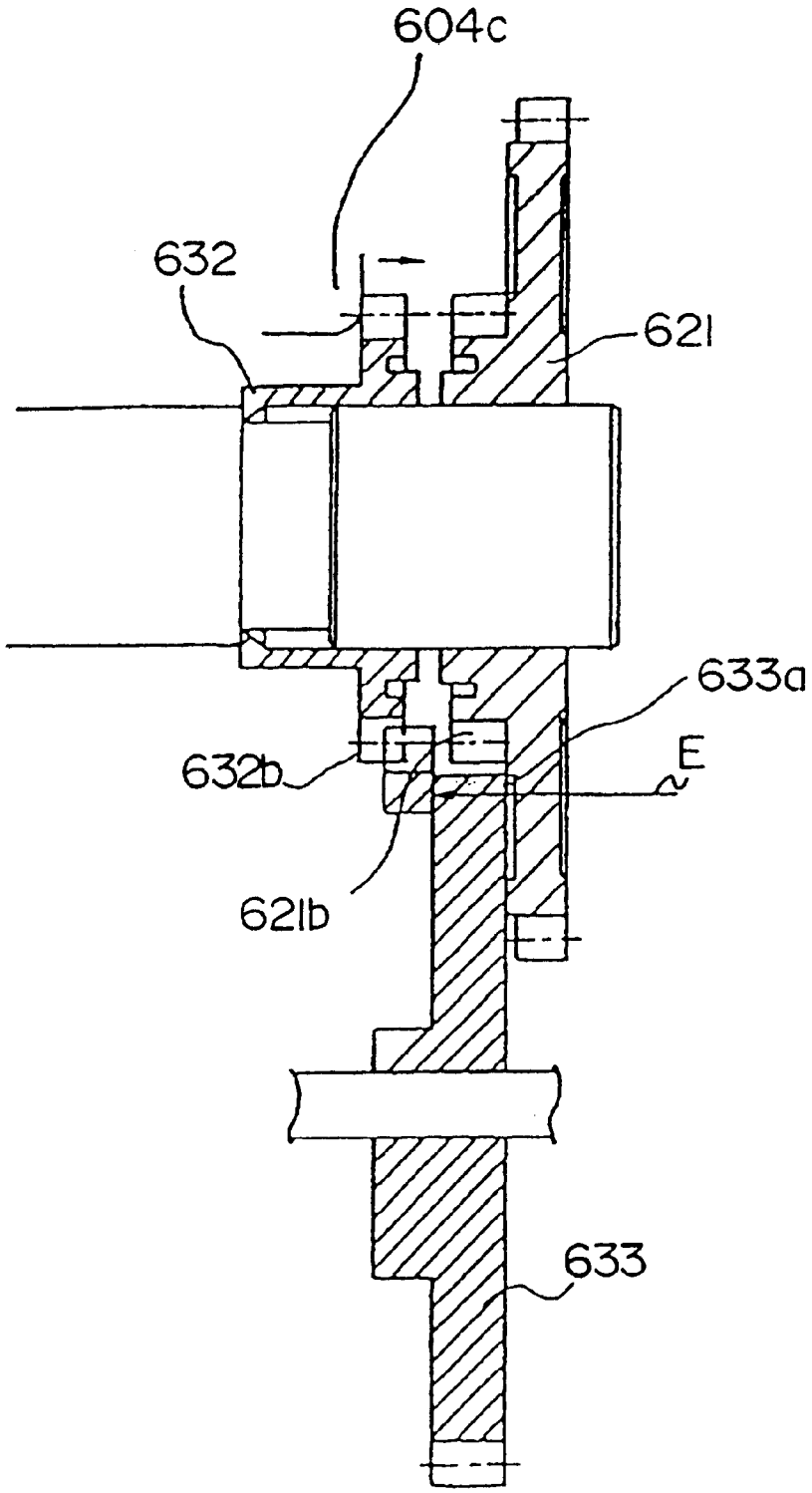
FIG. 64 is an enlarged view showing a switching mechanism and its vicinity of the printer portion of the recording apparatus as the embodiment of the invention.
Figure 65A:
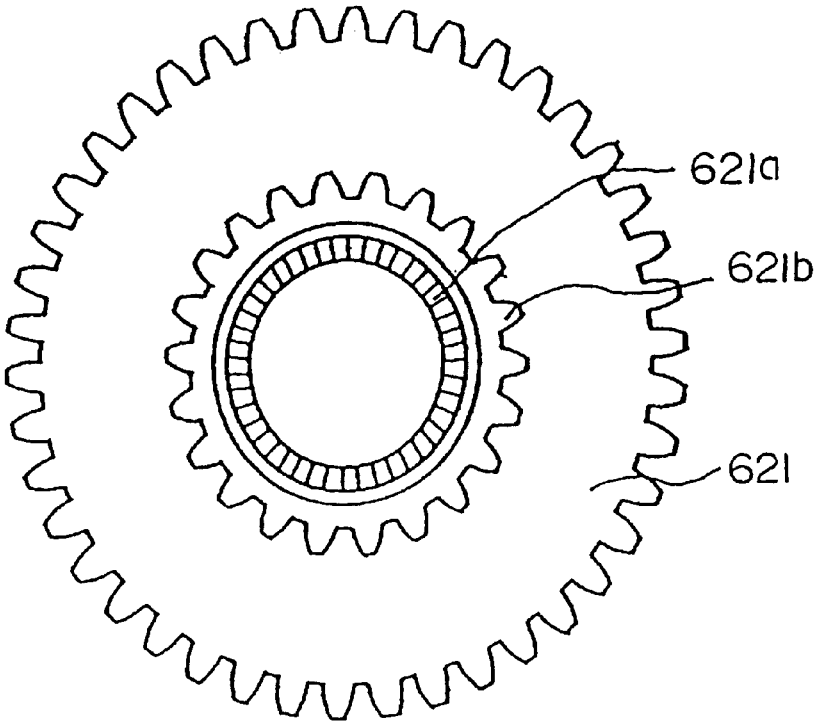
FIGS. 65(*a*)–65(*d*) is a diagram showing a meshing shape of an LF gear and a trigger gear shown in FIG. 64.
Figure 65B:
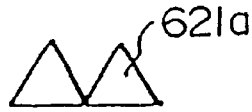
Figure 65C:
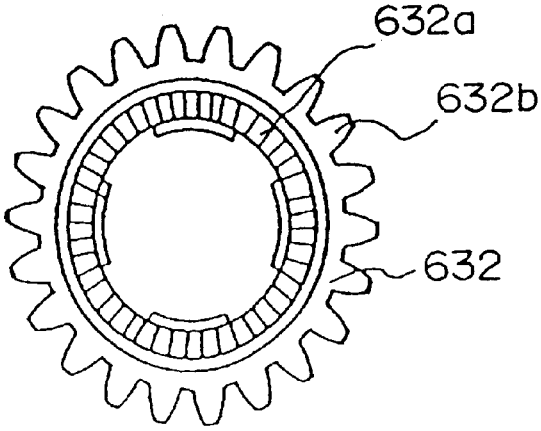
Figure 65D:
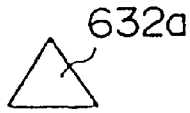

FIG. 64 is an enlarged view around a switching mechanism section of the recording apparatus according to an embodiment of the invention.

In FIG. 64, the trigger gear 64 is slidably formed as coaxially with the feeding roller. The trigger gear 632 is in meshing with the pump gear 633. In this state, because the trigger gear 632 is located remote to the LF gear 621, the drive from the LF gear 621 is not transmitted to the trigger gear 632. The pump gear 633 has a toothless portion at the engagement portion with the LF gear 621, and therefore, the pump gear 633 does not receive the drive force form the LF gear 621. If the carrier 604 moves toward the LF gear 621 direction more, the trigger gear 632 further moves to a side of the LF gear 621, thereby contacting the trigger gear 632 with the LF gear 621.

Teeth portions forming triangle shapes meshing to each other are formed on each contact surface (surfaces facing to each other). FIG. 65 is a diagram showing a meshed shape of the LF gear 621 and the trigger gear 632; (a) is a diagram showing the contact surface shape formed on the LF gear 621 facing the trigger gear 632; (b) is a cross section of the contact surface 621*a* of the LF gear 621 in (a); (c) is a diagram showing a contact surface shape formed on the trigger gear 632 facing the LF gear 621; (d) is a cross section of the contact surface 632*a* of the trigger gear 632 in (c).

As shown in FIGS. 65(*a*) and (*b*), the shapes of the contact surface 621*a* of the LF gear 621 are teeth forming triangle shapes (hereinafter, triangle teeth). The pitch is the same as the gear 621*b*, and the valleys of the triangle teeth are designed to be the same as mountains of the gear 621*b*. As shown in FIGS. 65(*c*) and (*d*), the shapes of the contact surface 632*a* of the trigger gear 632 are the same triangle teeth as those of the contact surface 621*a* of the LF gear 621. The pitch is the same as the gear 632*b*, and the mountains of the triangle teeth are designed to be the same as mountains of the gear 632*b*.

With the structure thus formed, where the LF gear 621 comes in contact with the trigger gear 632, the valleys of the triangle teeth of the contact surface 621*a* of the LF gear 621 engage with the mountains of the triangle teeth of the contact surface 632*a* of the trigger gear 632, thereby render the gears 621*b*, 632*b* of the LF gear 621 and the trigger gear 632 have the same phase. According to this, the trigger gear 632 rotates according to the rotation of the LF gear 621. The pump gear 633 rotates according to the rotation of the trigger gear 632 since the pump gear 633 does not disengage from the trigger gear 632 even where the trigger gear 632 moves toward the LF gear 621.

However, the drive force may be limited from such an indirect drive of the pump gear 633 through the trigger gear 632 with the LF gear 621.

To solve this problem, as shown in FIG. 64, a wide cutout portion 633*a* extending in a radial direction is formed at the peripheral portion of the pump gear 633. That is, the pump gear 633 has a portion formed thicker than the trigger gear 632 and the LF gear 621, and the peripheral portion of the pump gear 633 has the cutout portion 633*a* in which a part of the engraved teeth is cut out from the vicinity of the center in the axial direction to one end direction (arrow E, in FIG. 64).

Figure 66A:
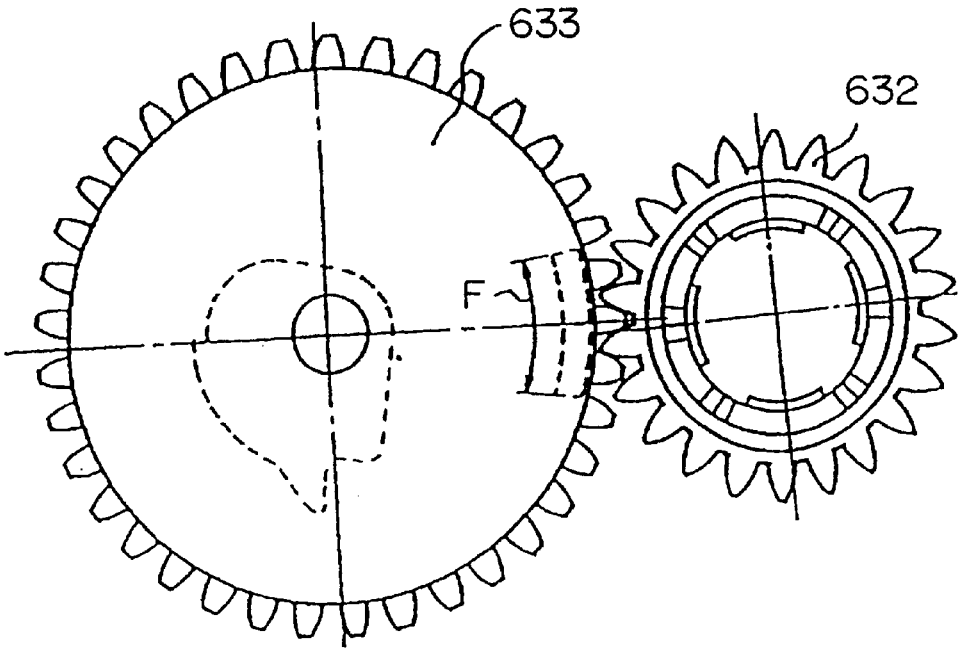
FIGS. 66(*a*)–66(*b*) is a diagram showing a structured layout of a pump gear and the trigger gear shown in FIG. 64.
Figure 66B:
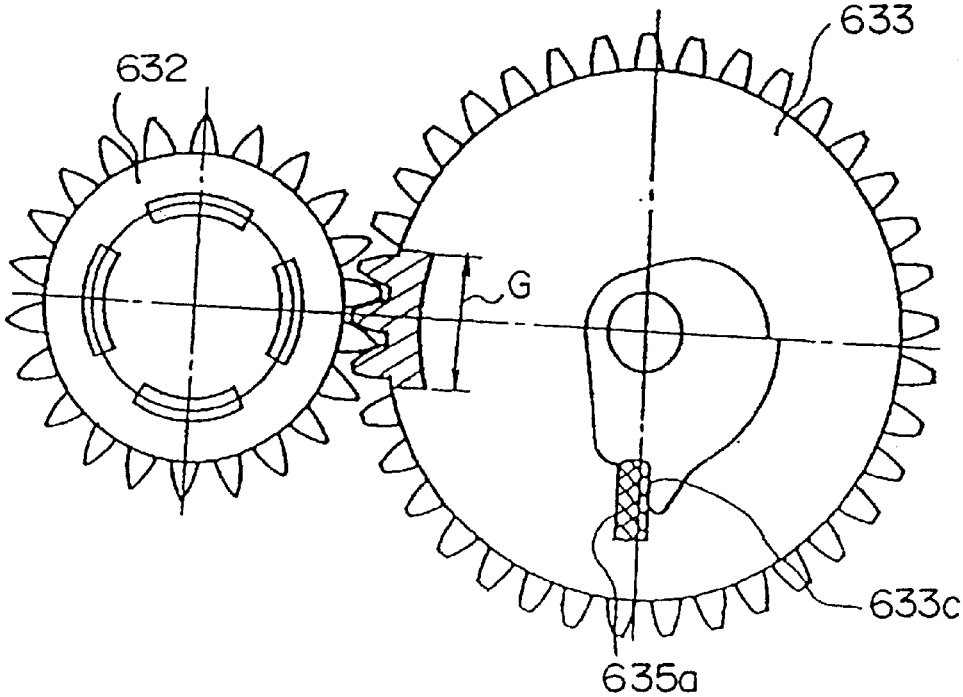

FIG. 66 is a diagram showing a structural layout of the pump gear 633 and the trigger gear 632; (a) is a diagram when seen from the right side; (b) is a diagram when seen from the left side.

As shown in FIG. 66, the width of the cutout (in FIG. 66, arrow F) is of a degree such that at least the cutout portion and the teeth of the LF gear 621 do not contact to each other even where the pump gear 633 and the LF gear 621 are placed to engage to each other.

If the trigger gear 632 rotates slightly, however, the pump gear 633 rotates to move the cutout portion, and therefore the pump gear 633 comes to engage with the LF gear 621 directly, thereby creating large drive force.

Under this state, even where the trigger gear 632 is disengaged from the LF gear 621 by a mechanism as described below where the carrier 604 is moved in a direction going away from the LF gear 621, the drive force continues to be transmitted because the pump gear 633 and the LF gear 621 are directly engaged to each other.

The trigger gear 632 moves as engaging with the pump gear 633 to be disengaged from the LF gear 621, so that there raises no problem such as collisions of teeth surfaces due to movements of the trigger gear 632.

Because the engagement between the pump gear 633 and the trigger gear 632 is not required when the pump gear 633 comes to engage with the LF gear 621, the engagement region of the pump gear 633 for the trigger gear 632 requires no more than an engagement portion (in FIG. 66, hatching portion, arrow G) equal to or greater than the cutout region at least as shown in FIG. 66.

This structure makes small the tooth width other than the engagement portion of the pump gear 633 with the trigger gear 632, so that different structural parts may be arranged at that region.

A disengagement mechanism between the trigger gear 632 and the LF gear 621 after the pump gear 633 engages with the LF gear 621 is described.

As described above, where the trigger gear 632 engages with the LF gear 621, the triangle teeth formed on the contact surfaces of both gears are in meshing with each other. Even if the carrier 604 is separated from the trigger gear 632 and further rotated from this state, the trigger gear 632 tries to maintain the engagement state with the LF gear 621 (actually, in some case the engagement may be released from vibrations or the like) because the drive force is directly transmitted by the pump gear 633 and the LF gear 621 and because the drive force is not transmitted to the trigger gear 632.

From this situation, the LF gear 621 is rotated in a direction reverse to the previous direction to release the drive transmission from the LF gear 621 to the pump gear 633. Then, the cutout portion 633*a* appears again, and at the same time, the engagement gear portion of the pump gear 633 for the trigger gear 632 (G portion, FIG. 66(*b*)) and the trigger gear 632 become in mesh with each other again. When the LF gear 621 is further rotated, the direct drive transmission is gone between the pump gear 633 and the LF gear 621, thereby stopping the rotation of the pump gear. The trigger gear 632 further rotates because of engagement with the LF gear 621, and therefore, the drive transmission to the pump gear 633 is done through the trigger gear 632. At that time, as shown in FIG. 66(*b*), the pump gear 633 does not rotate at a state facing the toothless position because an arm portion 635*a* of the cylinder 635 hits the recess wall surface 633*c* of the pump gear 633 to inhibit the rotation of the pump gear 633. In the trigger gear 632, therefore, force in the thrust direction works along the gear tooth surface of the pump gear 633, and the trigger gear 632 goes away from the LF gear 621.

Referring to FIG. 67 to FIG. 72, the recovery means constituted of the cap, the cylinder, and the like is described in detail.

FIG. 67 to FIG. 72 are illustrations for operation of the recovery system in the recording apparatus according to an embodiment of the invention.

The cap 636 made of a proper material having an elasticity of chloric butyl rubber or other is held unitedly at the cap holder 637. The cap holder 637 is rotatably held to the arm portion 635*a* extending unitedly from the cylinder 635.

The cylinder 635 has inside a piston 641 made of an elastic body such as a rubber or the like, and can generate a negative pressure in the cylinder 635 by drive of a piston shaft 640. Motions of the piston shaft 640 and the piston 641 are described in detail.

A joint portion 636 formed unitedly with the cap 636 is formed at the cap 636. Where the joint portion 636*a* is inserted with pressure into a joint portion 635*b* formed at the cylinder 635 with a stroke margin, and therefore the cylinder 635 and the cap 636 are coupled as a shielded state. An ink absorbing opening 635*c* is formed inside the joint portion 635*b* formed at the cylinder 635 for communication between the interior of the cylinder and the cap 636.

Figure 67:
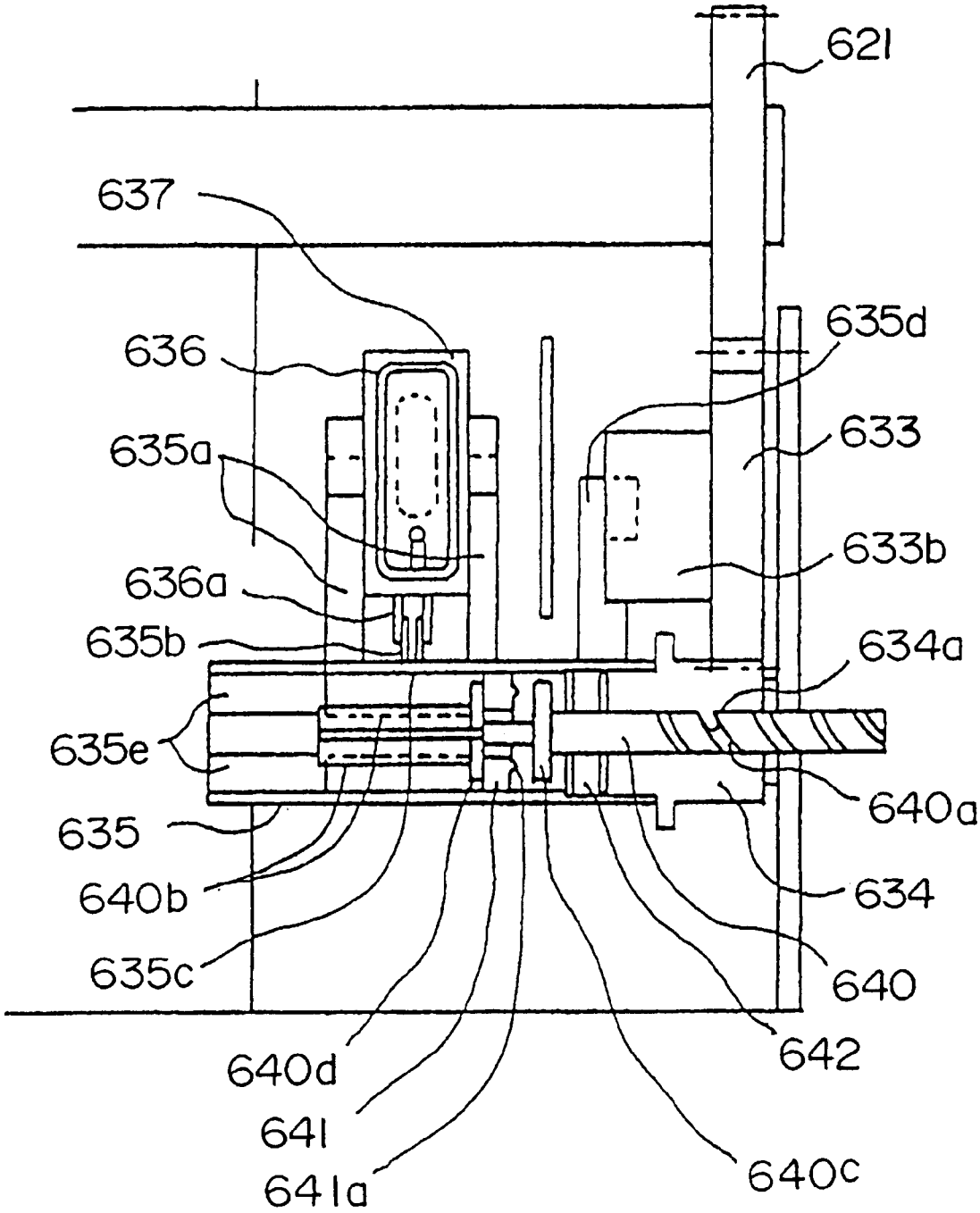
FIG. 67 is a operational diagram showing the recovery system in the printer portion of the recording apparatus as the embodiment of the invention.
Figure 68A:
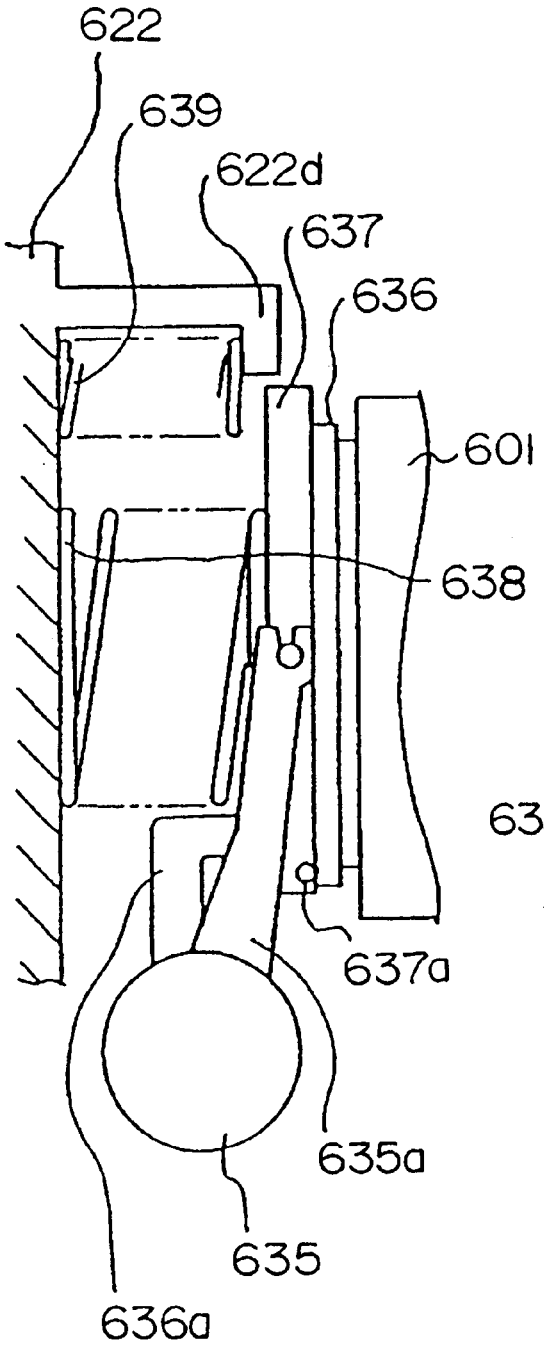
FIGS. 68(*a*) and 68(*b*) is a operational diagram showing the recovery system in the printer portion of the recording apparatus as the embodiment of the invention.
Figure 68B:
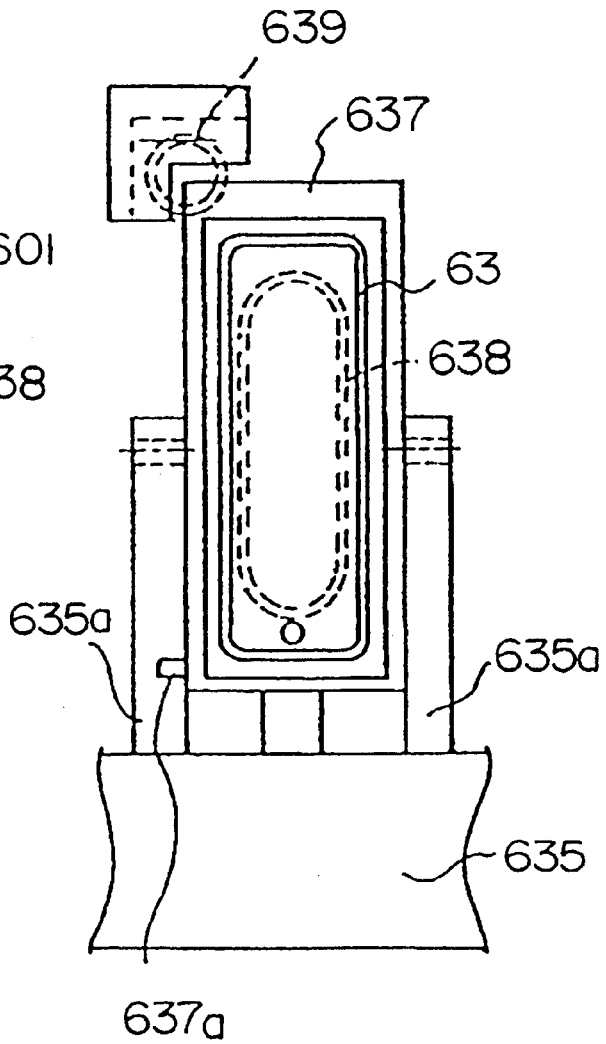
Figure 69:
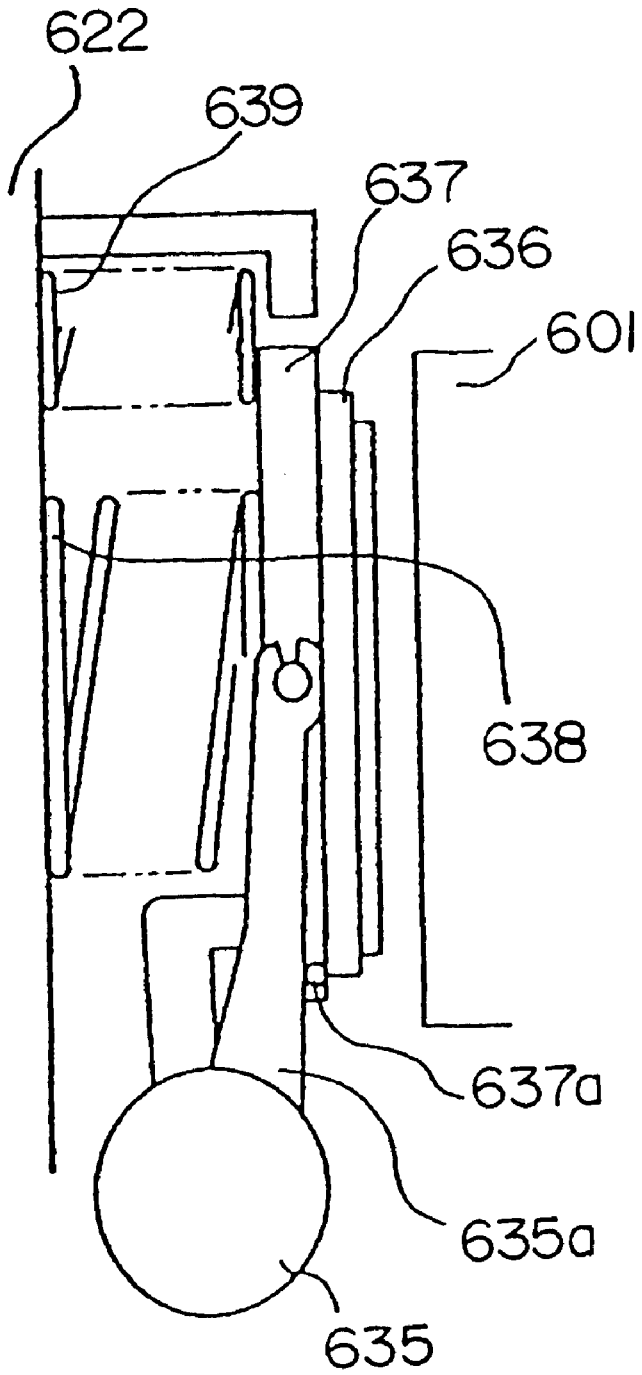
FIG. 69 is a operational diagram showing the recovery system in the printer portion of the recording apparatus as the embodiment of the invention.

Referring to FIG. 67 to FIG. 69, a method for pressing and releasing the cap 636 to the recording head cartridge 601 is described.

As described above, the cap 636 unitedly held to the cap holder 637 is coupled to the cylinder 635 with a seal, and the cap holder 637 is rotatably held to the cylinder arm 635*a* with respect to the cylinder 635.

Although the cap 636 and the cylinder 635 are coupled by the joint portions 636*a*, 635*b*, the cap 636 and the cylinder 635 do not disturb the rotation of the cap holder 637 at all because the joint portion 636*a* is made of an elastic body such as, e.g., chloric butyl rubber, unitedly with the cap 636 and formed in an L-letter shape to be easily deformed (see, FIG. 68).

As shown in FIG. 68, a different-diameter compression cap spring 638 is disposed below the cap holder 637 between the platen 622 and the cap holder 637, and the spring always urges the cap holder 637 toward the side of the recording head cartridge. The cylinder 635 is rotatably supported on a cylinder shaft by the platen 622.

Accordingly, the cylinder 635 and the cap 636 receive rotational force by the different-diameter compression cap spring 638 around the cylinder shaft as a center. A cylinder control portion 635*d* is unitedly formed to the cylinder 635 as shown in FIG. 67, and a tip of the cylinder control portion 635*b* is in contact with a cap control cam portion 633*b* as a first cam member of the pump gear 633.

Accordingly, the rotation of the cylinder 635 is controlled by the cap control cam portion 633*d* of the pump gear 633 through the cylinder control portion 635*d*.

That is, by moving up and down the cylinder control portion 635*b* along the cap control cam portion 633*d* of the pump gear 633, capping and releasing of capping of the cap 636 can be made with respect to the recording head cartridge 601 through the cylinder 635.

FIG. 68 shows a compression state of the cap 636 to the recording head cartridge 601; FIG. 69 shows a releasing state. In FIG. 68, numeral 639 is a cap control spring, and the whole length of the cap control spring 639 is limited by a spring restricting portion 622*d* of the platen 622 and is separated from the lower surface of the cap holder 637. The spring therefore does not affect the pressing state of the cap 636.

FIG. 69 shows a state that the cylinder 635 rotates by the rotation of the pump gear 633 and that the cap 636 is separated. With this state, the cap control spring 639 contacts with the lower surface of the cap holder 637, thereby providing rotational force in the clockwise direction to the cap holder 637. The cap holder 637 according to this rotates in the clockwise direction, but stops rotating where a stopper 637*a* formed as to project from the cap holder 637 contacts with the cylinder arm portion 635*a*.

At that time, if the position of the stopper 637*a* is set as to make parallel the cap 636 and the recording head cartridge 601, the relation between the cap 636 and the recording head cartridge 601 can be always maintained to be parallel when the cap is released.

As advantages of the above structure, since the position at a time of cap releasing is made stable, the cap 636 does not contact with the recording head cartridge 601 because of inclination of the cap 636 and the cap holder 637 even where the moving amount is made small for releasing the cap 636, so that the apparatus can be made compact.

It is to be noted that the pump gear 633 is selectively coupled to the LF gear 621, and the drive force of the feeding motor, not shown, is transmitted to the LF gear 621 through a gear series, not shown, and then, the drive force transmitted to the LF gear 621 is further transmitted to the pump gear 633 if a clutch operation is performed from the movement of the carrier 604. If the carrier 604 does not perform the clutch operation, the transmission to the LF gear 621 is cut off because the pump gear 633 partly has the cutout portion, and no drive force is transmitted to the pump gear 633.

Now, the piston shaft 640 and movements of the piston 641 are described.

In FIG. 67, the pump gear 633 is coupled to the cylinder gear 634. That is, the drive of the LF gear 621 is transmitted to the pump gear 633 where the carrier 604 as described above performs the clutch operation, and further transmitted to the cylinder gear 634. Moreover, the rotation movement of the pump gear 633 can be converted to a liner movement of the piston shaft 640 by stopping the rotation of the piston shaft 640 by fitting a boss 643*a* formed on an inner wall of the cylinder gear 634 in a leading groove 640*a* formed at the piston shaft 640 and by fitting a guide 635*a* formed at the cylinder 635 into the groove 640*b* formed at a tip of the piston shaft 640.

The piston shaft 640 is formed with two flange portions 640*c*, 640*d* formed unitedly with the shaft.

The piston 641 in a so-called donut shape having a through hole at a center made of an elastic member such as a silicone rubber, NBR rubber or the like is set between the flange portions. The cylinder 635 and the piston 641 are in the cylindrical shape as a matter of course, and the outer diameter of the piston 641 is larger than the inner diameter of the cylinder 635, having some stroke margin (about 0.2 to 0.55 mm).

Accordingly, the cylinder inner wall and the piston outer wall can maintain sealing property during move of the piston 641.

The cylinder seal 642 is also in a donut shape. The outer diameter of the cylinder seal 642 has sealing property with the inner diameter of the cylinder, and the inner diameter of the cylinder seal 642 has sealing property with the piston shaft 640. A cylinder washer is engaged at a stepwise portion formed at the cylinder 635. A rib 641*a* is formed on a side surface of the piston 641 around the whole round surface as to face to the flange portion 640*c*, and the inner diameter of the piston 641 is larger than the outer diameter of the piston shaft 640 to form a gap.

The width of the piston 641 is made smaller than the distance between the two flange portions formed at the piston shaft 640. Those gaps works for draining absorbed ink and are described below.

The initial state of the pump is, as shown in FIG. 67, that the piston shaft is pulled up, or namely, the piston 641 is pushed by the flange portion 640*d*, and located at a position shown in FIG. 67.

Figure 70:
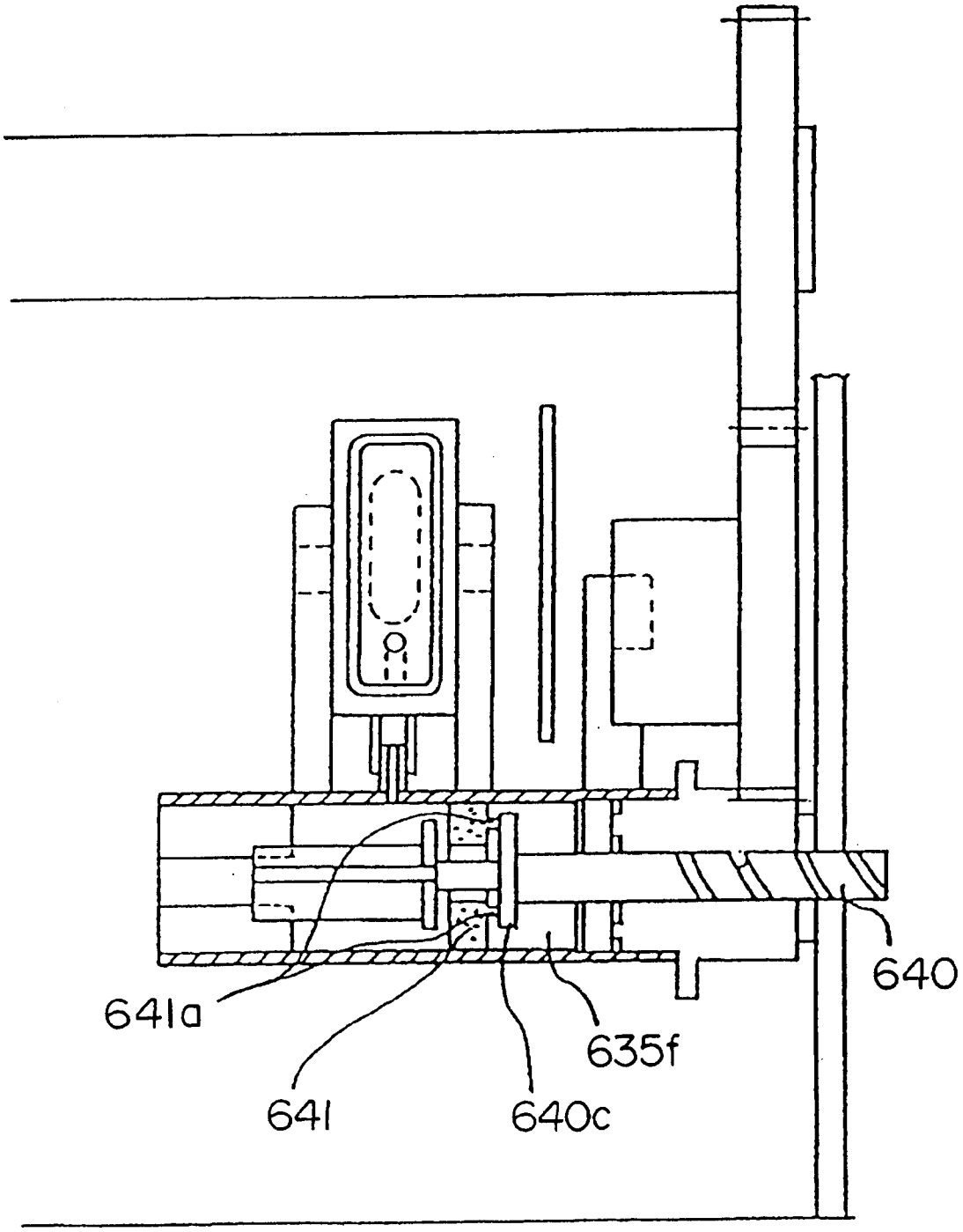
FIG. 70 is a operational diagram showing the recovery system in the printer portion of the recording apparatus as the embodiment of the invention.
Figure 71:
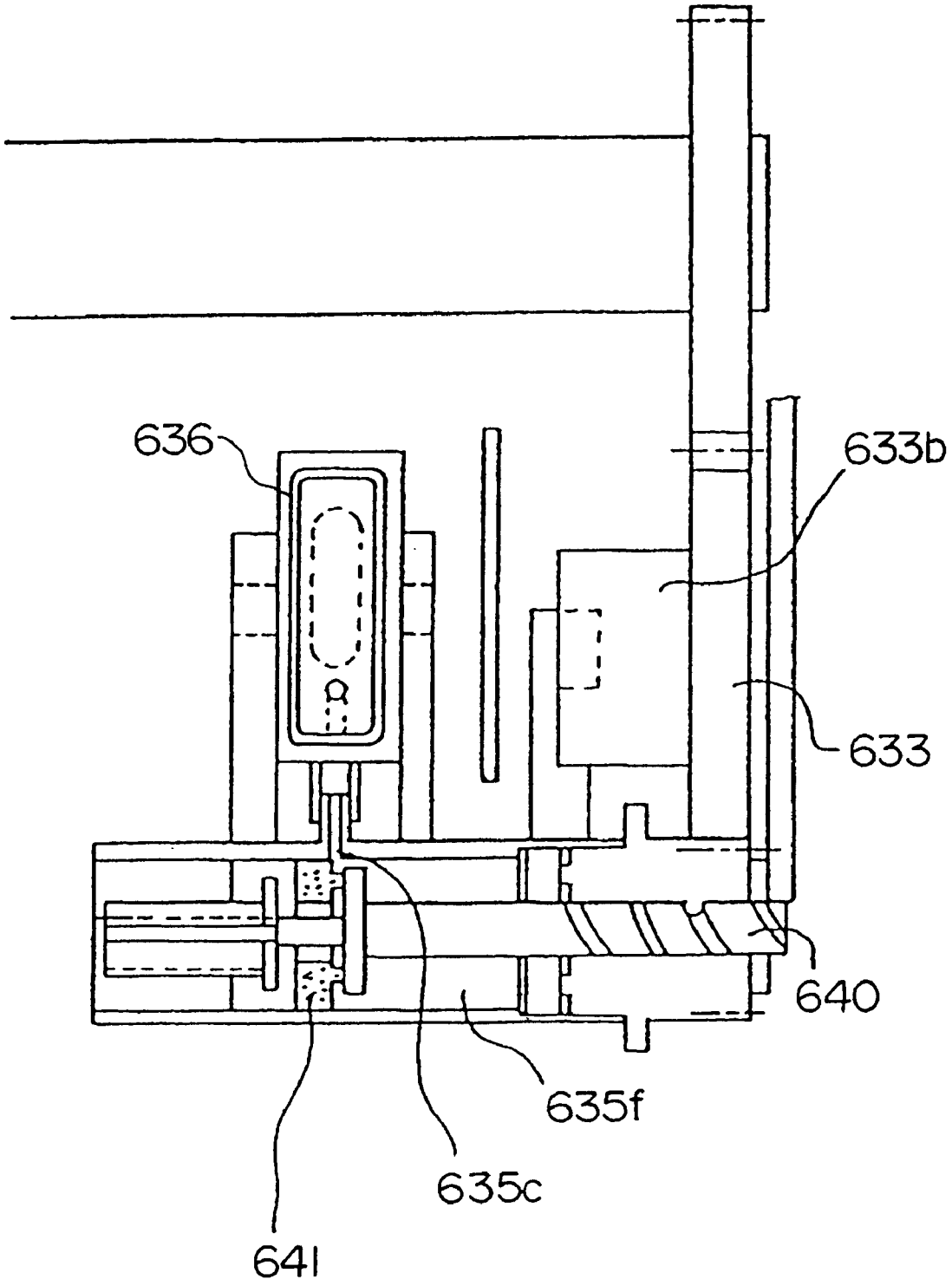
FIG. 71 is a operational diagram showing the recovery system in the printer portion of the recording apparatus as the embodiment of the invention.

When an absorbing signal is outputted from the controller, the carrier 604 performs a latch operation, and drive is transmitted from the LF gear 621 to the pump gear 633, and the cylinder gear 634. The rotation of the cylinder gear 634 is converted to the liner motion of the piston shaft 640.

Where the piston shaft 640 moves in the left direction in the drawing, the flange portion 640*c* as shown in FIG. 70 presses a piston side surface rib 641*a*, thereby rendering a space 635*f* on a right side of the piston 641 at a sealing state.

As the piston shaft 640 further goes left side, the space 635*f* is gradually subject to a pressure equal to or less than the atmospheric pressure (negative pressure state) because the space 635*f* increases the volume as sealed state. This negative pressure is gradually increased as move of the piston shaft 640 (piston 641), and it becomes maximum when the end of the side surface of the piston 641 passes by the ink absorbing opening 635*c* (see, FIG. 71).

This is because ink or air flows into the space 635*f* from the outside through the ink absorbing opening 635*c* and the cap 636 when the space 635*f* comes in communication with the ink absorbing opening 635*c*, thereby canceling the negative pressure in the space 635*f*. Ink can be absorbed by forming the cap control cam portion 633*b* formed at the pump gear 633 so as to seal the cap 636 with respect to the recording head cartridge 601 when the piston 641 passes by the ink absorbing opening 635*c*.

Figure 72:
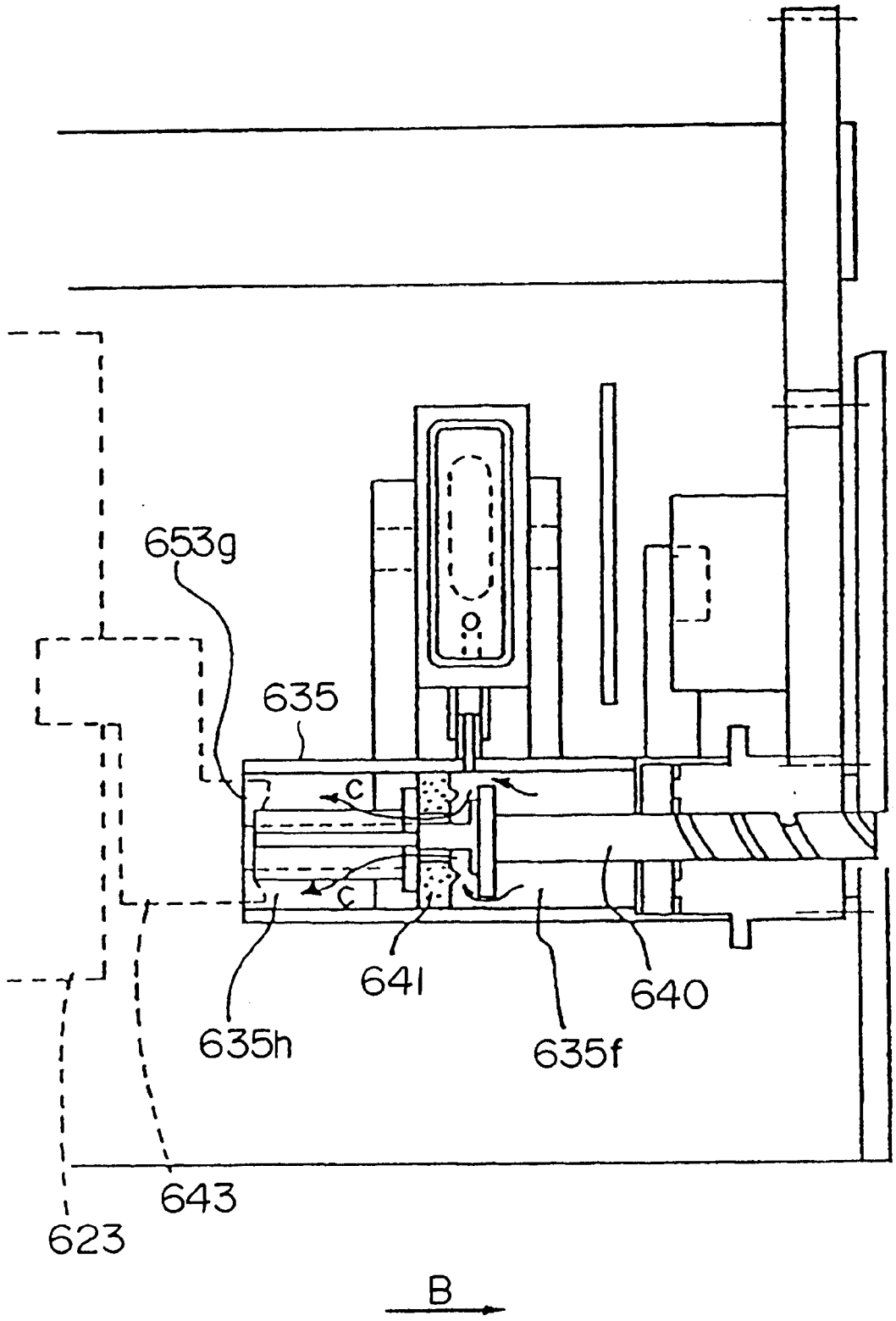
FIG. 72 is a operational diagram showing the recovery system in the printer portion of the recording apparatus as the embodiment of the invention.

Referring to FIG. 72, drain of ink in the cylinder is described next. The ink absorbed out of the recording head cartridge 601 as described above stays in the space 635*f* in the cylinder. Where the motor is reversely rotated and where the piston shaft 640 is pulled up (arrow B direction), the ink staying at the space 635*f* moves to a space 635*h* on a left side of the piston 641 (flow of arrow C in FIG. 72) through a gap between the piston 641 and the piston shaft 640 according to pulling up of the piston shaft 640 (the piston 641) because the width of the piston 641 is small in comparison with the piston shaft 640 between the flange portions and because the inner diameter of the piston is larger than the outer diameter of the piston shaft 640. As repeating reciprocal movements of the piston shaft 640 (piston 641), ink can be gradually drained from an end 635*g* of the cylinder 635.

The cylinder absorber 643 is inserted to the cylinder end 635*g*. The cylinder absorber 643 is formed of a foamed sponge, which is selected from material having good ink transfer property. That is, property for effectively draining ink staying in the cylinder 635 to the outside is required, and in this embodiment, a melamine resin based foamed material is used.

The cylinder absorber 643 is in contact with the waste ink absorber 623 contained in the platen 622. The waste ink absorber 623 is selected from materials having high ink possessing property such as paper multilayered sheet or polymer absorbing body or the like.

With this structure, the waste ink absorbed from the recording head cartridge 601 reaches the waste ink absorber 923 through the cylinder 635 and the cylinder absorber 643 and is stored there.

Printer, Head Mounting Portion

In the above description, exemplified is that the recording head cartridge 601 is detachably mounted to the carrier 604 of the recording apparatus. This is further described in reference to FIG. 73, FIG. 74, FIG. 75 and FIG. 76 in detail.

Figure 74:
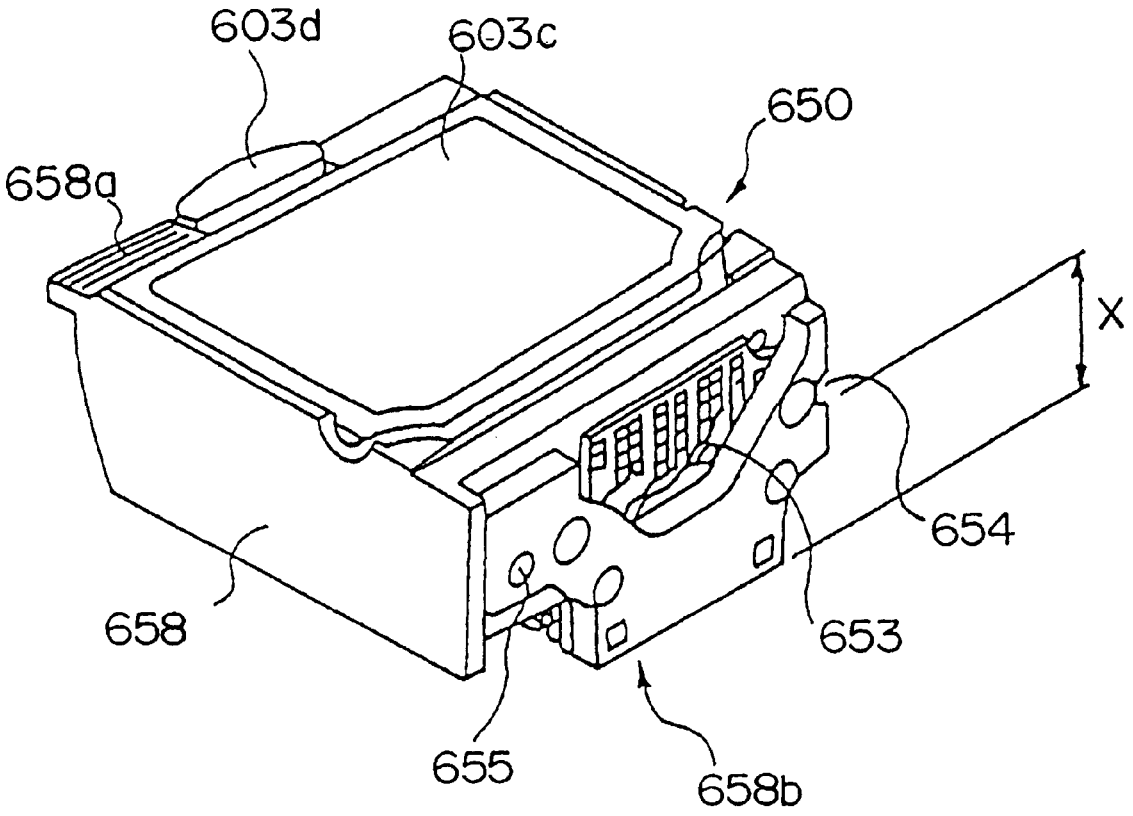
FIG. 74 is a perspective view showing a monochrome recording head used for the printer portion of the recording apparatus as the embodiment of the invention.
Figure 75:
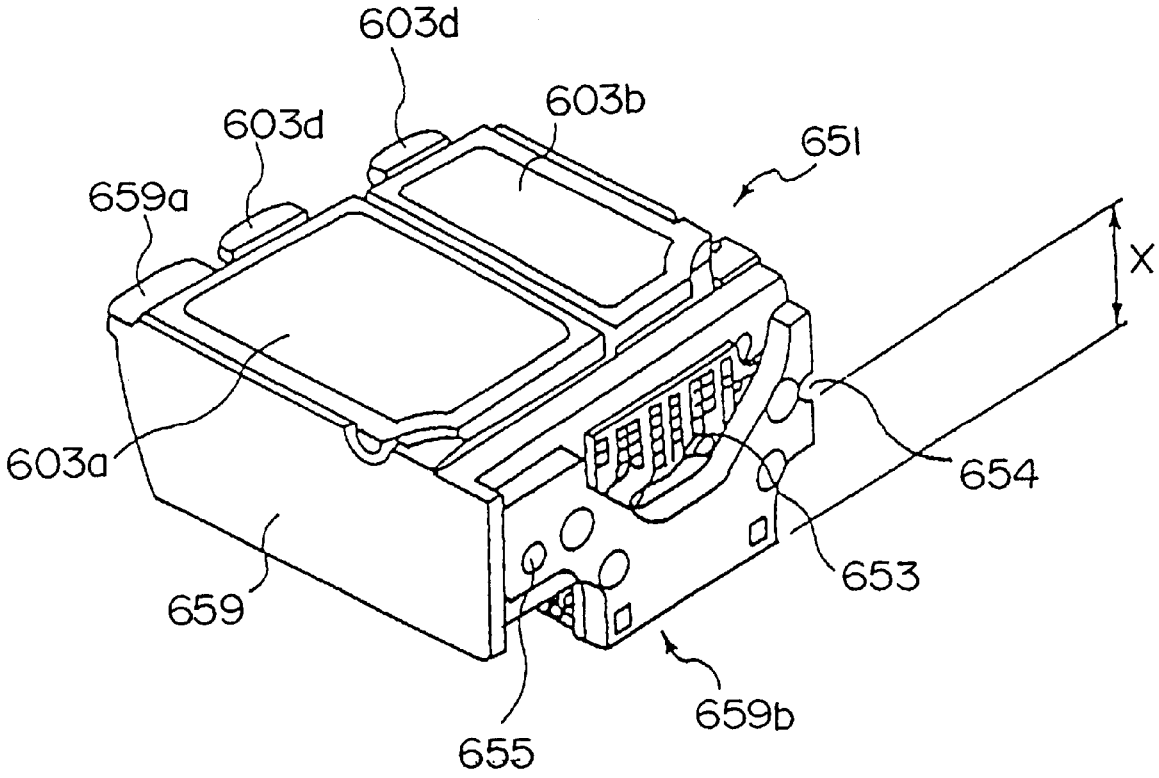
FIG. 75 is a perspective view showing a color recording head used for the printer portion of the recording apparatus as the embodiment of the invention.
Figure 76:
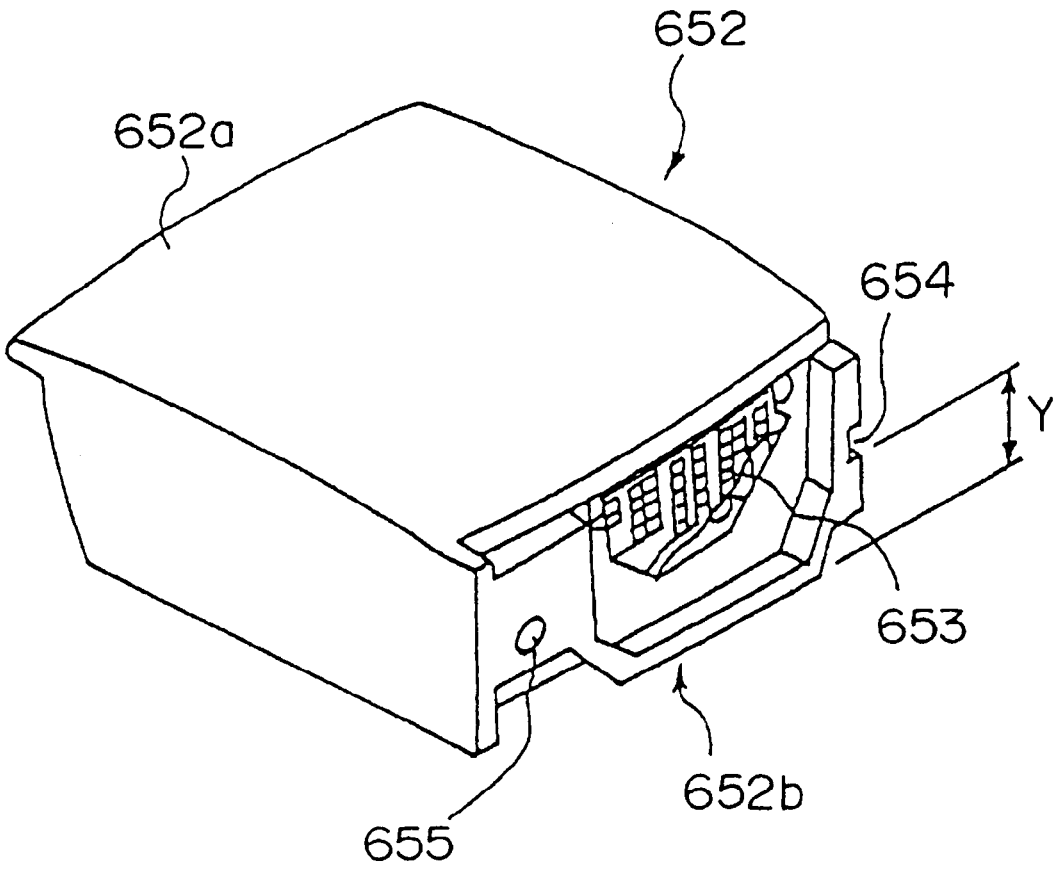
FIG. 76 is a perspective view showing a scanner head portion used for the printer portion of the recording apparatus as the embodiment of the invention.

As the recording head cartridge 601, more specifically, there are two types of a monochrome recording head portion 650 as shown in FIG. 74 and a color recording head portion 651 as shown in FIG. 75, and furthermore, a scanner head 652 capable of reading original documents inserted instead of the recording sheets 111 as shown in FIG. 76 exists. Any one of the head positions of three types in total can be mounted to the carrier 604 in this apparatus. Hereinafter, the monochrome recording head portion 650, the color recording head portion 651, and the scanner head 652 of the three types are collectively referred to as head portions.

Figure 73:
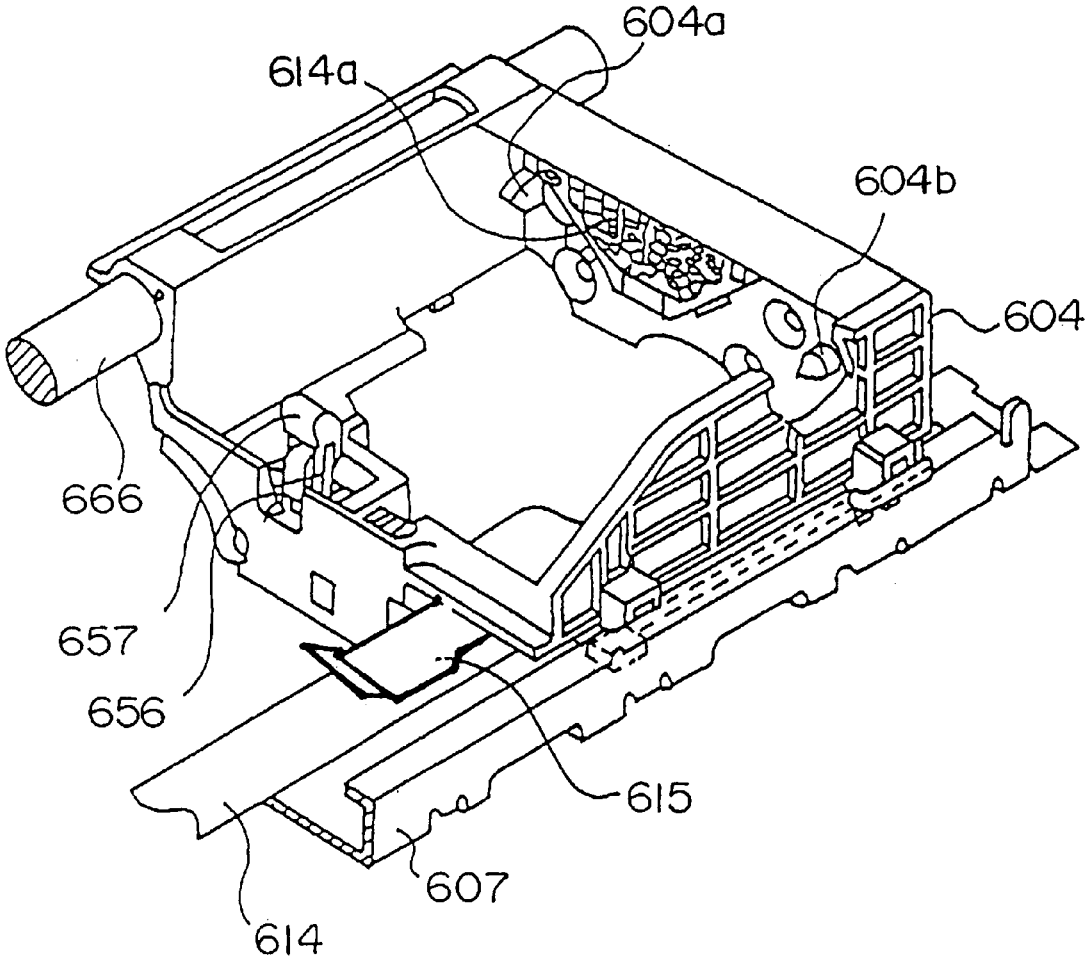
FIG. 73 is a perspective view showing a carrier portion when a head portion is mounting nothing.

First, in FIG. 73, a description is made for the head portions of the above three types to be detachably mounted. FIG. 73 is a perspective view of the carrier 604 where no head portion is mounted.

A cable terminal portion 614*a* for flexible cable is formed at one end of the carrier 604. The cable terminal portion

614*a* is to contact with a head terminal portion 653 (see, FIG. 74, FIG. 75, FIG. 76) when any of the monochrome recording head portion 650, the color recording head portion 651, and the scanner head 652 is mounted on the carrier 604, and this brings electrical connections to the head portion.

Two head portion positioning projections 604*a*, 604*b* are unitedly formed on the surface at which the cable terminal portion 614*a* of the carrier 604 is located. Where the head portion is mounted on the carrier 604, the head portion positioning projection 604*a* fits in a positioning cutout 654 on a head portion side, and the head portion positioning projection 604*b* fits in a positioning cutout 655 on a head portion side, respectively, so that the head portion is accurately positioned with respect to the carrier 604.

A contact spring 656 is formed at a position of the carrier 604 facing to the cable terminal portion 614, and at a tip thereof, a head guide 657 molded of a resin is secured. That is, the head guide 657 is supported to the carrier 604 elastically.

Where the head portion is mounted on the carrier 604, the head guide 657 realizes electrical connections between the cable terminal portion 614*a* and the head terminal portion by urging the head portion to a side of the cable terminal portion 614*a*.

The head guide 657 can be detachably attached in made to bend when the head portion is replaced and has a function to hold the mounted head portion not to disengaged upward.

Since the apparatus is thus structured, when a user replaces the head portion, the head terminal portion side of the head portion is inserted as to face to the cable terminal portion 614*a* of the carrier 604, and by pushing a top of the head portion downward, mounting of the head portion is completed with a click feeling where the head guide 657 is bent. Electric connections are also completed at that time.

To remove the head portion, head portion detaching controlling portions 658*a*, 659*a*, 652*a* formed at the head portion are pulled up by fingers to bend the head guide 657, thereby being capable of disengaging the head portion from the carrier 604.

Printer, Head Portion

The respective head portions are described next in reference to FIG. 74, FIG. 75, and FIG. 76.

FIG. 74 is a perspective view of the monochrome recording head portion 650 for printing in a single color (normally black). In FIG. 74, numeral 658 is a monochrome recording head cartridge, and a spraying opening surface 658*b* having a nozzle portion for spraying ink for recording is formed at a near portion of the recording head cartridge 658. Numeral 653 indicates a head terminal portion for receiving electrical signals for spraying. Ink is sprayed downward in FIG. 74 from the nozzles formed at the spraying opening surface 658*b* to make recording upon supplying electrical signals to the monochrome recording head cartridge 658 from the printer unit 600 through the head terminal portion 653. Numeral 654 shows a positioning cutout; numeral 655 shows a positioning hole. The positioning cutout 654 and the positioning hole 655 ensure positioning of the head portion with respect to the carrier 604 by fitting the cutout 654 and the hole 655 to head portion positioning projections 604*a*, 604*b* formed at the carrier 604.

Numeral 603*c* indicates a monochrome ink tank, whose inside contains ink. The monochrome ink tank 603*c* is detachably secured to the monochrome recording head cartridge 658 by means of a latch portion 603*d* formed unitedly and elastically at the monochrome ink tank 603*c*. The monochrome ink tank 603*c* and the monochrome recording head cartridge 658 have ink liquid routes by a joint portion detachable not shown.

Accordingly, if the ink is consumed by recording to render the ink in the monochrome ink tank 603*c* gone, the monochrome ink tank 603*c* is disengaged from the monochrome recording head cartridge 658 by bending the latch portion 603*d*, and a new monochrome ink tank 603*c* is mounted to continue recording.

FIG. 75 is a perspective view of the color recording head cartridge 651 for performing color recording. In FIG. 75, numeral 659 indicates a color recording head cartridge, and a spraying opening surface 659*b* having a nozzle portion for spraying ink for recording is formed at a near portion of the recording head cartridge 659. Hereinafter, only differences from the monochrome recording head cartridge 650 are described. The spraying opening surface 659*b* is fonned with independent nozzle groups of four kinds for spraying four colors of yellow, magenta, cyan, and black to make color recording. Numeral 603*b* indicates a black ink tank. The black ink tank 603*b* contains black ink inside and is coupled to a black nozzle group formed at the spraying opening surface 659*b* through a joint portion detachably attached, not shown.

Numeral 603*a* indicates a color ink tank. The interior of the color ink tank 603*a* is divided into three independent volumes, each of which any one of the yellow ink, magenta ink, and cyan ink is contained. In the color ink tank 603*a*, in the same manner as the black ink tank 603*b*, the yellow ink is coupled to the nozzle group for yellow, the magenta ink is coupled to the nozzle group for magenta, and the cyan ink is coupled to the nozzle group for cyan, through three independent joint portions detachably attached but not shown.

Numeral 603*d* on the side of the black ink tank 603*b* indicates a latch portion for replacement of the black ink tank 603*b*; numeral 603*d* on the side of the color ink tank 603*a* indicates a latch portion for replacement of the color ink tank 603*a*.

As described above, color recording can be made by mounting the color recording head portion 651 to the printer unit 600. If the black ink is emptied, only the black ink tank 603*b* can be replaced, and if any of the yellow, magenta, and cyan or all is emptied, the color ink tank 603*a* only can be replaced.

FIG. 76 is a perspective view of the scanner head 652. A detailed description is below.

In FIG. 74, FIG. 75, letter X represents a distance from the positioning cutout 654 to the spraying opening surfaces 658*b*, 659*b*, which is the same value in the monochrome recording head cartridge 658 as well as in the color recording head cartridge 659. In this invention, it is about 13 mm. To the contrary, in the scanner head 652 in FIG. 76, letter Y represents a distance from the positioning cutout 654 to the reading portion surface 652*b*, which is designed shorter than the letter X, and in this invention, it is about 9 mm.

From this Y value, a horizontal line difference in the vertical direction between the spraying opening surface position and the reading portion surface is 4 mm as the difference between 13 mm and 9 mm, as described above.

Therefore, when the scanner head 652 is mounted, the reading portion surface 652*b* of the scanner head 652 does not contact with the cap 636 and a blade 644, together even where the capping operation and a wiping operation are executed.

As a result of this structure, when the scanner head 652 is mounted, the apparatus can prevent the reading surface 652*b* from becoming unclean due to cap 636 and blade 644 with ink.

Printer, Scanner Portion

Figure 77B:
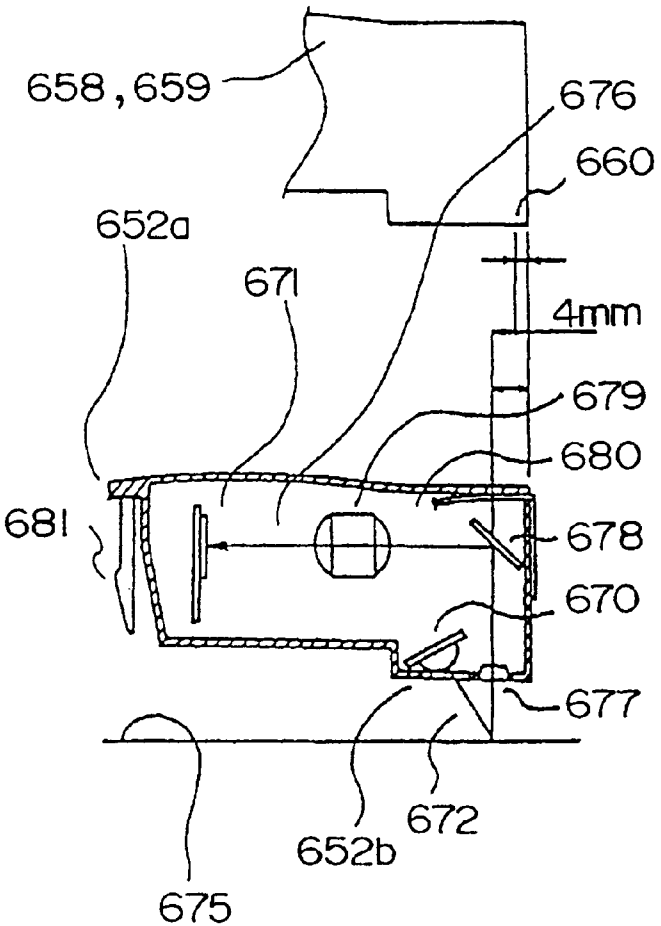
FIGS. 77(*a*) and 77(*b*) is a schematic cross section and a perspective view showing a scanner head used for the printer portion of the recording apparatus as the embodiment of the invention.
Figure 77A:
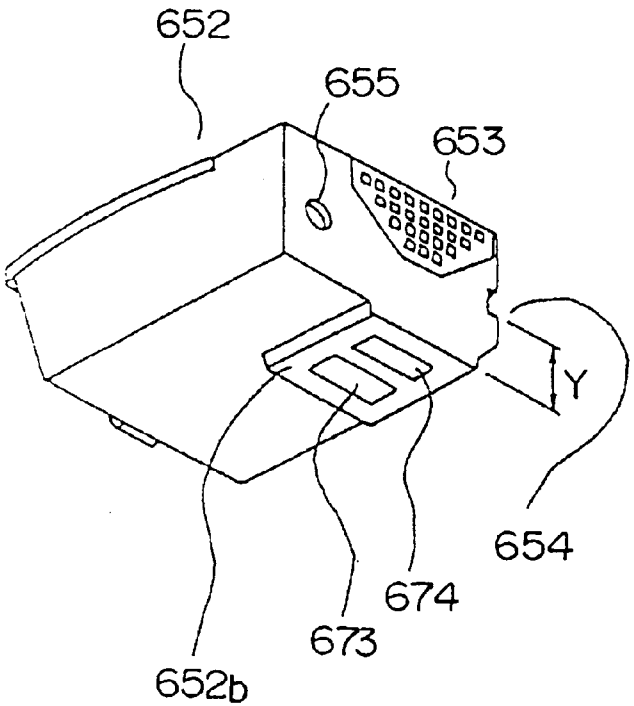

Next, the scanner portion as a feature of the recording apparatus of the invention is described. FIG. 77 shows a schematic cross section and a perspective view of the scanner head 652.

In FIG. 77, numeral 670 represents an LED for illumination for original document surface 675. The LED beam 672 emitted from the LED 670 passes an LED opening 673 to illuminate the original document surface 675, and image light 676 on the original document surface 675 passes a field lens 677 formed at a sensor opening 674. The light path is then bent perpendicularly by a mirror 678, and the light passes a lens for forming image and creates an image on a sensor 671.

The center of the sensor opening 674 is large in comparison with the distance of the ink spraying opening 660 of the monochrome recording head cartridge 658 and the color recording head cartridge 659 from the contact surface of the respective recording head cartridges with the carrier 604, and in this embodiment, it is shifted 4 mm.

The LED 670 and the sensor 671 are electrically connected and pulled out to the outside by an interconnection board 680. Electrodes are formed on the head terminal portion 653 of the interconnection board 680, and are in pressed contact with electrodes of the carrier 604, not shown, thereby introducing signals to the control circuit on the apparatus body.

The scanner head 652 has the same appearance as a shape in which an ink tank 603 is mounted to the recording head cartridge 601, and the head 652 can be mounted by a latch of a nail portion 681 as a part of external decorations to the carrier 604 in the same manner as the recording head cartridge 601. When disengaged, the scanner head can be readily removed by disengaging the latch of the nail portion 681 where the head portion detaching controlling portion 652*a* is lifted.

When the scanner is attached to the carrier 604, the controller automatically judges the scanner and enters in the scanner mode.

The controller, when inputting scanner reading signal from a host computer or the like, conveys, in the same manner as the recording sheets 11, the original document to be read to a prescribed position by drive of the feeding motor 609. After the LED 670 is turned on, image signals are read through a scanner driver portion in driving the carrier motor 608.

The drive speed of the carrier motor can be changed according to the original document reading mode of the scanner head 652. The mode is a combination of the reading definition and grayscale of the reading values. The apparatus has a resolution of 360 dpi in the main scanning direction as paper conveyance direction. The sensor 672 of the scanner head 652 has the resolution of 360 dpi in a sub-scanning direction as a scanning direction of the carrier 604. Because the apparatus can obtain 64 level grayscales output, there are modes such as reading of 64 grayscales of 360 dpi in the main scanning direction and 360 dpi in the sub-scanning direction, or reading of 2 levels of 90 dpi in the main scanning direction and 90 dpi in the sub-scanning direction, or reading of 200 dpi as the resolution in the main scanning direction in consideration of compatibility to fax machines. With the mode having a large data amount such as reading of 64 grayscales of 360 dpi in the main scanning direction and 360 dpi in the sub-scanning direction, data processing and data transmission takes time, so that the carrier drive speed is made slow, whereas the carrier drive speed is made fast in the mode of reading of 2 levels of 90 dpi in the main scanning direction and 90 dpi in the sub-scanning direction.

When one line reading finishes, the feeding motor 609 conveys the sheet by one line to read the next line. This operation is done until the original document reaches the end.

As described above, the recording apparatus of the invention can perform recording to the recording sheets 111 by means of the recording head cartridge 111 and reading of the original document by means of the scanner head 652, and hereinafter, where the recording sheet 111 is referred, it implies that the sheet includes the original document except that the description is only for recording.

Printer, Recovery Operation During Printing

Figure 78:
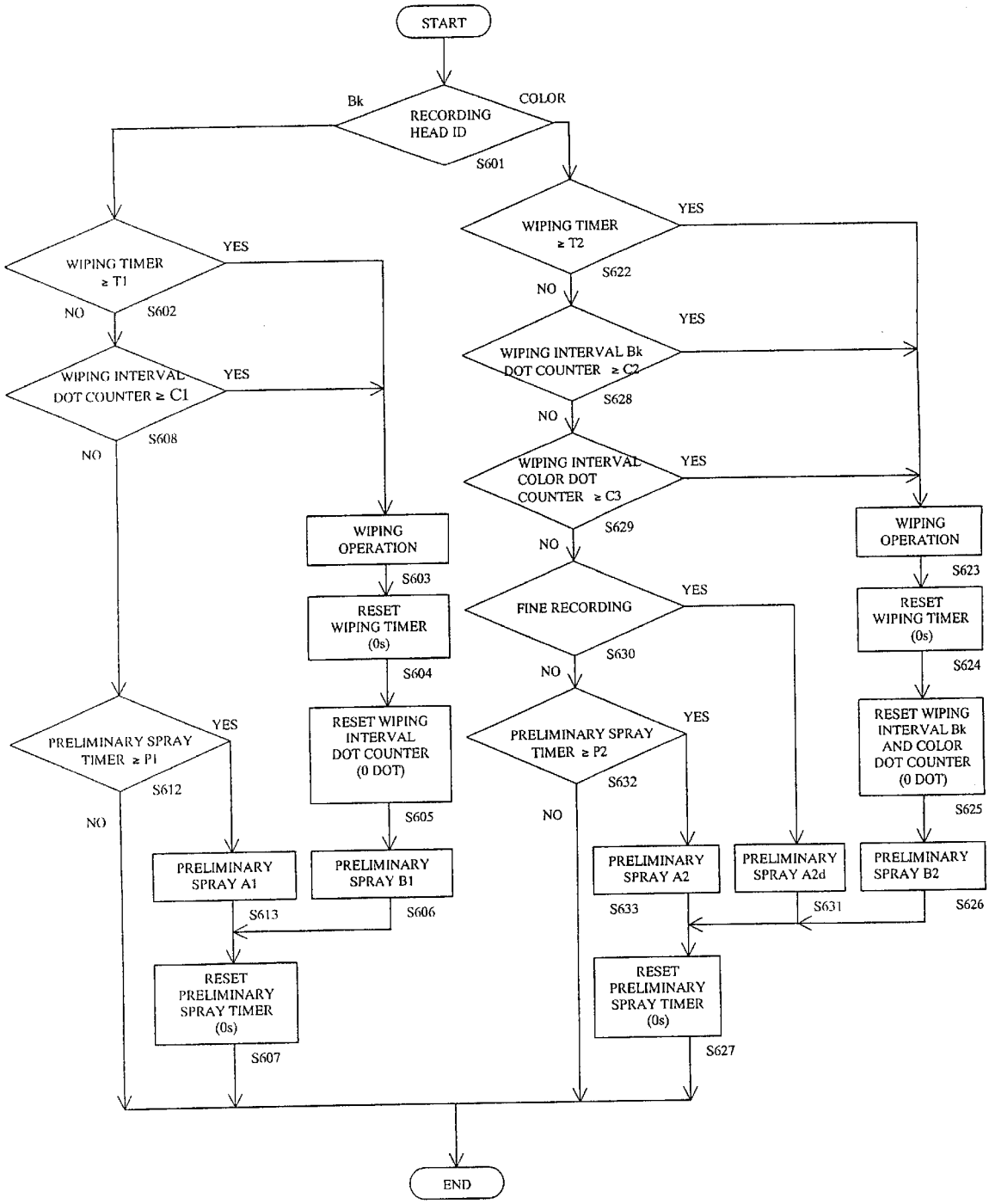
FIG. 78 is a flowchart showing recovery operation during printing used for the printer portion of the recording apparatus as the embodiment of the invention.

Next, referring to a flow chart of FIG. 78, recovery operation during printing of the recording head cartridge 601 of the recording apparatus of the invention is described.

Ink spraying of the recording head cartridge 601 is controlled by the MPU 702 and the controller 701. When recording starts according to a recording instruction, ajudgment is made as to whether the recording head cartridge 601 is the monochrome recording head cartridge 658 or the color recording head cartridge 659 (S601).

If the recording head cartridge 601 is judged as the monochrome recording head cartridge 658, with a wiping timer, ajudgment is made as to whether a passed time from the previous wiping exceeds a prescribed time T1 (S602). As for this prescribed time T1, for example 120 seconds may be set. If the passed time from the previous wiping exceeds a prescribed time T1, wiping operation is executed because ink adhered to the spraying opening surface 658*b* of the monochrome recording head cartridge 658 may be solidified and not be removed easily, and the ink adhered to the spraying opening surface 658*b* of the monochrome recording head cartridge 658 is wiped out by the blade 644 (S603).

When this wiping operation ends, the wiping timer is set to zero second (S604). Then, a wiping interval dot counter as described below is set to zero (S605). By the wiping operation, the ink adhered to the spraying opening surface 658*b* of the monochrome recording head cartridge 658 is removed by the blade 644, but removed ink may be pushed into the respective spraying openings when the blade 644 passes over the respective spraying openings. If recording is made as it is, recording quality becomes lower. To prevent this, preliminary spraying operation B1 is executed (S606) to remove the pushed ink after wiping operation. The ink spraying number from the respective spraying openings during this preliminary spraying operation B1 can be set to, for example, 250 times equally to all spraying openings, with spraying frequency of 2 kHz. After this preliminary spraying operation B1 ends, the preliminary spraying timer as described below is set to zero second (S607), and the program ends.

Meanwhile, if the passed time from the previous wiping does not exceed the prescribed time T1, the sprayed ink number from the respective spraying openings from the previous wiping is counted up by the wiping interval dot counter, and a judgment is made as to whether the counted value exceeds a prescribed number C1 (S608). As the prescribed number C1, for example, 24,883,200 can be set.

If the ink number sprayed from the respective spraying openings exceeds the prescribed number C1, the steps S603 to S607 are executed because ink mists occurring during printing may adhere to the spraying opening surface 658*b* and ink's projection accuracy may be impaired due to a wet condition of ink at the vicinity of the spraying openings, and the program ends.

In a meantime, if the ink number sprayed from the respective spraying openings does not exceed the prescribed number C1, a judgment is made as to whether a passed time from the previous preliminary spraying (which is different from the passed time measured by the wiping timer) measured by a preliminary spraying timer exceeds a prescribed time P1. As the prescribed time P1, for example, 12 seconds can be set. If the passed time from the previous preliminary spraying exceeds the prescribed time P1, preliminary spraying operation A1 is executed (S613). The ink spraying number from the respective spraying openings during this preliminary spraying operation A1 can be set to, for example, 9 times equally to all spraying openings, with spraying frequency of 2 kHz. After this preliminary spraying operation A1 ends, the preliminary spraying timer is set to zero second (S607), and the program ends. On the other hand, if the passed time from the previous preliminary spraying does not exceed the prescribed time P1, the program ends as it is.

If the recording head cartridge 601 is judged as the color recording head cartridge 659, with a wiping timer, ajudgment is made as to whether a passed time from the previous wiping exceeds a prescribed time T2 (S622). As for this prescribed time T2, for example 60 seconds may be set. If the passed time from the previous wiping exceeds the prescribed time T2, wiping operation is executed because ink adhered to the spraying opening surface 659*b* of the color recording head cartridge 659 may be solidified and not be removed easily, and the ink adhered to the spraying opening surface 659*b* of the color recording head cartridge 659 is wiped out by the blade 644 (S623).

When this wiping operation ends, the wiping timer is set to zero second (S624). Then, a wiping interval black dot counter as described below and a wiping interval color dot counter are set to zero (S625). By the wiping operation, the ink adhered to the spraying opening surface 659*b* of the color recording head cartridge 659 is removed by the blade 644, but removed ink may be pushed into the respective spraying openings when the blade 644 passes over the respective spraying openings. If recording is made as it is, mixed colored inks may be sprayed from the respective spraying openings, and recording quality becomes lower. To prevent this, preliminary spraying operation B2 is executed (S626) to remove the mixed inks after wiping operation. The ink spraying number from the respective spraying openings during this preliminary spraying operation B2 can be set to, for example, 90 times equally to all black ink spraying openings, with spraying frequency of 2 kHz.

Moreover, the number can be set to, for example, 200 times equally to all spraying openings for yellow ink, magenta ink, and cyan ink, with spraying frequency of 2 kHz. After this preliminary spraying operation B2 ends, the preliminary spraying timer as described below is set to zero second (S627), and the program ends. Meanwhile, if the passed time from the previous wiping does not exceed the prescribed time T2, the black ink number from the respective black ink spraying openings from the previous wiping is counted up by the wiping interval black dot counter, and a judgment is made as to whether the counted value exceeds a prescribed number C2 (S628). As the prescribed number C2, for example, 6,220,800 can be set. If the black ink number sprayed from the respective black ink spraying openings exceeds the prescribed number C2, the steps S623 to S627 are executed because ink mists occurring during printing may adhere to the spraying opening surface 659*b* and ink's projection accuracy may be impaired due to a wet condition of ink at the vicinity of the spraying openings, and the program ends.

If the black ink number sprayed from the respective black ink spraying openings does not exceed the prescribed number C2, the color ink number from the respective color ink (yellow ink, magenta ink, and cyan ink) spraying openings from the previous wiping is counted up by the wiping interval color dot counter, and ajudgment is made as to whether the counted value exceeds a prescribed number C3 (S629). As the prescribed number C3, for example, 2,488,320 can be set. If the color ink number sprayed from the respective color ink spraying openings exceeds the prescribed number C3, the steps S623 to S627 are executed because ink mists occurring during printing may adhere to the spraying opening surface 659*b* and ink's projection accuracy may be impaired due to a wet condition of ink at the vicinity of the spraying openings, and the program ends.

Meanwhile, if the color ink number sprayed from the respective color ink spraying openings does not exceed the prescribed number C3, a judgment is made as to whether the recording mode is fine recording (S630). If the recording mode is fine recording, preliminary spraying operation A2*d* is executed to further improve the recording quality (S631). The ink spraying number from the respective spraying openings during this preliminary spraying operation A2*d* can be set to, for example, 3 times equally to all black ink spraying openings, with spraying frequency of 2 kHz. Moreover, the number can be set to, for example, 9 times equally to all spraying openings for yellow ink, magenta ink, and cyan ink, with spraying frequency of 2 kHz. The reason having the preliminary spraying times different between the black ink and the color ink is that fogs by color ink tend to be easily recognizable with respect to the recording quality whereas fogs by black ink tend to be not easily recognizable and that ink consumption is intended to be reduced as much as possible. After the preliminary spraying operation A2*d* ends, the preliminary spraying timer is set to zero second (S627), and the program ends.

If the recording mode is not fine recording, a judgment is made as to whether a passed time from the previous preliminary spraying (which is different from the passed time measured by the wiping timer) measured by a preliminary spraying timer exceeds a prescribed time P2 (S632). As the prescribed time P2, for example, 10 seconds can be set. If the passed time from the previous preliminary spraying exceeds the prescribed time P2, preliminary spraying operation A2 is executed (S633). The ink spraying number from the respective spraying openings during this preliminary spraying operation A2 can be set to, for example, 9 times equally to all spraying openings, with spraying frequency of 2 kHz. After this preliminary spraying operation A2 ends, the preliminary spraying timer is set to zero second (S627), and the program ends.

The above flow is repeated every line until a printing end instruction comes. As described above, according to this embodiment, the apparatus has the structure that the sheet can be conveyed by projecting the U-turn roller 112*d* into the sheet conveyance route when the ASF motor 406 is driven to rotate in the CW direction, and has the structure having the intermediate conveyance roller moving mechanism for rendering the U-turn roller 112*d* escape from the sheet conveyance route when the ASF motor is driven to rotate in the CCW direction and the intermediate conveyance roller normally feeding mechanism for rotating the U-turn roller 112*d* only in the feeding direction notwithstanding of the rotation direction of the ASF motor 406. Therefore, the sheet can be conveyed stably at the recording section without receiving interference from the U-urn roller 112*d*. Consequently, the apparatus makes an apparatus with high image property.

Moreover, as described above, according to the embodiment, because the ASF clutch 429 formed of a clutch lock mechanism having the ASF lock 444 is unlocked when the U-turn roller 112*d* projects in the sheet conveyance route by rotation of the U-turn roller holders A416, B417, the sheets are stably conveyed during the recording operation of the printer section, and the image quality can be made higher. Moreover, so-called one turn sequence of the feeding roller 112*e* is surely realized with low costs and small space, so that feeding capability can be improved.

What is claimed is:

1. A sheet feeding apparatus for conveying a sheet from a feeding roller to an image processing section, comprising:

an intermediate conveyance roller disposed between the feeding roller and the image processing section;

a drive source providing a rotary drive force to the intermediate conveyance roller;

an intermediate conveyance roller moving mechanism for moving the intermediate conveyance roller to be projecting in a sheet conveyance route so as to be conveyable of the sheet when the drive source is driven in one rotational direction and to be escaping from the sheet conveyance route when the drive source is driven in the other rotational direction; and an intermediate conveyance roller normally feeding mechanism for rotating the intermediate conveyance roller in only one sheet feeding direction notwithstanding of the rotational direction of the drive source.

2. The sheet feeding apparatus according to claim 1, wherein the intermediate conveyance roller moving mechanism includes a pair of rocking gears selectively transmitting the drive force from the drive source, a partly toothless gear capable of engaging with the rocking gears, a cam rotatable in a united body with the partly toothless gear, and an intermediate conveyance roller supporting means for supporting the intermediate conveyance roller and rotating by effect of the cam.

3. The sheet feeding apparatus according to claim 1, wherein the intermediate conveyance roller normally feeding mechanism includes a pair of rocking gears selectively transmitting the drive force to the intermediate conveyance roller, the rocking gears engaging with a gear, to which one rocking gear engages directly and to which the other rocking gear engages via another gear.

4. A sheet feeding apparatus comprising:

a feeding roller rotatively driven through a one-way clutch capable of selectively outputting rotation input for feeding a sheet in a sheet by sheet manner;

an intermediate conveyance roller for conveying the sheet to an image processing section;

intermediate conveyance roller supporting means for supporting the intermediate conveyance roller, the intermediate conveyance roller supporting means rotatable to a position rendering the intermediate conveyance roller project in a sheet conveyance route and to a position rendering the intermediate conveyance roller escape from the sheet conveyance route; and a clutch locking mechanism for locking the one-way clutch to stop rotation output given to the feeding roller and for unlocking the one-way clutch, wherein the one-way clutch is unlocked at a time that the intermediate conveyance roller is projecting in the sheet conveyance route by rotation of the intermediate conveyance roller supporting means.

5. The sheet feeding apparatus according to claim 4, wherein the clutch locking mechanism includes clutch engaging means for engaging the one-way clutch to stop the rotation output to the feeding roller, the clutch engaging means being disengaged from the one-way clutch when the intermediate conveyance roller is projecting in the sheet conveyance route by rotation of the intermediate conveyance roller supporting means.

6. An image processing apparatus comprising:

an image processing section for rendering image processing on a sheet; and a sheet feeding section for feeding the sheet to the image processing section, the sheet feeding section having the image forming apparatus according to any one of claim 1 to claim 5.

7. The image processing apparatus according to claim 6, wherein the image processing section is recording means for recording an image on the sheet.

8. The image processing apparatus according to claim 6, wherein the image processing section is reading means for reading an image on the sheet.

9. A sheet feeding apparatus comprising:

an intermediate conveyance roller for conveying a sheet to an image processing section;

intermediate conveyance roller supporting means for supporting the intermediate conveyance roller, the intermediate conveyance roller supporting means rotatable to a position rendering the intermediate conveyance roller project in a sheet conveyance route and to a position rendering the intermediate conveyance roller escape from the sheet conveyance route;

a feeding roller partly formed with a cutout for feeding the sheet in a sheet by sheet manner; and a locking mechanism for positioning the feeding roller at a prescribed rotational position, wherein the locking mechanism locks the rotation of the feeding roller as the cutout of the feeding roller faces to the sheet conveyance route when the intermediate conveyance roller escapes from the sheet conveyance route by the rotation of the intermediate conveyance roller supporting means, and unlocks the feeding roller when the intermediate conveyance roller projects in the sheet conveyance route by the rotation of the intermediate conveyance roller supporting means.

10. The sheet feeding apparatus according to claim 9, wherein a one-way clutch is disposed between the feeding roller and the drive source, and wherein the locking mechanism locks and unlocks the one-way clutch.

* * * * *

UNITED STATES PATENT AND TRADEMARK OFFICE

CERTIFICATE OF CORRECTION

PATENT NO. : 6,471,202 B1
DATED : October 29, 2002
INVENTOR(S) : Hideo Sugimura

It is certified that error appears in the above-identified patent and that said Letters Patent is hereby corrected as shown below:

Drawings,
Figure 56, “NORMALY” (both occurrences) should read -- NORMALLY --.
Figure 59, “POSISION” should read -- POSITION --.

Column 3,
Lines 3 and 7, “is a” should read -- are --, and “view” should read -- views --.
Line 36, “is a” should read -- are --, and “illustration” should read -- illustrations --.
Line 66, “is a diagram” should read -- are diagrams --.

Column 4,
Lines 1, 54 and 56, “is a diagram” should read -- are diagrams --.
Line 24, “is an” should read -- are --, and “view” should read -- views --.
Line 61, “is a” should read -- are --, and “diagram” should read -- diagrams --.

Column 5,
Line 22, “is a” should read -- are --, and “section” should read -- sections --.
Line 46, “eternal” should read -- external --.

Column 7,
Line 41, “that” should read -- that is --.

Column 8,
Line 39, “is” should read -- are --.

Column 11,
Line 24, “loosen” should read -- loosened --.

Column 13,
Line 49, “and” should read -- to --.

Column 14,
Line 2, “transparent partly.” should read -- partly transparent. --.
Line 30, “transparent” should read -- partly --.
Line 31, “partly.” should read -- transparent. --.
Line 38, “lager” should read -- larger --.

Column 15,
Line 65, “to back” should read -- back --.

UNITED STATES PATENT AND TRADEMARK OFFICE

CERTIFICATE OF CORRECTION

PATENT NO. : 6,471,202 B1
DATED : October 29, 2002
INVENTOR(S) : Hideo Sugimura

It is certified that error appears in the above-identified patent and that said Letters Patent is hereby corrected as shown below:

Column 17,
Line 37, “in” (2nd occurrence) should read -- and --.

Column 18,
Line 64, “comer” should read -- corner --.

Column 20,
Line 61, “cain” should read -- cam --.

Column 21,
Line 55, “U-urn” should read -- U-turn --.
Line 63, “can do” should read -- can not do --.

Column 22,
Line 11, “B427a,” should read -- B427c, --.

Column 23,
Line 12, “is” should read -- is an --.

Column 24,
Line 39, “U-urn” should read -- U-turn --.
Line 45, “442” should read -- 442 to --.

Column 28,
Line 30, “415” should read -- 415 and --.

Column 32,
Line 2, “fonned” should read -- formed --.
Line 40, “sheets” should read -- sheets 111. --.

Column 33,
Line 60, “0.55” should read -- 0.5 --.

Column 37,
Line 26, “in mesh” should read -- enmeshed --.

Column 38,
Line 30, “635b” should read -- 635∂ --.
Line 54, “be always” should read -- always be --.

UNITED STATES PATENT AND TRADEMARK OFFICE

CERTIFICATE OF CORRECTION

PATENT NO. : 6,471,202 B1
DATED : October 29, 2002
INVENTOR(S) : Hideo Sugimura

It is certified that error appears in the above-identified patent and that said Letters Patent is hereby corrected as shown below:

Column 39,
Line 18, “635a” should read -- 635e --.
Line 30, “0.55” should read -- 0.5 --.

Column 41,
Line 4, “is” should read -- are --.
Line 25, “in” should read -- and --.

Column 42,
Line 18, “fonned” should read -- formed --.

Column 43,
Line 47, “11,” should read -- 111, --.

Column 44,
Line 26, “ajudg-” should read -- a judg- --.

Column 45,
Line 27, “ajudg-” should read -- a judg- --.

Column 46,
Line 13, “ajudgment” should read -- a judgment --.

Column 47,
Line 7, “U-urn” should read -- U-turn --.

Signed and Sealed this

Fifteenth Day of April, 2003

JAMES E. ROGAN
*Director of the United States Patent and Trademark Office*